US008905638B2

(12) United States Patent
Moehlenbrock et al.

(10) Patent No.: US 8,905,638 B2
(45) Date of Patent: Dec. 9, 2014

(54) EASY OPEN AND RECLOSABLE PACKAGE WITH DIE-CUT WEB, AND DISCRETE STRIP ANCHORED TO SECOND SIDE PANEL

(75) Inventors: Andrew W. Moehlenbrock, Simpsonville, SC (US); Sumita Sanjeevi Ranganathan, Simpsonville, SC (US)

(73) Assignee: Cryovac, Inc., Duncan, SC (US)

( * ) Notice: Subject to any disclaimer, the term of this patent is extended or adjusted under 35 U.S.C. 154(b) by 224 days.

(21) Appl. No.: 13/220,169

(22) Filed: Aug. 29, 2011

(65) Prior Publication Data

US 2012/0207412 A1 Aug. 16, 2012

Related U.S. Application Data

(60) Provisional application No. 61/443,388, filed on Feb. 16, 2011.

(51) Int. Cl.

| | |
|---|---|
| ***B65D 33/00*** | (2006.01) |
| ***B65D 65/26*** | (2006.01) |
| ***B65B 9/06*** | (2012.01) |
| ***B65B 9/213*** | (2012.01) |
| ***B65B 5/02*** | (2006.01) |
| ***B65D 75/58*** | (2006.01) |
| ***B65B 51/30*** | (2006.01) |
| ***B65B 61/08*** | (2006.01) |
| ***B65D 33/20*** | (2006.01) |
| ***B65D 77/20*** | (2006.01) |
| ***B65B 9/20*** | (2012.01) |
| ***B31B 19/00*** | (2006.01) |
| ***B31B 1/00*** | (2006.01) |

(52) U.S. Cl.

CPC ..... *B31B 1/00* (2013.01); *B31B 2237/406* (2013.01); *B65B 9/06* (2013.01); *B31B 2219/269* (2013.01); *B65B 9/213* (2013.01); *B65B 5/022* (2013.01); *B31B 2219/909* (2013.01); *B31B 2219/9096* (2013.01); *B65D 75/5833* (2013.01); *B65B 51/303* (2013.01); *B65B 61/08* (2013.01); *B65D 33/20* (2013.01); *B31B 2219/6092* (2013.01); *B31B 2237/10* (2013.01); *B65D 77/2048* (2013.01); *B31B 2219/9019* (2013.01); *B31B 2237/50* (2013.01); *B65B 9/2028* (2013.01); *B31B 19/00* (2013.01)

USPC ..... 383/105; 383/200; 383/203; 383/204; 383/207; 383/209; 229/87.05

(58) Field of Classification Search

CPC .... B65D 27/06; B65D 75/58; B65D 75/5827; B65D 75/5833; B65D 75/5844; B65D 75/58555

USPC ..... 383/84–86.2, 66, 200, 203, 204, 207, 383/209, 210, 210.1, 211, 41, 93, 95; 229/300, 301, 80.5, 87.05, 87.01, 229/87.08

See application file for complete search history.

(56) References Cited

U.S. PATENT DOCUMENTS

| | | | |
|---|---|---|---|
| 2,991,001 | A | 7/1961 | Hughes |
| 3,259,303 | A | 7/1966 | Repko |

(Continued)

FOREIGN PATENT DOCUMENTS

| | | | |
|---|---|---|---|
| EP | 0179624 | A2 | 4/1986 |
| EP | 1676785 | A1 | 7/2006 |

(Continued)

OTHER PUBLICATIONS

Wipak Mission Reclosable, Apr. 2006, 8 pages.

(Continued)

*Primary Examiner* — Jes F Pascua
*Assistant Examiner* — Nina Attel
(74) *Attorney, Agent, or Firm* — Mark B. Quatt

(57) ABSTRACT

An easy-open and reclosable package includes a pouch including a discrete strip, between first and second side panels; including a sealing segment, a backing segment, and an intermediate layer including a pressure sensitive adhesive, the first surface of the strip anchored to the inner surface of the first panel at a first location, and the second surface of the strip anchored to the inner surface of the second side panel at a first location; a die cut in the first panel, defining a primary die cut segment so arranged that when the package is opened, it can be reclosed by adhering the adhesive to the first side panel; and a product in the pouch. A secondary die cut segment can be disposed between the primary die cut segment and an end of the package. This secondary die cut can be at least partially underlain by the adhesive.

4 Claims, 37 Drawing Sheets

(56) References Cited

U.S. PATENT DOCUMENTS

| | | | | |
|---|---|---|---|---|
| 3,272,424 | A | 9/1966 | Rodkey | |
| 3,349,993 | A | 10/1967 | Ells et al. | |
| 3,456,867 | A | 7/1969 | Repko | |
| 4,260,061 | A | 4/1981 | Jacobs | |
| 4,280,653 | A | 7/1981 | Elias | |
| 4,410,130 | A | 10/1983 | Herrington | |
| 4,759,643 | A | 7/1988 | Canno | |
| 4,785,940 | A * | 11/1988 | Wilson | 383/204 |
| 4,913,293 | A | 4/1990 | Sanders | |
| 4,934,535 | A * | 6/1990 | Muckenfuhs et al. | 206/494 |
| 5,044,772 | A | 9/1991 | Larson | |
| 5,089,320 | A | 2/1992 | Straus et al. | |
| 5,205,649 | A | 4/1993 | Fullerton | |
| 5,391,136 | A | 2/1995 | Makowka | |
| 5,626,929 | A | 5/1997 | Stevenson | |
| 5,658,077 | A | 8/1997 | Hoftman | |
| 5,806,984 | A | 9/1998 | Yeager | |
| 5,836,697 | A | 11/1998 | Chiesa | |
| 5,855,435 | A | 1/1999 | Chiesa | |
| 5,882,749 | A * | 3/1999 | Jones et al. | 428/35.2 |
| 5,882,789 | A | 3/1999 | Jones et al. | |
| 5,954,433 | A | 9/1999 | Yeager | |
| 6,012,844 | A | 1/2000 | Huseman et al. | |
| 6,131,248 | A | 10/2000 | Tomic | |
| 6,196,716 | B1 | 3/2001 | Geyer | |
| 6,302,321 | B1 | 10/2001 | Reese et al. | |
| 6,461,044 | B1 * | 10/2002 | Anderson | 383/211 |
| 6,502,986 | B1 | 1/2003 | Bensur et al. | |
| 6,517,243 | B2 | 2/2003 | Huffer et al. | |
| 6,659,645 | B1 * | 12/2003 | Schulz | 383/210 |
| 6,969,196 | B2 | 11/2005 | Woodham et al. | |
| 7,033,077 | B2 | 4/2006 | Taylor | |
| 7,165,888 | B2 | 1/2007 | Rodick | |
| 7,422,782 | B2 | 9/2008 | Haedt et al. | |
| 7,527,842 | B2 | 5/2009 | Mathy et al. | |
| 7,681,732 | B2 | 3/2010 | Moehlenbrock et al. | |
| 7,722,255 | B2 | 5/2010 | Tessera Chiesa | |
| 7,927,679 | B2 | 4/2011 | Cruz et al. | |
| 2003/0118254 | A1 | 6/2003 | Razeti et al. | |
| 2004/0013322 | A1 | 1/2004 | Taylor | |
| 2004/0179753 | A1 | 9/2004 | Schneider et al. | |
| 2006/0269707 | A1 | 11/2006 | Berbert | |
| 2008/0152264 | A1 | 6/2008 | Pokusa et al. | |
| 2009/0304874 | A1 | 12/2009 | Stephens et al. | |
| 2009/0311454 | A1 | 12/2009 | Stephens | |
| 2011/0036741 | A1 | 2/2011 | Moehlenbrock | |
| 2011/0038570 | A1 | 2/2011 | Moehlenbrock | |
| 2011/0038571 | A1 | 2/2011 | Moehlenbrock | |
| 2011/0103718 | A1 | 5/2011 | Bosman | |
| 2011/0147383 | A1 | 6/2011 | Soudais et al. | |
| 2011/0162993 | A1 | 7/2011 | Cruz | |
| 2011/0204056 | A1 | 8/2011 | Veternik et al. | |
| 2012/0156415 | A1 | 6/2012 | Willey et al. | |

FOREIGN PATENT DOCUMENTS

| | | |
|---|---|---|
| IT | 01319964 | 3/2000 |
| WO | 0002782 A2 | 1/2000 |
| WO | WO2006/005848 | 1/2006 |
| WO | WO2007057060 | 5/2007 |
| WO | WO2008001768 | 1/2008 |

OTHER PUBLICATIONS

JP 3161665 Aug. 5, 2010, Amano, Y., Abstract 7 Drawings (11 pages).

* cited by examiner

EASY OPEN AND RECLOSABLE PACKAGE WITH DIE-CUT WEB, AND DISCRETE STRIP ANCHORED TO SECOND SIDE PANEL

This application claims the benefit of U.S. Provisional Application No. 61/443,388, filed Feb. 16, 2011, that application incorporated herein by reference in its entirety.

FIELD OF THE INVENTION

This invention relates to an easy-open and reclosable package with a die-cut web, and a discrete strip anchored to a second side panel, and to methods of making the package.

BACKGROUND OF THE INVENTION

Food and non-food products, including produce, snack foods, cheese and the like have long been packaged in containers such as pouches, bags, or lidded trays or formed webs made from various thermoplastic materials such as polyethylene, polypropylene, or polyester (PET). These containers can be formed from a web or webs of thermoplastic material on packaging equipment, using various packaging processes, at a processing/packaging facility. Such equipment and processes includes horizontal form/fill/seal (HFFS), vertical form/fill/seal (VFFS), thermoforming/lidstock, and continuous horizontal packaging (sometimes referred to as Flow-wrap). In each case, the product is manually or automatically placed in a pouch, bag, formed web, tray, etc., the filled container is optionally vacuumized or gas flushed, and the mouth of the container is hermetically or non-hermetically sealed to close and finish the package.

Opening of the finished package (i.e. opening with the use of tools such as scissors or knives) can provide access to the product by the consumer.

Common in the industry is the use of plastic zipper closures; press-to-close or slide zippers; interlocking closures; reclosable fasteners with interlockable fastener elements; interlocking rib and groove elements having male and female profiles; interlocking alternating hook-shaped closure members, and the like. These terms appear in the patent literature, and to some extent may overlap in meaning. These features provide reclosability, and in some cases may provide an easy-open feature to the package. However, such features are not always easy to open or reclose.

Also relatively common is the use of pressure sensitive adhesive to provide a reclosability feature to a package.

There is need in the marketplace for a package, and methods of packaging that can be used in a manner that requires little or no modification to the packager's packaging equipment, while providing a manually (i.e. by hand, without the need for tools such as scissors or knives) openable and easy to reclose feature, optionally while maintaining hermeticity of the package when made, and without the use of plastic zipper closures; press-to-close or slide zippers; interlocking closures; reclosable fasteners with interlockable fastener elements; interlocking rib and groove elements having male and female profiles; interlocking alternating hook-shaped closure members, and the like.

Some retail packages currently do not offer an easy-open and/or reclosable feature. Examples are some produce bags and snack food bags. In the produce market, there is a need for a cost-effective way to manually open, and repeatably reclose, retail produce bags, e.g. a package made in HFFS, VFFS, thermoforming/lidstock, or continuous horizontal packaging processes.

The present invention relates to a package, and methods of making the package, which package is manually openable and reclosable, i.e. can be opened and reclosed a number of times, and adapted to package non-food products, as well as food products such as e.g. produce, snack foods, cheese, luncheon meat, sausage, culinary nuts, trail mix, etc., as well as products for the medical industry. The package optionally maintains a hermetic seal until the package is opened.

SUMMARY OF THE INVENTION

Statement of Invention/Embodiments of the Invention

In a first aspect, an easy-open and reclosable package comprises:

a pouch comprising
- a first and second side panel each comprising an outer and inner surface, a first and
- second side edge, and a first and second end, the first and second side panels joined
- together along their respective first and second side edges;
- a first end defined by the first end of at least one of the first and second side panels;
- a second end defined by the second ends of the first and second side panels respectively;
- a discrete strip, disposed between the first and second side panels, comprising a first and second surface, a first and second end, a first and second side edge, a sealing segment, a backing segment, and an intermediate layer disposed between the sealing and backing segments and comprising a pressure sensitive adhesive, the discrete strip spaced apart from at least one of the first end of the pouch, and the second end of the pouch;
- a first anchor seal whereby the first surface of the discrete strip is anchored to the inner surface of the first side panel, and
- a second anchor seal whereby the second surface of the discrete strip is anchored to the inner surface of the second side panel;
- a die cut disposed in the first side panel, the die cut defining a primary die cut segment, the primary die cut segment so arranged with respect to the discrete strip and the first anchor seal that when the package is opened, the package can thereafter be reclosed by adhering the pressure sensitive adhesive to the first side panel; and
- the first end of the first side panel joined to the second side panel; and a product disposed in the pouch.

Optionally, according to various embodiments of the first aspect of the invention, taken alone or in any suitable combination of these embodiments:
- when the primary die cut segment is removed or displaced, the sealing segment is at least partially removed from the discrete strip, and the intermediate layer comprising the pressure sensitive adhesive is at least partially exposed.
- a secondary die cut segment is disposed between the primary die cut segment and an end of the package, the secondary die cut segment so arranged with respect to the discrete strip that when the secondary die cut segment is removed or displaced, the sealing segment is at least partially removed from the discrete strip, and the intermediate layer comprising the pressure sensitive adhesive is at least partially exposed.
  - both the first and second surfaces of the discrete strip comprise a sealant.

the first and second side panels are joined together along their respective first and second side edges with a first and second side seal respectively.

the first and second side panels are joined together along their respective first and second side edges with a fold.

the first end of the first side panel, and the second side panel, are joined together with a seal.

the first end of the first side panel, and the second side panel, are joined together with a fold.

the first end of the first side panel, and the first end of the second side panel, are joined together with a seal.

the first end of the first side panel, and the first end of the second side panel, are joined together with a fold.

the second end of the first side panel, and the second end of the second side panel, are joined together with a seal.

the second end of the first side panel, and the second end of the second side panel, are joined together with a fold.

the discrete strip is spaced apart from the first and second side edges of the first and second side panels.

the sealing segment comprises a single layer.

the backing segment comprises a single layer.

the package is absent any zipper.

the package can be opened with a peel force of from 25 grams/inch to 5 pounds/inch.

the primary die cut segment is completely underlain by the discrete strip.

the primary die cut segment is partially underlain by the discrete strip.

when the package is opened, the discrete strip is not torn through the entire thickness of the discrete strip.

the first surface of the discrete strip is substantially free from PSA.

the second surface of the discrete strip is substantially free from PSA.

the package is absent a discrete thread or tear strip.

the primary die cut segment includes a first portion wherein the die cut extends partially through the first side panel, and a second portion wherein the die cut extends entirely through the first side panel.

the first side edge of the discrete strip is disposed between and sealed to the first side edge of the first and second side panels respectively, and the second side edge of the discrete strip is disposed between and sealed to the second side edge of the first and second side panels respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

In a second aspect, an easy-open and reclosable package comprises:

a pouch comprising a folded web having an interior surface;

a first transverse seal at a first end of the folded web;

a second transverse seal at a second end of the folded web;

a longitudinal seal extending along the length of the folded web, a discrete strip positioned adjacent to and spaced apart from the longitudinal seal, the discrete strip comprising a first and second surface, a first and second end, a first and second side edge, a sealing segment, a backing segment, and an intermediate layer disposed between the sealing and backing segments and comprising a pressure sensitive adhesive;

a first anchor seal whereby the first surface of the discrete strip is anchored to the interior surface of the folded web, and a second anchor seal whereby the second surface of the discrete strip is anchored to the interior surface of the folded web; and a die cut disposed in the folded web, the die cut defining a primary die cut segment, the primary die cut segment so arranged with respect to the discrete strip that when the package is opened, the package can thereafter be reclosed by adhering the pressure sensitive adhesive to the folded web; and a product disposed in the pouch.

Optionally, according to various embodiments of the second aspect of the invention, taken alone or in any suitable combination of these embodiments:

when the primary die cut segment is removed or displaced, the sealing segment is at least partially removed from the discrete strip, and the intermediate layer comprising the pressure sensitive adhesive is at least partially exposed.

a secondary die cut segment is disposed between the primary die cut segment and an end of the package, the secondary die cut segment so arranged with respect to the discrete strip that when the secondary die cut segment is removed or displaced, the sealing segment is at least partially removed from the discrete strip, and the intermediate layer comprising the pressure sensitive adhesive is at least partially exposed.

both the first and second surfaces of the discrete strip comprise a sealant.

the sealing segment comprises a single layer.

the backing segment comprises a single layer.

the package is absent any zipper.

the package can be opened with a peel force of from 25 grams/inch to 5 pounds/inch.

the primary die cut segment is completely underlain by the discrete strip.

the primary die cut segment is partially underlain by the discrete strip.

when the package is opened, the discrete strip is not torn through the entire thickness of the discrete strip.

the first surface of the discrete strip is substantially free from PSA.

the second surface of the discrete strip is substantially free from PSA.

the package is absent a discrete thread or tear strip.

the primary die cut segment includes a first portion wherein the die cut extends partially through the folded web, and a second portion wherein the die cut extends entirely through the folded web.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the folded web.

In a third aspect, a method of making an easy-open and reclosable package in a horizontal form/fill/seal process comprises:

providing a lay-flat web on a first roll, the lay-flat web having a first and second longitudinal edge, and a die cut;

providing a discrete strip comprising a first and second surface, a first and second side edge, a sealing segment, a backing segment, and an intermediate layer disposed between the sealing and backing segments and comprising a pressure sensitive adhesive;

advancing the lay-flat web to a forming device to convert the lay-flat web to a folded web having an interior surface;

advancing the discrete strip such that when the package is made, the discrete strip is disposed between a first and second side panel of the package;

making side seals in the folded web to produce an open pouch comprising the first and second side panels each comprising an outer and inner surface, first and second side edges, and a first and second end, the first and second side panels joined together along their respective first and second side edges by a seal, a first end defined by the first end of at least one of the first and second side panels, a second end defined by the second ends of the first and second side panels respectively, the first and second side panels joined together along their respective second ends, and the discrete strip spaced apart from at least one of the first and second ends of the pouch;

putting a product in the open pouch; and sealing the first end of the first side panel to the second side panel to close the pouch;

wherein the die cut is disposed in the first side panel, the die cut defining a primary die cut segment, the primary die cut segment so arranged with respect to the discrete strip that when the package is opened, the package can thereafter be reclosed by adhering the pressure sensitive adhesive to the first side panel;

at any time during the method of making the package, anchoring the first surface of the discrete strip to the lay-flat web, the interior surface of the folded web, or the inner surface of the first side panel to form a first anchor seal, and at any time during the method of making the package anchoring the second surface of the discrete strip to the lay-flat web, the interior surface of the folded web, or the inner surface of the second side panel to form a second anchor seal, such that when the package is made, the first surface of the discrete strip is anchored to the inner surface of the first side panel, and the second surface of the discrete strip is anchored to the inner surface of the second side panel; and cutting the web at the side seals during the step of making side seals in the folded web, or before, during or after any subsequent steps.

Optionally, according to various embodiments of the third aspect of the invention, taken alone or in any suitable combination of these embodiments:

when the primary die cut segment is removed or displaced, the sealing segment is at least partially removed from the discrete strip, and the intermediate layer comprising the pressure sensitive adhesive is at least partially exposed.

a secondary die cut segment is disposed between the primary die cut segment and an end of the package, the secondary die cut segment so arranged with respect to the discrete strip that when the secondary die cut segment is removed or displaced, the sealing segment is at least partially removed from the discrete strip, and the intermediate layer comprising the pressure sensitive adhesive is at least partially exposed.

both the first and second surfaces of the discrete strip comprise a sealant.

the first end of the first side panel, and the first end of the second side panel, are joined together with a seal.

the first end of the first side panel, and the first end of the second side panel, are joined together with a fold.

the sealing segment comprises a single layer.

the backing segment comprises a single layer.

the package is absent any zipper.

the package can be opened with a peel force of from 25 grams/inch to 5 pounds/inch.

the primary die cut segment is completely underlain by the discrete strip.

the primary die cut segment is partially underlain by the discrete strip.

when the package is opened, the discrete strip is not torn through the entire thickness of the discrete strip.

the first surface of the discrete strip is substantially free from PSA.

the second surface of the discrete strip is substantially free from PSA.

the package is absent a discrete thread or tear strip.

the primary die cut segment includes a first portion wherein the die cut extends partially through the first side panel, and a second portion wherein the die cut extends entirely through the first side panel.

the first side edge of the discrete strip is disposed between and sealed to the first side edge of the first and second side panels respectively, and the second side edge of the discrete strip is disposed between and sealed to the second side edge of the first and second side panels respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

In a fourth aspect, a method of making an easy-open and reclosable package in a horizontal form/fill/seal process comprises:

providing a lay-flat web on a first roll, the lay-flat web having a first and second longitudinal edge, and a die cut;

providing a discrete strip comprising a first and second surface, a first and second side edge, a sealing segment, a backing segment, and an intermediate layer disposed between the sealing and backing segments and comprising a pressure sensitive adhesive, wherein i) the first surface of the discrete strip is anchored to a first surface of the lay-flat web to form a first anchor seal, or ii) the second surface of the discrete strip is anchored to the lay-flat web to form a second anchor seal;

advancing the lay-flat web with the discrete strip anchored thereto to a forming device to convert the lay-flat web to a folded web having an interior surface; making side seals in the folded web to produce an open pouch comprising a first and second side panel each comprising an outer and inner surface, first and second side edges, and a first and second end, the first and second side panels joined together along their respective first and second side edges by a seal, a first end defined by the first end of at least one of the first and second side panels, a second end defined by the second ends of the first and second side panels respectively, the first and second side panels joined together along their respective second ends, and the discrete strip disposed between the first and second side panels, and spaced apart from at least one of the first and second end of the pouch;

putting a product in the open pouch; and sealing the first end of the first side panel to the second side panel to close the pouch; wherein the die cut is disposed in the first side panel, the die cut defining a primary die cut segment, the primary die cut segment so arranged with respect to the discrete strip and the first anchor seal that when the package is opened, the package can thereafter be reclosed by adhering the pressure sensitive adhesive to the first side panel; and cutting the web at the side seals during the step of making side seals in the folded web, or before, during or after any subsequent steps; and completing the anchoring of the discrete strip to the lay-flat web, folded web, or side panels such that the first surface of the discrete strip is anchored to the inner surface of the first side panel, and the second surface of the discrete strip is anchored to the inner surface of the second side panel.

Optionally, according to various embodiments of the fourth aspect of the invention, taken alone or in any suitable combination of these embodiments:

when the primary die cut segment is removed or displaced, the sealing segment is at least partially removed from the discrete strip, and the intermediate layer comprising the pressure sensitive adhesive is at least partially exposed.

a secondary die cut segment is disposed between the primary die cut segment and an end of the package, the secondary die cut segment so arranged with respect to the discrete strip that when the secondary die cut segment is removed or displaced, the sealing segment is at least partially removed from the discrete strip, and the intermediate layer comprising the pressure sensitive adhesive is at least partially exposed.

both the first and second surfaces of the discrete strip comprise a sealant.

the first end of the first side panel, and the first end of the second side panel, are joined together with a seal.

the first end of the first side panel, and the first end of the second side panel, are joined together with a fold.

the sealing segment comprises a single layer.

the backing segment comprises a single layer.

the package is absent any zipper.

the package can be opened with a peel force of from 25 grams/inch to 5 pounds/inch.

the primary die cut segment is completely underlain by the discrete strip.

the primary die cut segment is partially underlain by the discrete strip.

when the package is opened, the discrete strip is not torn through the entire thickness of the discrete strip.

the first surface of the discrete strip is substantially free from PSA.

the second surface of the discrete strip is substantially free from PSA.

the package is absent a discrete thread or tear strip.

the primary die cut segment includes a first portion wherein the die cut extends partially through the first side panel, and a second portion wherein the die cut extends entirely through the first side panel.

the first side edge of the discrete strip is disposed between and sealed to the first side edge of the first and second side panels respectively, and the second side edge of the discrete strip is disposed between and sealed to the second side edge of the first and second side panels respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

In a fifth aspect, a method of making an easy-open and reclosable package in a vertical form/fill/seal process comprises:

providing a lay-flat web on a first roll, the lay-flat web comprising a first and second surface, and a die cut;

providing a discrete strip comprising a first and second surface, a first and second side edge, a sealing segment, a backing segment, and an intermediate layer disposed between the sealing and backing segments and comprising a pressure sensitive adhesive;

advancing the lay-flat web over a forming device to convert the lay-flat web to a folded web having an interior surface;

advancing the discrete strip such that when the package is made, the discrete strip is disposed between a first and second side panel of the package;

making a longitudinal seal in the folded web;

transversely sealing the folded web to produce a first transverse seal to define a first pouch, wherein the first transverse seal is a bottom transverse seal of the first pouch; putting a product in the first pouch;

advancing the folded web, with the first pouch, downward a predetermined distance;

transversely sealing the first pouch to produce a top transverse seal in the first pouch, and a bottom transverse seal in a second pouch, the second pouch disposed above the first pouch; and transversely cutting the folded web to separate the first pouch from the second pouch to make a package, the package comprising the first and second side panels each comprising an outer and inner surface, a first and second side edge, and a first and second end, the first and second side panels joined together along their respective first and second side edges, a first end defined by the first ends of the first and second side panels, a second end defined by the second ends of the first and second side panels, and the die cut disposed in the first side panel, the die cut defining a primary die cut segment, the primary die cut segment so arranged with respect to the discrete strip that when the package is opened, the package can thereafter be reclosed by adhering the pressure sensitive adhesive to the first side panel;

wherein at any time during the method of making the package, anchoring the first surface of the discrete strip to the lay-flat web, the interior surface of the folded web, or the inner surface of the first side panel to form a first anchor seal, and at any time during the method of making the package, anchoring the second surface of the discrete strip to the lay-flat web, the interior surface of the folded web, or the inner surface of the second side panel to form a second anchor seal, such that when the package is made, the first surface of the discrete strip is anchored to the inner surface of the first side panel, and the second surface of the discrete strip is anchored to the inner surface of the second side panel.

Optionally, according to various embodiments of the fifth aspect of the invention, taken alone or in any suitable combination of these embodiments:

when the primary die cut segment is removed or displaced, the sealing segment is at least partially removed from the discrete strip, and the intermediate layer comprising the pressure sensitive adhesive is at least partially exposed.

a secondary die cut segment is disposed between the primary die cut segment and an end of the package, the secondary die cut segment so arranged with respect to the discrete strip that when the secondary die cut segment is removed or displaced, the sealing segment is at least partially removed from the discrete strip, and the intermediate layer comprising the pressure sensitive adhesive is at least partially exposed.

both the first and second surfaces of the discrete strip comprise a sealant.

the first and second side panels are joined together along their respective first and second side edges with a seal.

the first and second side panels are joined together along their respective first and second side edges with a fold.

the first end of the first side panel, and the first end of the second side panel, are joined together with a seal.

the first end of the first side panel, and the first end of the second side panel, are joined together with a fold.

the second end of the first side panel, and the second end of the second side panel, are joined together with a seal.

the second end of the first side panel, and the second end of the second side panel, are joined together with a fold.

the sealing segment comprises a single layer.

the backing segment comprises a single layer.

the package is absent any zipper.

the package is absent a discrete release liner for a PSA layer or coating.

the package can be opened with a peel force of from 25 grams/inch to 5 pounds/inch.

the primary die cut segment is completely underlain by the discrete strip.

the primary die cut segment is partially underlain by the discrete strip.

when the package is opened, the discrete strip is not torn through the entire thickness of the discrete strip.

the first surface of the discrete strip is substantially free from PSA.

the second surface of the discrete strip is substantially free from PSA.

the package is absent a discrete thread or tear strip.

the primary die cut segment includes a first portion wherein the primary die cut extends partially through the first side panel, and a second portion wherein the primary die cut extends entirely through the first side panel.

the first side edge of the discrete strip is disposed between and sealed to the first side edge of the first and second side panels respectively, and the second side edge of the discrete strip is disposed between and sealed to the second side edge of the first and second side panels respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

In a sixth aspect, a method of making an easy-open and reclosable package in a vertical form/fill/seal process comprises:

providing a lay-flat web on a first roll, the lay-flat web comprising a first and second surface, and a die cut;

providing a discrete strip comprising a first and second surface, a first and second side edge, a sealing segment, a backing segment, and an intermediate layer disposed between the sealing and backing segments and comprising a pressure sensitive adhesive, wherein i) the first surface of the discrete strip is anchored to a first surface of the lay-flat web to form a first anchor seal, or ii) the second surface of the discrete strip is anchored to the lay-flat web to form a second anchor seal;

advancing the lay-flat web with the discrete strip attached thereto over a forming device to convert the lay-flat web to a folded web having an interior surface; making a longitudinal seal in the folded web;

transversely sealing the folded web to produce a first transverse seal to define a first pouch, wherein the first transverse seal is a bottom transverse seal of the first pouch; putting a product in the first pouch;

advancing the folded web, with the first pouch, downward a predetermined distance; transversely sealing the folded web to produce a top transverse seal in the first pouch, and a bottom transverse seal in a second pouch, the second pouch disposed above the first pouch; and transversely cutting the folded web to separate the first pouch from the second pouch to make a package, the package comprising a first and second side panel each comprising an outer and inner surface, a first and second side edge, and a first and second end, the first and second side panels joined together along their respective first and second side edges, a first end defined by the first ends of the first and second side panels, a second end defined by the second ends of the first and second side panels, and the die cut disposed in the first side panel, the die cut defining a primary die cut segment, the primary die cut segment so arranged with respect to the discrete strip and the first anchor seal that when the package is opened, the package can thereafter be reclosed by adhering the pressure sensitive adhesive to the first side panel; and completing the anchoring of the discrete strip to the lay-flat web, folded web, or side panels such that the first surface of the discrete strip is anchored to the inner surface of the first side panel, and the second surface of the discrete strip is anchored to the inner surface of the second side panel.

Optionally, according to various embodiments of the sixth aspect of the invention, taken alone or in any suitable combination of these embodiments:

when the primary die cut segment is removed or displaced, the sealing segment is at least partially removed from the discrete strip, and the intermediate layer comprising the pressure sensitive adhesive is at least partially exposed.

a secondary die cut segment is disposed between the primary die cut segment and an end of the package, the secondary die cut segment so arranged with respect to the discrete strip that when the secondary die cut segment is removed or displaced, the sealing segment is at least partially removed from the discrete strip, and the intermediate layer comprising the pressure sensitive adhesive is at least partially exposed.

both the first and second surfaces of the discrete strip comprise a sealant.

the first and second side panels are joined together along their respective first and second side edges with a seal.

the first and second side panels are joined together along their respective first and second side edges with a fold.

the first end of the first side panel, and the first end of the second side panel, are joined together with a seal.

the first end of the first side panel, and the first end of the second side panel, are joined together with a fold.

the second end of the first side panel, and the second end of the second side panel, are joined together with a seal.

the second end of the first side panel, and the second end of the second side panel, are joined together with a fold.

the sealing segment comprises a single layer.

the backing segment comprises a single layer.

the package is absent any zipper.

the package is absent a discrete release liner for a PSA layer or coating.

the package can be opened with a peel force of from 25 grams/inch to 5 pounds/inch.

the primary die cut segment is completely underlain by the discrete strip.

the primary die cut segment is partially underlain by the discrete strip.

when the package is opened, the discrete strip is not torn through the entire thickness of the discrete strip.

the first surface of the discrete strip is substantially free from PSA.

the second surface of the discrete strip is substantially free from PSA.

the package is absent a discrete thread or tear strip.

the primary die cut segment includes a first portion wherein the die cut extends partially through the first side panel, and a second portion wherein the die cut extends entirely through the first side panel.

the first side edge of the discrete strip is disposed between and sealed to the first side edge of the first and second side panels respectively, and the second side edge of the discrete strip is disposed between and sealed to the second side edge of the first and second side panels respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

In a seventh aspect, a method of making an easy-open and reclosable package having a formed web comprises:

providing a formed web, having an inner and outer surface, comprising a product cavity;

providing a product;

providing a lidstock, having an inner and outer surface, comprising a lay-flat web, and a die cut disposed in the lidstock, the die cut defining a primary die cut segment;

providing a discrete strip comprising a first and second surface, a first and second side edge, a sealing segment, a backing segment, and an intermediate layer disposed between the sealing and backing segments and comprising a pressure sensitive adhesive;

placing the product in the product cavity;

sealing the lidstock to the formed web, such that the discrete strip is disposed between the lidstock and the formed web; and cutting the lidstock and formed web to make the package; wherein the primary die cut segment is so arranged with respect to the discrete strip that when the package is opened, the package can thereafter be reclosed by adhering the pressure sensitive adhesive to the lidstock;

at any time during the method of making the package, anchoring the first surface of the discrete strip to the inner surface of the lidstock to form a first anchor seal; and at any time during the method of making the package, anchoring the second surface of the discrete strip to the inner surface of the formed web to form a second anchor seal, such that when the package is made, the first surface of the discrete strip is anchored to the inner surface of the lidstock, and the second surface of the discrete strip is anchored to the inner surface of the formed web.

Optionally, according to various embodiments of the seventh aspect of the invention, taken alone or in any suitable combination of these embodiments:

when the primary die cut segment is removed or displaced, the sealing segment is at least partially removed from the discrete strip, and the intermediate layer comprising the pressure sensitive adhesive is at least partially exposed.

a secondary die cut segment is disposed between the primary die cut segment and an end of the package, the secondary die cut segment so arranged with respect to the discrete strip that when the secondary die cut segment is removed or displaced, the sealing segment is at least partially removed from the discrete strip, and the intermediate layer comprising the pressure sensitive adhesive is at least partially exposed.

both the first and second surfaces of the discrete strip comprise a sealant.

the sealing segment comprises a single layer.

the backing segment comprises a single layer.

the package is absent any zipper.

the package can be opened with a peel force of from 25 grams/inch to 5 pounds/inch.

the primary die cut segment is completely underlain by the discrete strip.

the primary die cut segment is partially underlain by the discrete strip.

when the package is opened, the discrete strip is not torn through the entire thickness of the discrete strip.

the first surface of the discrete strip is substantially free from PSA.

the second surface of the discrete strip is substantially free from PSA.

the package is absent a discrete thread or tear strip.

the primary die cut segment includes a first portion wherein the die cut extends partially through the lidstock, and a second portion wherein the die cut extends entirely through the lidstock.

the first side edge of the discrete strip is disposed between and sealed to a first side edge of the lidstock and formed web respectively, and the second side edge of the discrete strip is disposed between and sealed to a second side edge of the lidstock and formed web respectively.

the primary die cut segment is spaced apart from a first and second side seal respectively.

the primary die cut segment extends laterally across the package from a first side edge to a second side edge of the package.

the primary die cut segment is underlain entirely by at least one of a clear area, or the inner surface of the formed web.

In an eighth aspect, a method of making an easy-open and reclosable package having a formed web comprises:

providing a formed web, having an inner and outer surface, comprising a product cavity;

providing a product;

providing a lidstock, having an inner and outer surface, comprising a lay-flat web, and a die cut disposed in the lidstock, the die cut defining a primary die cut segment;

providing a discrete strip comprising a first and second surface, a first and second side edge, a sealing segment, a backing segment, and an intermediate layer disposed between the covering and backing segments and comprising a pressure sensitive adhesive, wherein i) the first surface of the discrete strip is anchored to the inner surface of the lidstock to form a first anchor seal, or ii) the second surface of the discrete strip is anchored to the inner surface of the formed web to form a second anchor seal;

placing the product in the product cavity;

sealing the lidstock to the formed web, such that the discrete strip is disposed between the lidstock and the formed web; and cutting the lidstock and formed web to make the package:

wherein the primary die cut segment is so arranged with respect to the discrete strip and the first anchor seal that when the package is opened, the package can thereafter be reclosed by adhering the pressure sensitive adhesive to the lidstock; and completing the anchoring of the discrete strip to the lidstock and the formed web such that the first surface of the discrete strip is anchored to the inner surface of the lidstock, and the second surface of the discrete strip is anchored to the inner surface of the formed web.

Optionally, according to various embodiments of the eighth aspect of the invention, taken alone or in any suitable combination of these embodiments:

when the primary die cut segment is removed or displaced, the sealing segment is at least partially removed from the discrete strip, and the intermediate layer comprising the pressure sensitive adhesive is at least partially exposed.

a secondary die cut segment is disposed between the primary die cut segment and an end of the package, the secondary die cut segment so arranged with respect to the discrete strip that when the secondary die cut segment is removed or displaced, the sealing segment is at least partially removed from the discrete strip, and the intermediate layer comprising the pressure sensitive adhesive is at least partially exposed.

both the first and second surfaces of the discrete strip comprise a sealant.

the sealing segment comprises a single layer.

the backing segment comprises a single layer.

the package is absent any zipper.

the package is absent a discrete release liner for a PSA layer or coating.

the package can be opened with a peel force of from 25 grams/inch to 5 pounds/inch.

the primary die cut segment is completely underlain by the discrete strip.

the primary die cut segment is partially underlain by the discrete strip.

when the package is opened, the discrete strip is not torn through the entire thickness of the discrete strip.

the first surface of the discrete strip is substantially free from PSA.

the second surface of the discrete strip is substantially free from PSA.

the package is absent a discrete thread or tear strip.

the primary die cut segment includes a first portion wherein the die cut extends partially through the lidstock, and a second portion wherein the die cut extends entirely through the lidstock.

the first side edge of the discrete strip is disposed between and sealed to a first side edge of the lidstock and formed web respectively, and the second side edge of the discrete strip is disposed between and sealed to a second side edge of the lidstock and formed web respectively.

the primary die cut segment is spaced apart from a first and second side seal respectively.

the primary die cut segment extends laterally across the package from a first side edge to a second side edge of the package.

the primary die cut segment is underlain entirely by at least one of a clear area, or the inner surface of the formed web.

In a ninth aspect, a method of making an easy-open and reclosable package in a continuous horizontal packaging process comprises:

providing a lay-flat web, the lay-flat web comprising a die cut;

providing a discrete strip comprising a first and second surface, a first and second side edge, a sealing segment, a backing segment, and an intermediate layer disposed between the sealing and backing segments and comprising a pressure sensitive adhesive;

advancing the lay-flat web to a forming device to convert the lay-flat web into a folded web having an interior surface;

advancing the discrete strip such that when the package is made, the discrete strip is disposed between a first and second side panel of the package;

advancing a product to the forming device such that the folded web envelopes the product;

longitudinally sealing the folded web to make a longitudinal seal;

transversely sealing the folded web, with the product therein, to produce a leading transverse seal to define a first pouch;

advancing the folded web, with the leading transverse seal, forward a predetermined distance;

transversely sealing the folded web to produce a trailing transverse seal in the first pouch, and a leading transverse seal in a second pouch, the second pouch disposed upstream of the first pouch; and cutting the folded web to separate the first pouch from the second pouch to form an individual package comprising the first and second side panel;

wherein the die cut is disposed in the package, the die cut defining a primary die cut segment, the primary die cut segment so arranged with respect to the discrete strip that when the package is opened, the package can thereafter be reclosed by adhering the pressure sensitive adhesive to the first side panel;

at any time during the method of making the package, anchoring the first surface of the discrete strip to the lay-flat web, the interior surface of the folded web, or an inner surface of the first side panel to form a first anchor seal; and at any time during the method of making the package, anchoring the second surface of the discrete strip to the lay-flat web, the interior surface of the folded web, or an inner surface of the second side panel to form a second anchor seal; such that when the package is made, the first surface of the discrete strip is anchored to the inner surface of the first side panel, and the second surface of the discrete strip is anchored to the inner surface of the second side panel.

Optionally, according to various embodiments of the ninth aspect of the invention, taken alone or in any suitable combination of these embodiments:

when the primary die cut segment is removed or displaced, the sealing segment is at least partially removed from the discrete strip, and the intermediate layer comprising the pressure sensitive adhesive is at least partially exposed.

a secondary die cut segment is disposed between the primary die cut segment and an end of the package, the secondary die cut segment so arranged with respect to the discrete strip that when the secondary die cut segment is removed or displaced, the sealing segment is at least partially removed from the discrete strip, and the intermediate layer comprising the pressure sensitive adhesive is at least partially exposed.

both the first and second surfaces of the discrete strip comprise a sealant.

the sealing segment comprises a single layer.

the backing segment comprises a single layer.

the package is absent any zipper.

the package can be opened with a peel force of from 25 grams/inch to 5 pounds/inch.

the primary die cut segment is completely underlain by the discrete strip.

the primary die cut segment is partially underlain by the discrete strip.

when the package is opened, the discrete strip is not torn through the entire thickness of the discrete strip.

the first surface of the discrete strip is substantially free from PSA.

the second surface of the discrete strip is substantially free from PSA.

the package is absent a discrete thread or tear strip.

the primary die cut segment includes a first portion wherein the die cut extends partially through the folded web, and a second portion wherein the die cut extends entirely through the folded web.

the first side edge of the discrete strip is disposed between and sealed to a first side edge of the first and second side panels respectively, and the second side edge of the discrete strip is disposed between and sealed to a second side edge of the first and second side panels respectively.

the primary die cut segment is spaced apart from a first and second side seal respectively.

the primary die cut segment extends laterally across the package from a first side edge to a second side edge of the package.

the primary die cut segment is underlain entirely by at least one of a clear area, or an inner surface of the second side panel.

In a tenth aspect, a method of making an easy-open and reclosable package in a continuous horizontal packaging process comprises:

providing a lay-flat web, the lay-flat web having a first and second surface, and a die cut;

providing a discrete strip comprising a first and second surface, a first and second side edge, a sealing segment, a backing segment, and an intermediate layer disposed between the sealing and backing segments and comprising a pressure sensitive adhesive, wherein i) the first surface of the discrete strip is anchored to the first surface of the lay-flat web to form a first anchor seal, or ii) the second surface of the discrete strip is anchored to the second surface of the lay-flat web to form a second anchor seal;

advancing the lay-flat web with the discrete strip attached thereto to a forming device to convert the lay-flat web into a folded web having an interior surface;

advancing a product to the forming device such that the folded web envelopes the product;

longitudinally sealing the folded web to make a longitudinal seal;

transversely sealing the folded web, with the product therein, to produce a leading transverse seal to define a first pouch;

advancing the folded web, with the leading transverse seal, forward a predetermined distance;

transversely sealing the folded web to produce a trailing transverse seal in the first pouch, and a leading transverse seal in a second pouch, the second pouch disposed upstream of the first pouch; and cutting the transversely sealed first pouch, with the product therein, to form an individual package comprising a first and second side panel;

wherein the die cut is disposed in the folded web, the die cut defining a primary die cut segment, the primary die cut segment so arranged with respect to the discrete strip that when the package is opened, the package can thereafter be reclosed by adhering the pressure sensitive adhesive to the first side panel;

and completing the anchoring of the discrete strip to the lay-flat web, folded web, or side panels such that the first surface of the discrete strip is anchored to an inner surface of the first side panel, and the second surface of the discrete strip is anchored to an inner surface of the second side panel.

Optionally, according to various embodiments of the tenth aspect of the invention, taken alone or in any suitable combination of these embodiments:

when the primary die cut segment is removed or displaced, the sealing segment is at least partially removed from the discrete strip, and the intermediate layer comprising the pressure sensitive adhesive is at least partially exposed.

a secondary die cut segment is disposed between the primary die cut segment and an end of the package, the secondary die cut segment so arranged with respect to the discrete strip that when the secondary die cut segment is removed or displaced, the sealing segment is at least partially removed from the discrete strip, and the intermediate layer comprising the pressure sensitive adhesive is at least partially exposed.

both the first and second surfaces of the discrete strip comprise a sealant.

the sealing segment comprises a single layer.

the backing segment comprises a single layer.

the package is absent any zipper.

the package can be opened with a peel force of from 25 grams/inch to 5 pounds/inch.

the primary die cut segment is completely underlain by the discrete strip.

the primary die cut segment is partially underlain by the discrete strip.

when the package is opened, the discrete strip is not torn through the entire thickness of the discrete strip.

the first surface of the discrete strip is substantially free from PSA.

the second surface of the discrete strip is substantially free from PSA.

the package is absent a discrete thread or tear strip.

the primary die cut segment includes a first portion wherein the die cut extends partially through the first side panel, and a second portion wherein the die cut extends entirely through the first side panel.

the first side edge of the discrete strip is disposed between and sealed to a first side edge of the first and second side panels respectively, and the second side edge of the discrete strip is disposed between and sealed to a second side edge of the first and second side panels respectively.

the primary die cut segment is spaced apart from a first and second side seal respectively.

the primary die cut segment extends laterally across the package from a first side edge to a second side edge of the package.

the primary die cut segment is underlain entirely by at least one of a clear area, or an inner surface of the second side panel.

In an eleventh aspect, a pouch comprises:

a first and second side panel each comprising an outer and inner surface, a first and second side edge, and a first and second end, the first and second side panels joined together along their respective first and second side edges;

a first end defined by the first end of at least one of the first and second side panels; a second end defined by the second ends of the first and second side panels respectively;

the first and second side panels joined together along their respective second ends; a discrete strip, disposed between the first and second side panels, comprising a first and second surface, a first and second end, a first and second side edge, a sealing segment, a backing segment, and an intermediate layer disposed between the sealing and backing segments and comprising a pressure sensitive adhesive, the discrete strip spaced apart from at least one of the first end of the pouch, and the second end of the pouch;

a first anchor seal whereby the first surface of the discrete strip is anchored to the inner surface of the first side panel, and a second anchor seal whereby the second surface of the discrete strip is anchored to the inner surface of the second side panel; and a die cut disposed in the first side panel, the die cut defining a primary die cut segment, the primary die cut segment so arranged with respect to the discrete strip and the first anchor seal that when the package is opened, the package can thereafter be reclosed by adhering the pressure sensitive adhesive to the first side panel; and the first end of the first side panel joined to the second side panel.

Optionally, according to various embodiments of the eleventh aspect of the invention, taken alone or in any suitable combination of these embodiments:

when the primary die cut segment is removed or displaced, the sealing segment is at least partially removed from the discrete strip, and the intermediate layer comprising the pressure sensitive adhesive is at least partially exposed.

a secondary die cut segment is disposed between the primary die cut segment and an end of the package, the secondary die cut segment so arranged with respect to the discrete strip that when the secondary die cut segment is removed or displaced, the sealing segment is at least partially removed from the discrete strip, and the intermediate layer comprising the pressure sensitive adhesive is at least partially exposed.

both the first and second surfaces of the discrete strip comprise a sealant.

the first and second side panels are joined together along their respective first and second side edges with a first and second side seal respectively.

the first and second side panels are joined together along their respective first and second side edges with a fold.

the first end of the first side panel, and the second side panel, are joined together with a seal.

the first end of the first side panel, and the second side panel, are joined together with a fold.

the first end of the first side panel, and the first end of the second side panel, are joined together with a seal.

the first end of the first side panel, and the first end of the second side panel, are joined together with a fold.

the second end of the first side panel, and the second end of the second side panel, are joined together with a seal.

the second end of the first side panel, and the second end of the second side panel, are joined together with a fold.

the discrete strip is spaced apart from the first and second side edges of the first and second side panels.

the sealing segment comprises a single layer.

the backing segment comprises a single layer.

the pouch, and a package made from the pouch, is absent any zipper.

when the pouch is sealed to make a package, the package can be opened with a peel force of from 25 grams/inch to 5 pounds/inch.

the primary die cut segment is completely underlain by the discrete strip.

the primary die cut segment is partially underlain by the discrete strip.

when the package is opened, the discrete strip is not torn through the entire thickness of the discrete strip.

the first surface of the discrete strip is substantially free from PSA.

the second surface of the discrete strip is substantially free from PSA.

the package is absent a discrete thread or tear strip.

the primary die cut segment includes a first portion wherein the die cut extends partially through the first side panel, and a second portion wherein the die cut extends entirely through the first side panel.

the first side edge of the discrete strip is disposed between and sealed to the first side edge of the first and second side panels respectively, and the second side edge of the discrete strip is disposed between and sealed to the second side edge of the first and second side panels respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

In a twelfth aspect, a method of making a bag with a die cut and a discrete strip disposed thereon comprises:

extruding a thermoplastic tube to make a bag tubing;

providing a discrete strip comprising a first and second surface, a first and second side edge, a sealing segment, a backing segment, and an intermediate layer disposed between the sealing and backing segments and comprising a pressure sensitive adhesive;

slitting the tubing at a longitudinal edge thereof to make a slit bag tubing; placing the discrete strip inside the slit bag tubing; and transversely cutting and sealing the slit bag tubing at predetermined intervals to make a plurality of individual bags, each bag having a die cut disposed thereon, each bag comprising a first and second side panel each comprising a first and second end, an outer and inner surface, and first and second side edges, the first and second side panels joined together along at least a portion of their respective first and second side edges by a seal, a first end defined by the first end of at least one of the first and second side panels, an end fold defined by the second ends of the first and second side panels respectively, and the discrete strip disposed between the first and second side panels, and spaced apart from at least one of the first end and the end fold of the bag;

wherein the die cut is disposed in the first side panel, the die cut defining a primary die cut segment, the primary die cut segment so arranged with respect to the discrete strip that when the bag is sealed to make a package, and the package is then opened, the package can thereafter be reclosed by adhering the pressure sensitive adhesive to the first side panel;

at any time before transversely cutting the bag tubing to produce a bag, the bag tubing or slit bag tubing is die cut at predetermined intervals to make a plurality of die cuts in the bag tubing or slit bag tubing respectively;

at any time during the method of making the bag, anchoring the first surface of the discrete strip to the bag tubing, the slit bag tubing, or the inner surface of the first side panel to form a first anchor seal, and at any time during the method of making the bag, anchoring the second surface of the discrete strip to the bag tubing, the slit bag tubing, or the inner surface of the second side panel to form a second anchor seal;

such that when a package is made from the bag, the first surface of the discrete strip is anchored to the inner surface of the first side panel, and the second surface of the discrete strip is anchored to the inner surface of the second side panel.

Optionally, according to various embodiments of the twelfth aspect of the invention, taken alone or in any suitable combination of these embodiments:

when the primary die cut segment is removed or displaced, the sealing segment is at least partially removed from the discrete strip, and the intermediate layer comprising the pressure sensitive adhesive is at least partially exposed.

a secondary die cut segment is disposed between the primary die cut segment and an end of the package, the secondary die cut segment so arranged with respect to the discrete strip that when the secondary die cut segment is removed or displaced, the sealing segment is at least partially removed from the discrete strip, and the intermediate layer comprising the pressure sensitive adhesive is at least partially exposed.

both the first and second surfaces of the discrete strip comprise a sealant.

the discrete strip is spaced apart from the first end of the bag, and spaced apart from the end fold of the bag.

the discrete strip is spaced apart from the first and second side edges of the first and second side panels.

the sealing segment comprises a single layer.

the backing segment comprises a single layer.

the bag, and a package made from the bag, is absent any zipper.

a package made from the bag can be opened with a peel force of from 25 grams/inch to 5 pounds/inch.

the primary die cut segment is completely underlain by the discrete strip.

the primary die cut segment is partially underlain by the discrete strip.

when the package is opened, the discrete strip is not torn through the entire thickness of the discrete strip.

the first surface of the discrete strip is substantially free from PSA.

the second surface of the discrete strip is substantially free from PSA.

the package is absent a discrete thread or tear strip.

the primary die cut segment includes a first portion wherein the die cut extends partially through the first side panel, and a second portion wherein the die cut extends entirely through the first side panel.

the first side edge of the discrete strip is disposed between and sealed to the first side edge of the first and second side panels respectively, and the second side edge of the discrete strip is disposed between and sealed to the second side edge of the first and second side panels respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

BRIEF DESCRIPTION OF THE DRAWINGS

The present invention is illustrated by reference to the following drawing figures, encompassing different views of various embodiments of the invention, wherein.

DEFINITIONS

Figure 1:
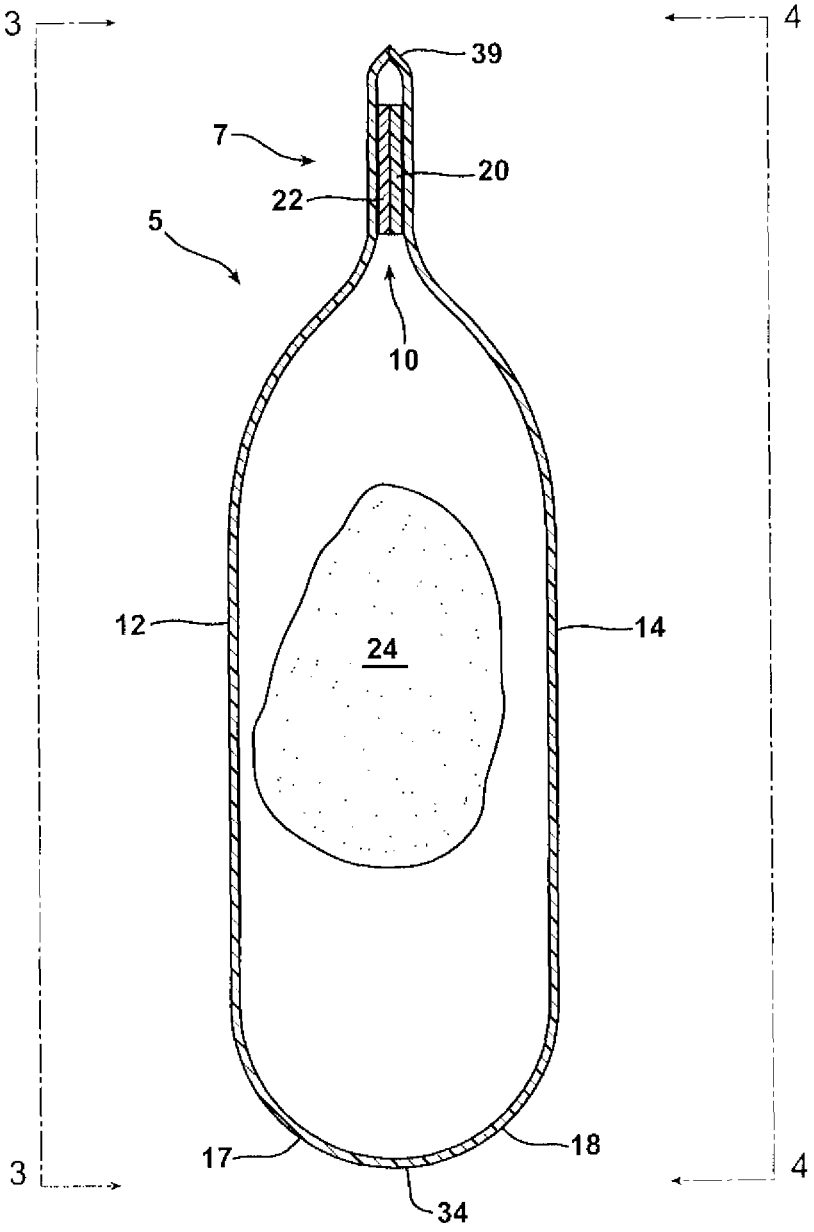
FIG. 1 is an elevational view of a package.

"Anchored", "anchoring" and the like herein refers to sealing or adhering two surfaces together, and refers to the resulting bond between surfaces. Sealing is done by means of a sealant. Adhering is done by means of PSA or permanent adhesive. In processes described herein where a strip is anchored to a web or side panel, either during the process wherein the web and strip are advanced, or when a strip has been pre-anchored to the web before the start of the process, anchoring can be done by use of any suitable continuous or discontinuous sealing or adhesive material and method. Such anchoring is done to hold the strip to the web during the relevant packaging process.

In some embodiments, wherein the anchor is already relatively strong or continuous, e.g. a heat seal that constitute either a relatively strong heat seal, or an easy-open seal as defined herein, the anchor functions not only to hold the strip to the web during the relevant packaging process, but also as a final seal of that surface of the strip to the web (lay-flat or folded) or panel made from the web.

Any subsequent disclosed or recited step in the process of sealing one of the surfaces (i.e. the anchored surface) of the strip to a web or panel, is in these embodiments already completed by the anchoring step. In these embodiments, then, contact of a seal device, e.g. a seal bar in the region of the anchor, in a subsequent step, may add no further or separate seal to that surface of the strip.

Any subsequent step in the process of sealing the other surface of the strip to a web or panel, then, may in some embodiments add no further or separate seal to the anchored surface of the strip.

Sealing of a surface of the strip to a web, as a process step disclosed or recited herein, should be understood in this light.

In some embodiments where the bond is a relatively weak or discontinuous one, e.g. a discontinuous seal, spots or narrow stripes of adhesive. etc., in a subsequent step of sealing one of the surfaces of the strip to the web or panel, a seal bar that seals one of the surfaces of the strip to the web or panel can contact the web or panel in the region where the anchor is already disposed. The seal in that region may be either enhanced, or initially created, by the subsequent sealing step.

"Backing segment" refers to a monolayer or multilayer portion of a discrete strip that can be sealed to a web or second side panel by a sealant.

"Closed-loop" herein refers to a die cut that defines a closed pattern or path in the first side panel whereby the web material within the path (the die-cut segment) can be removed from the panel.

"Die cut" and the like herein refers to methods of cutting or scoring materials, including rotary die, steel rule die, platen die cutting, and laser cutting or scoring; and refers to the resulting cut or score. A die cut can extend entirely or partially through the relevant layer or web, and can leave intact a certain amount of material. "Score" and the like herein refers to a partial die cut that extends partly but not entirely through the thickness of a material, layer, web, panel, etc, The purpose of the score in the present invention is to provide for controlled tear or separation of material in the act of displacing or removing the die cut segment. The depth of the cut can vary from package to package, and within a single die cut or die cut segment on a given package.

"Die-cut segment" herein refers to a portion of the first side panel that can be displaced or completely removed because of the presence of a closed-loop or open-loop die cut. The die-cut segment is a piece of the first side panel, and when displaced or removed can function as a tamper evidence device, and facilitates access to the interior of the package. In some embodiments such as the secondary die cut segment 156 defined by region "D" in FIGS. 28A to 28D, a die cut segment provides access to the PSA to allow reclosing.

"Discrete" with respect to the discrete strip is used herein to mean independently made (the strip is not an integral part of the web when the web is made) or constituting a separate entity from the web.

"Easy-open" herein refers to a package that can be manually opened relatively easily. The physical mode of opening may include any one or more of a) actual peeling at the discrete strip/web interface (adhesive failure), or b) a sealant layer of the discrete strip breaking completely through, and peeling then occurring between the sealant layer and an adjacent layer within the strip (delamination failure), or c) breaking within a sealant layer by rupturing of the sealant material itself (cohesive failure). The peel force required to open the package can be measured by an evaluation of seal strength or peel strength in accordance with the test procedure set out in ASTM F88, incorporated herein by reference in its entirety, using a crosshead speed of 8 to 12 inches/minute and an initial jaw gap of from 1.00 inch to 2.00 inch. Typical peel forces for opening the package of the invention can range from e.g. 25 grams/inch to 3 pounds/inch, e.g. from 100 grams/inch to 2 pounds/inch, such as from 200 grams/inch to 1.5 pounds/inch. In some cases, the sealant may actually peel away from the surface to which it is adhered (adhesive failure), or breakage of the sealant and delamination along an adjacent layer interface may occur (delamination failure) or a rupture of the sealant can occur (cohesive failure). Depending on the design and geometry of the seal, peel forces can in some embodiments be higher than 3 pounds/inch, e.g. 3.5, 4.0, 4.5, or 5 pounds/inch, or values intermediate these values. When a die cut segment is displaced or removed from the first side panel, such that the PSA is exposed, in some embodiments some part of the scored portion of the die cut segment that remains after the die cutting process, may be torn through in the act of opening the package. The peel force required for this step in the opening process will be within the parameters discussed herein.

"Easy-open seal" herein refers to a seal involving the discrete strip and web in which materials and sealing conditions are chosen for the discrete strip and web such that the package is easy-open with a physical mode of opening that includes any one or more of adhesive failure, delamination failure, or cohesive failure as described herein.

"Easy-open sealant" herein refers to a material chosen for one or both surfaces of the discrete strip, such that when such surface is sealed to a web, it provides a package that is easy-open with a physical mode of opening that includes any one or more of adhesive failure, delamination failure, or cohesive failure as described herein.

"Ethylene/alpha-olefin copolymer" (EAO) herein refers to copolymers of ethylene with one or more comonomers selected from $C_3$ to $C_{10}$ alpha-olefins such as propene, butene-1, hexene-1, octene-1, etc. EAO includes heterogeneous materials such as linear medium density polyethylene (LMDPE), linear low density polyethylene (LLDPE), and very low and ultra low density polyethylene (VLDPE and ULDPE); single-site catalyzed materials such as homogeneous linear ethylene/alpha olefin copolymers and long chain branched ethylene/alpha olefin copolymers; and multicomponent ethylene/alpha-olefin interpenetrating network resin (or "IPN resin").

"Ethylene homopolymer or copolymer" herein refers to polyethylene (PE) such as ethylene homopolymer such as low density polyethylene (LDPE), medium density polyethylene (MDPE), high density polyethylene (HDPE); ethylene/alpha olefin copolymer such as those defined herein; ethylene/vinyl acetate copolymer (EVA); ethylene/alkyl acrylate copolymer such as ethylene/methyl acrylate copolymer (EMA) or ethylene/ethyl acrylate copolymer (EEA), or ethylene/butyl acrylate copolymer (EBA); ethylene/(meth)acrylic acid copolymer; or ionomer resin (IO).

"Fig." herein refers to drawing figure; "Figs." to drawing figures.

"Film" is used herein to mean a thermoplastic film, laminate, or web, either multilayer or monolayer, that may be used in connection with the present invention. Film can be of any suitable thickness, e.g. between 0.1 and 30 mils.

"Fin seal" is used herein to mean, in the case of a single web, folding one edge of a web towards the opposite edge of the web, and sealing the facing inner surfaces together. In the case of two webs, a fin seal is a seal formed by sealing the inner surface of the edge of one web to the inner surface of a corresponding edge of another web.

"Lap seal" is used herein to mean a seal made by sealing an inside surface of a web to an outside surface of a web. The inside and outside surfaces can both be on a single web; or the inside surface can be of one web, and the outside surface of a second web.

"Lidstock" herein refers to a film used to cover a container or tray that carries a product, and can be sealed to the tray, typically as a perimeter heat seal. Lidstock typically is supplied to a food processor in a lay flat film rolled onto a roll.

"Longitudinal seal" herein refers to a fin seal or lap seal.

"Olefinic" and the like herein refers to a polymer or copolymer derived at least in part from an olefinic monomer.

"Open-loop" herein refers to a die cut that defines an open pattern or path in the first side panel whereby the web material within the path or pattern (the die-cut segment) can be displaced from its original position on the panel, e.g. by acting as a flap.

"Oxygen barrier" and the like herein refers to materials having an oxygen permeability, of the barrier material, less than 500 $cm^3$ $O_2/m^2$ day*atmosphere (tested at 1 mil thick and at 25° C., 0% RH according to ASTM D3985), such as less than 100, less than 50, less than 25, less than 10, less than 5, and less than 1 $cm^3$ $O_2/m^2$*day*atmosphere. Examples of polymeric materials useful as oxygen barrier materials are ethylene/vinyl alcohol copolymer (EVOH), polyvinylidene dichloride (PVDC), vinylidene chloride/1 methyl acrylate copolymer, vinylidene chloride/vinyl chloride copolymer, polyamide (nylon), and polyester (PET).

"Polymer" and the like herein means a homopolymer, but also a copolymer thereof, including terpolymer, tetrapolymer, block copolymer, etc.

"Pouch" herein means a pouch or bag.

"Pressure sensitive adhesive" (PSA) herein refers to a repositionable adhesive that bonds firmly with the application of light pressure. It adheres to most surfaces with very slight pressure; is available in solvent and latex or water based forms, and is often based on non-crosslinked rubber adhesives, acrylics, or polyurethanes. PSA forms viscoelastic bonds that are aggressively and permanently tacky; adhere without the need for more than hand pressure; and require no activation by water, solvent, or heat. Some PSA materials are cured by hot air, electron beam, UV, or chemical (peroxide) means. They are available in a wide variety of chemical compositions and systems including acrylic and methacrylate adhesives, emulsion-based acrylic adhesive; rubber-based pressure sensitive adhesive, styrene copolymers (styrene/isoprene/styrene and styrene/butadiene/styrene block copolymers), and silicones. In some embodiments, hot melt adhesives may be useful as well, and are included herein for those embodiments as "PSA"; a hot melt adhesive is a thermoplastic adhesive compound, usually solid at room temperature which becomes fluid on heating for use. Suitable commercial examples of PSA include PS-2000™ from Dow, and "acResin®", available from BASF, and comprising a UV-curable polyacrylate that can be applied by conventional hot-melt coaters at temperatures of about 120° C. Suitable tackifiers can be added to acResin® or like compositions to control the tackiness of the adhesive; examples are FORAL® 85 synthetic resin available from Pinova. Tackifiers can be added to the base adhesive composition in any suitable amount, e.g. from 15% to 25% by weight of the total composition of PSA and tackifier, or higher than 25% by weight of the total composition of the PSA and tackifier. In some embodiments, the PSA can be blended with an olefinic additive such as polyethylene, ethylene/methyl acrylate copolymer, or ethylene/vinyl acetate copolymer. These blends can be in any suitable proportions of the PSA and olefinic additive, as long as the easy-open and reclosable functionality of the package is substantially maintained. Extrudable pressure sensitive hot melt adhesive, having an appropriate melt index and melt strength, can be extruded as an intermediate layer within a multilayer structure made by a blown or cast film process. This layer would impart the reclosable characteristics to the structure. Examples of extrudable PSA materials include but not limited to the M-series materials such as M3156T™ and M551™ available from Bostik; HL2942M™ available from H B Fuller; and VECTOR™4114A and 4186A available from Dexco. Alternatively, blends of these materials can be made with compatible materials that may act as processing aids, without unduly compromising the reclose characteristics of the original PSA. Extrudable adhesive chemistries include styrene-Isoprene-styrene and styrene-butadiene-styrene copolymers, including both the linear blocks (e.g. the resins from Bostik) and radial blocks (the VECTOR resins); silicones; high comonomer content EVA, EMA, EBA etc. based formulations; and INFUSE™ olefinic block copolymer based materials. Those skilled in the art will appreciate, after a review of this disclosure, that a particular PSA can be selected based at least in part on the particular process used to produce the film from which the discrete strip is made, e.g. coextrusion, extrusion coating, etc., and the appropriate rheology and process characteristics of the PSA desired for that process, while ensuring that the easy-open and reclosable features of the package made in accordance with the invention are substantially maintained.

"Reclosable" herein refers to a feature or function of a package in accordance with the invention whereby a package can be reclosed by bringing a folded web, panel, or portion of a folded web or panel into contact with the PSA of the discrete strip.

"Registration device" herein refers to any mark, pattern, die cut or feature of a web or strip, that facilitates the advancement of the web or discrete strip, in a controlled manner, into a packaging machine, where the web or discrete strip is used to make individual packages. The device can be e.g. printed or placed in uniformly spaced fashion along or near an edge of the web or discrete strip, i.e. registration marks, or in an area near the middle of a web that does not interfere with decorative printed graphics. These marks are used in connection with appropriate sensors to controllably advance the web or strip. Where die cuts are used as a registration device, detected by sensors, it may not be necessary to print registration marks on the web or discrete strip.

"Seal" herein means a bond between two thermoplastic surfaces, e.g. as produced by heat sealing, radio frequency (RF) sealing, ultrasonic sealing, or permanent adhesive, but excluding repositionable adhesive or PSA.

"Sealant" is a polymeric material or blend of materials, such as olefinic polymer or copolymer such as an ethylenic polymer or copolymer, that can form a surface of the discrete strip of the invention, or a web to which the discrete strip is sealed, and form a bond between two thermoplastic surfaces. A permanent adhesive can also be a sealant. "Sealant" herein, with respect to the discrete strip, or a web to which the discrete strip is attached, excludes a repositionable adhesive or PSA.

"Sealing segment" refers to a monolayer or multilayer portion of a discrete strip that can be sealed to a web or first side panel by a sealant.

"Strip" herein refers to an elongate piece of thermoplastic material, typically longer in a first direction than in a direction perpendicular to the first direction, e.g. rectangular; but can also be square, round, oblong, elliptical, or any appropriate shape in plan view. The strip can be of any suitable thickness, e.g. between 0.1 and 30 mils.

"Tamper evidence", "tampering", and the like herein refers to visual evidence of a breach in a package; i.e. that someone has accidentally or intentionally opened or partially opened the package, or attempted to do so.

"Thermoplastic" herein includes plastic materials that when heated to a softening or melting point may be reshaped without significant thermal degradation (burning). Thermoplastic includes both materials that are not crosslinked, or that are crosslinked by chemical or radiation means.

"Tray" herein refers to a formed member that has a tray bottom, tray sides, and a tray flange around the upper perimeter of the tray, where the tray bottom and tray sides form an internal cavity within which a product can be placed. The cavity can be enclosed by a lidstock sealed to the tray flange.

"Web" is used herein to mean a thermoplastic film, laminate, or web, either multilayer or monolayer, that may be used in connection with the present invention. The web can be of any suitable thickness, e.g. between 0.1 and 30 mils, and the web can be of any suitable length and width.

"Zipper" and the like herein refers to a plastic zipper closure; press-to-close or slide zipper; interlocking closure; reclosable fastener with interlockable fastener elements; interlocking rib and groove elements having male and female profiles; interlocking alternating hook-shaped closure, and the like.

All compositional percentages used herein are presented on a "by weight" basis, unless designated otherwise.

Drawings herein are not necessarily to scale, and certain features of the invention may be graphically exaggerated for clarity.

DETAILED DESCRIPTION OF THE INVENTION

1. Package

Referring to the drawings, a package 5 according to the invention is shown. Package includes a pouch 7 that can be made from either a single web, or two webs, to form a first or front side panel 12, and a second or back side panel 14.

A. Web(s)

In either embodiment, the web or webs comprises a thermoplastic material of any suitable composition, including those having as at least one component olefinic materials such as ethylene or propylene polymers or copolymers, e.g. polyethylene or ethylene/alpha olefin copolymers; polyethylene terephthalate (PET); and including webs typically used in, or useful in, HFFS, VFFS, lidstock/tray, continuous horizontal packaging and bag making apparatus and processes. The web or webs can be monolayer or multilayer in construction, can be coextruded, laminated, or made by any suitable film making process, and can have any suitable thickness.

Examples of web(s) useful in the invention include H7225B™, a barrier hybrid material used for products requiring a high oxygen barrier, such as shredded cheese; H7525B™ a barrier hybrid material used for products requiring a high oxygen barrier, such as bacon and smoked and processed meat; H7530B, like H7525B but having a thickness of about 3 mils; CP04140™, a low barrier (high OTR) material used in produce packaging, CPM4090, a microwaveable packaging film for fresh cut produce; and T7225B™, a barrier material used as lidstock for products requiring a high oxygen barrier, such as luncheon meat. These are all commercial products produced by the Cryovac business unit of Sealed Air Corporation.

H7225B™ is a laminate having the construction PET//adhesive//coextruded barrier film, where the PET is a biaxially oriented polyester film, and the barrier film has in one embodiment the construction LDPE (low density polyethylene)/EVA tie/nylon/EVOH+nylon/nylon/EVA tie/EAO. The overall thickness of the laminate can be any of several gauges, being typically about 2.5 mils. The LDPE is the surface of the barrier film adhered, by the adhesive, to the PET film. The EAO typically acts as the heat sealant layer of the film, and finished laminate, and in packaging made from the laminate, the EAO will form the inner or sealant surface of the package, facing the contained product, and the PET will form the outer or skin surface of the package. H7225B™ can be used as a lidstock (non-forming) web.

H7525B™ is a laminate having the construction PET//adhesive//coextruded barrier film, where the PET is a biaxially oriented polyester film, and the barrier film has in one embodiment the construction LDPE (low density polyethylene)/EVA/LLDPE tie/EVOH/LLDPE tie/EVA/EAO. The overall thickness of the laminate can be any of several gauges, being typically about 2.5 mils. The LDPE is the surface of the barrier film adhered, by the adhesive, to the PET film. The EAO typically acts as the heat sealant layer of the film, and finished laminate, and in packaging made from the laminate, the EAO will form the inner or sealant surface of the package, facing the contained product, and the PET will form the outer or skin surface of the package. H7525B™ can be used as a lidstock (non-forming) web.

CP04140™ is a laminate having the construction BOPP//adhesive/monolayer LLDPE film. A typical gauge for the laminate is about 1.8 mils. The LLDPE typically acts as the heat sealant layer of the finished laminate, and in packaging made from the laminate, the LLDPE will form the inner or sealant surface of the package, facing the contained product, and the BOPP will form the outer or skin surface of the package.

CPM4090™ is a laminate having the construction BOPP//adhesive/monolayer LLDPE+LDPE film. A typical gauge for the laminate is about 2 mils. The LLDPE+LDPE layer typically acts as the heat sealant layer of the finished laminate, and in packaging made from the laminate, the LLDPE+LDPE will form the inner or sealant surface of the package, facing the contained product, and the BOPP will form the outer or skin surface of the package.

T7225B™ film has the construction EAO/EAO/LLDPE tie/nylon/EVOH/nylon/EVA tie/EVA tie/nylon. The first layer of EAO typically acts as the heat sealant layer of the film, and in packaging made from the laminate, the EAO will form the inner or sealant surface of the package, facing the contained product, and the nylon of the last layer will form the outer or skin surface of the package. T7225B™ is used as a lidstock (non-forming) web.

Referring to the drawings, the first side panel 12 has a top portion 9, a first side edge 31, a second side edge 33, and a lower portion 17. The second side panel 14 has a top portion 11, a first side edge 35, a second side edge 37, and a lower portion 18. The first and second side panels 12 and 14 are joined together along their respective first and second side edges by either a seal or a fold. As shown, first side edge 31 of first side panel 12 is joined to first side edge 35 of second side panel 14 by a seal 30. Second side edge 33 of first side panel 12 is joined to second side edge 37 of second side panel 14 by a heat seal 32. The second end 34 of the pouch 7 can be either a seal or a fold. Where a single web is used to make the pouch, second end 34 will typically be a fold, although even after the web is folded, a seal such as a heat seal can optionally be installed in the area of the fold. Where two webs of film are used to make panels 12 and 14, second end 34 will be a seal that joins panels 12 and 14 together along their respective lower portions 17 and 18. The two webs can be from the same material, or can be different in composition, structure, etc.

B. Discrete Strip

1. Geometry and Placement in Package

Figure 4:
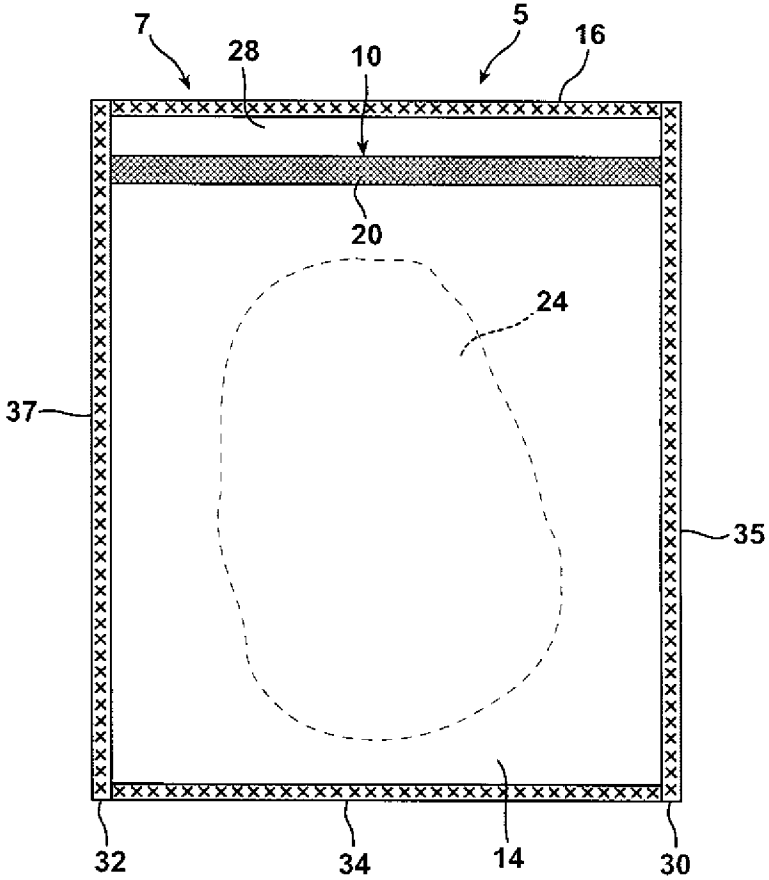
FIG. 4 is a back view of the package of FIG. 1, viewed along lines 4-4 of FIG. 1.

A discrete strip 10 is disposed between first panel 12 and second panel 14, typically spaced apart from at least one of the first end and second end of the pouch. In one embodiment (see FIG. 2B) the first end of the discrete strip is disposed at the first end of the package. The discrete strip 10 can be of any suitable dimension, and will typically be longer in length than in width, with the length of the strip 10 being e.g. greater than two times the width of the strip, e.g. greater than 3, 4, or 5 times the width. A typical dimension for the strip 10 is a width of from about 1 to 1.5 inches and a length of about 7 inches. The strip 10 will be shorter in at least one dimension than the pouch and package. For example, the strip can extend across the transverse width of a pouch made in a HFFS or VFFS process, but will be significantly narrower than the length of the package (see e.g. FIGS. 3 and 4). In one embodiment, the strip will occupy less than 50%, such as less than 40%, less than 30%, less than 20%, or less than 10% of the length of the package. The strip can in another embodiment be shorter in both dimensions than the pouch and package (see e.g. FIGS. 18 and 19). The strip can occupy e.g. less than 50%, such as less than 40%, less than 30%, less than 20%, or less than 10% of each of the length and width of the package. In some cases, the strip can be spaced apart from but near an end of the pouch or package. "Near" herein means that the first end 28 of the discrete strip closest to the first end of the pouch and package will be typically within about three inches of the first end of the pouch. The strip 10 can be closer than this, such as within about two inches, one and one quarter inches, one inch, 0.75 inches, 0.5, 0.4, 0.3, 0.2, or 0.1 inches of the first end of the pouch. The discrete strip and the PSA layer can each be of any suitable thickness. The discrete strip can for example have a thickness of between 2.0 and 5.0 mils, such as between 2.5 and 4.5 mils, between 3.0 and 4.0 mils, or any thicknesses therebetween. Factors such as the composition of the discrete strip, arrangement of layers within the discrete strip, and flexural modulus of the materials used may affect the choice of appropriate thickness of the discrete strip. The PSA can also have any suitable thickness, typically 0.5 mils, e.g. between 0.1 mil and 1 mil, or 0.2 mils and 0.8 mils, etc.

Discrete strip 10 comprises a first surface 23 and a second surface 25. In one embodiment, these first and second surfaces each comprise a sealant.

As shown in the drawings, a first portion of the first surface 23 of the discrete strip is anchored to the inner surface 27 of first side panel 12 at a first location (sealing zone "D") on the first side panel 12 to form a first anchor seal 63, providing an easy-open mechanism as described herein. The second surface 25 of the discrete strip is sealed to the inner surface of the second side panel 14 with a strong (regular) seal to form a second anchor seal shown as sealing zone "A". The functionality of this arrangement in providing an easy-open and reclosable package is disclosed in more detail herein When the appropriate die cut segment is removed or displaced from the package to open the package, the first end of the first side panel effectively becomes the first end of the portion of the first side panel that remains after the die cut segment is removed or displaced. To illustrate, in a typical package orientation, shown in elevation view in FIG. 2A, the original first end of the package 5 is the top of the package, defined by top ends 9 and 11 of the first and second side panels respectively. When the die cut segment defined by "C" is removed, the top or first end of first side panel 12 becomes the location of the side panel where the lowest die cut 21 was located (the lower end of "C" in the drawing).

2. Strip Construction

In general, strip 10 can have any total thickness desired, and each layer can have any thickness desired, so long as the strip and package provide the desired functionalities. Typical total film thicknesses are from 0.1 mils to 15 mils, such as 0.2 to 12 mils, such as 0.5 mils to 10 mils, 0.8 mils to 8 mils, and 1 mil to 4 mils. Suitable gauges include 1.5 mils, 2 mils (as in Example 1); and 3 mils.

Figure 2:
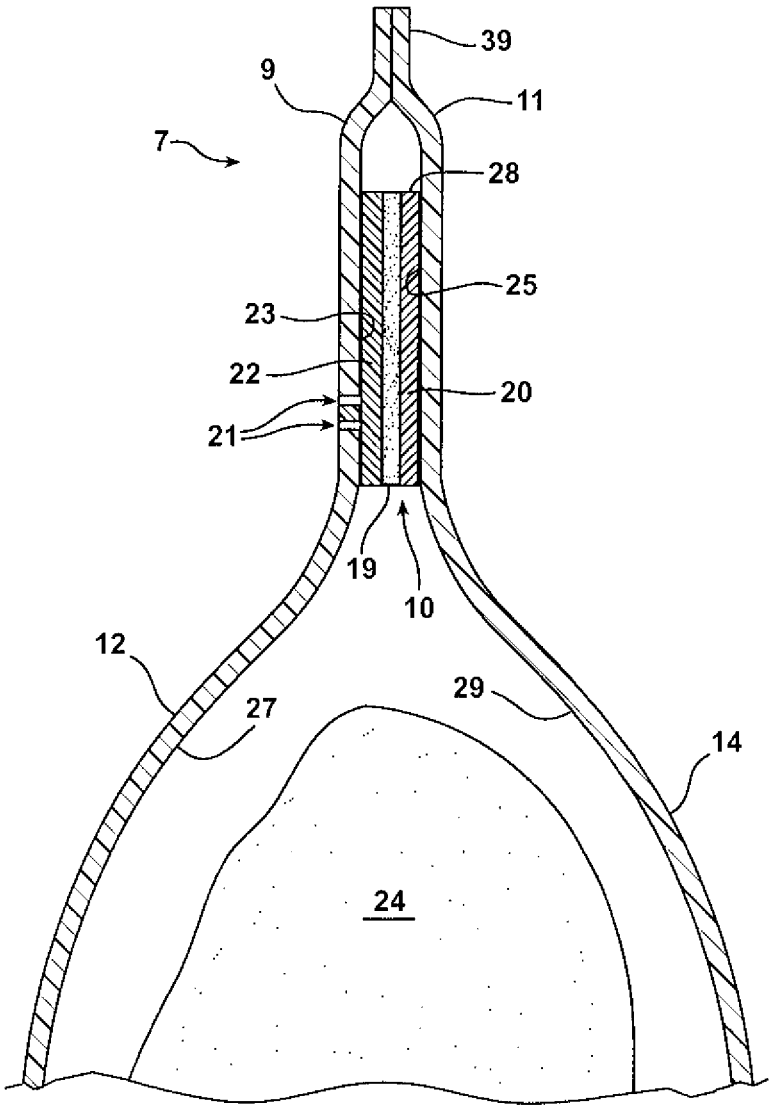
FIG. 2 is an enlarged view of the package of FIG. 1.

The discrete strip of the invention is made from a multilayer film. A representative film structure suitable for use as the discrete strip 10 according to the invention is shown in FIGS. 2 through 2C. In one embodiment, this film is a three layer coextruded film and has the composition shown in Table 1.

TABLE 1

(Example 1)

| Layer | Composition | Gauge (thickness %) | Gauge (mils) | Gauge (microns) |
|---|---|---|---|---|
| 20 | Polyethylene | 33.3 | 0.50 | 12.7 |
| 19 | PSA | 33.4 | 0.50 | 12.7 |
| 22 | Polyethylene | 33.3 | 0.50 | 12.7 |

In the embodiment of example 1, layer 22 functions as a sealant layer for sealing to a first portion of an inner surface of a front or first side panel or surface of a web to be made into a package. Layer 22 also comprises a single layer, and comprises sealing segment 22. Layer 20 functions as a sealant layer for sealing to an inner surface of a back or second side panel or surface of a web to be made into a package. Layer 20 also comprises a single layer, and comprises backing segment 20. Thus, either or both of sealing segment 22 and backing segment 20 can comprise, and consist of, only one layer.

A film of the construction of the film of Example 1 is commercially available in Europe, and sold as T174RC2™ from B-Pack, used as a primary web for a package, not as a discrete strip to be used in a package as disclosed herein.

Alternative three layer coextruded film structures, suitable for use in the invention, that were made in-house on a flat cast line include the films shown below in Table 2:

TABLE 2

(Examples 2 to 9)

| Example | Sealant Layer 22 | Reclose Layer 19 | Skin Layer 20 |
|---|---|---|---|
| 2 | IO1 | PSA1 | AD3 |
| 3 | IO2 | PSA1 | AD3 |
| 4 | IO3 | PSA1 | AD3 |
| 5 | IO4 | PSA1 | AD3 |
| 6 | IO5 | PSA1 | AD3 |
| 7 | EA3 | PSA1 | AD3 |
| 8 | EA1 | PSA1 | AD3 |
| 9 | EA2 | PSA1 | AD3 |

In each of examples 2 through 9 of Table 2, sealant layer 22 was 0.4 mils thick; the reclose layer 19 was 0.6 mils thick; and skin layer 20 was 1 mil thick.

Figure 6:
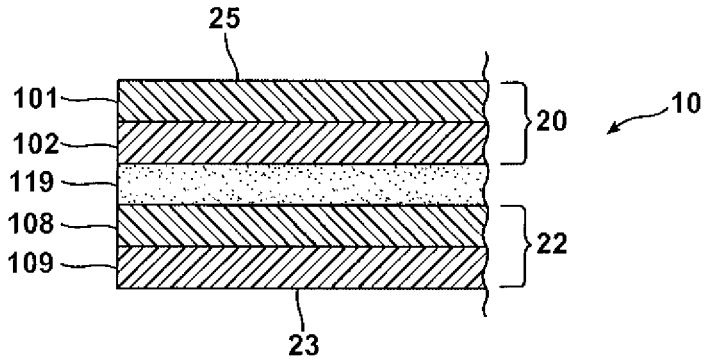
FIG. 6 is a cross-sectional view of a discrete strip.

Another representative film structure suitable for use as the film strip 10 according to the invention is shown in FIG. 6. In one embodiment, this coextruded five-layer film has the composition shown in Table 3.

TABLE 3

(Example 10)

| Segment | Layer | Composition | Gauge (thickness %) | Gauge (mils) | Gauge (microns) |
|---|---|---|---|---|---|
| backing segment 20 | 101 | 98% PE7 + 2% AB2 | 21.74 | 0.39 | 10.0 |
| | 102 | EV2 | 17.39 | 0.31 | 8.0 |
| | 119 | PSA1 | 32.61 | 0.59 | 15.0 |
| sealing segment 22 | 108 | EMAA1 | 7.61 | 0.14 | 3.5 |
| | 109 | 99% PE7 + 1% AB2 | 21.74 | 0.39 | 10.0 |

In the embodiment of example 10, layer 109 functions as a sealant layer for sealing to a first portion of an inner surface of a front or first side panel or surface of a web to be made into a package. Layer 108 functions as a sealant support layer, and also as a tie layer to bond the sealant layer 109 to the PSA layer 119. Thus, in this embodiment, sealing segment 22 comprises two layers, layers 109 and 108. In general, sealing segment 22 can comprise any suitable number of layers, such as one, two, or three or more layers, as long as the easy-open/reclose functionality of the package made from the web and discrete strip is maintained.

In the embodiment of example 10, layer 101 functions as a sealant layer for sealing to the inner surface of a back or second side panel or surface of a web to be made into a package. Layer 102 functions as a tie layer to bond the sealant layer 101 to the PSA layer 119. Thus, in this embodiment, backing segment 20 comprises two layers, layers 101 and 102. In general, backing segment 20 can comprise any suitable number of layers, such as one, two, or three or more layers, as long as the easy-open/reclose functionality of the package made from the web and discrete strip is maintained. In some embodiments, backing segment 20 can include one or more functional layers such as e.g. oxygen barrier layers.

A commercial example of a film of the construction of the film of Example 10 is available in Europe, used there as a primary web for a package.

Figure 7:
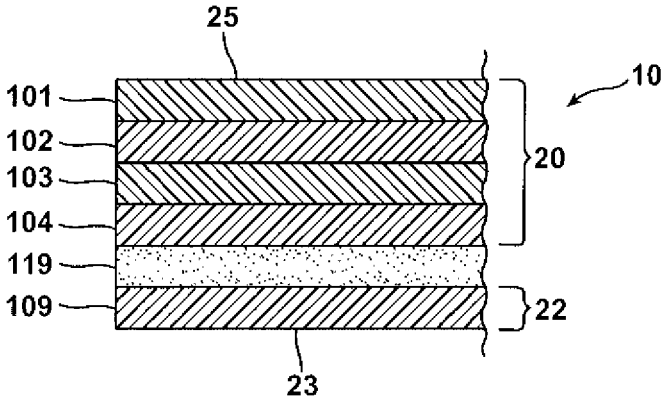
FIG. 7 is a cross-sectional view of a discrete strip according to another embodiment.

Another representative film structure suitable for use as the film strip 10 according to the invention is shown in FIG. 7. In one embodiment, this coextruded six-layer film has the composition shown in Table 4.

TABLE 4

(Example 11)

| Segment | Layer | Composition | Gauge (thickness %) | Gauge (mils) |
|---|---|---|---|---|
| backing segment 20 | 101 | PE7 | 20.00 | 0.4 |
| | 102 | AD3 | 10.00 | 0.2 |
| | 103 | OB1 | 10.00 | 0.2 |
| | 104 | AD3 | 10.00 | 0.2 |
| | 119 | PSA1 | 30.00 | 0.6 |
| sealing segment 22 | 109 | 99% PE7 + 1% AB3 | 20.00 | 0.4 |

In the embodiment of example 11, layer 109 functions as a sealant layer for sealing to a first portion of an inner surface of a front or first side panel or surface of a web to be made into a package. Thus, in this embodiment, sealing segment 22 comprises one layer, layer 109.

In the embodiment of example 11, layer 101 functions as a sealant layer that can be used for sealing to the inner surface of a back or second side panel or surface of a web to be made into a package. Layer 103 functions as an oxygen barrier layer, and tie layers 102 and 104 bond the oxygen barrier layer 103 to the sealant layer 101 and PSA layer 119 respectively. Thus, in this embodiment, backing segment 20 comprises four layers, layers 101, 102, 103 and 104.

Example 12

A film is made like the film of Example 11, but in which PSA2 is used instead of PSA1.

Example 13

A film is made like the film of Example 11, but in which layer 109 comprises 98% EA3+2% AB3.

Example 14

A film is made like the film of Example 13, but in which PSA2 is used instead of PSA1.

The materials disclosed in Tables 1 to 4, and other materials referred to elsewhere in the present application, are identified in Table 5.

TABLE 5

| Material Code | Tradename Or Designation | Source(s) |
|---|---|---|
| AB1 | 10853 ™ | Ampacet |
| AB2 | aB60051LD ™ | IMCD Italia SPA |
| AB3 | FSU 255E ™ | Schulman |
| AD1 | BYNEL ™ 39E660 ™ | DuPont |
| AD2 | PLEXAR ™ PX3236 ™ | LyondellBasell |

TABLE 5-continued

| Material Code | Tradename Or Designation | Source(s) |
|---|---|---|
| AD3 | PLEXAR ™ PX3227 | LyondellBasell |
| EA1 | PRIMACOR ™ 3330 | Dow |
| EA2 | PRIMACOR ™ 3150 | Dow |
| EA3 | PRIMACOR ™ 1430 | Dow |
| EMAA1 | NUCREL ™ 1202 | DuPont |
| EV1 | ESCORENE ™ LD318.92 ™ | ExxonMobil |
| EV2 | EVATANE ™ 28-03 | Arkema |
| IO1 | SURLYN 1650 ™ | DuPont |
| IO2 | SURLYN 1857 ™ | DuPont |
| IO3 | SURLYN 1652 ™ | DuPont |
| IO4 | SURLYN 1705 ™ | DuPont |
| IO5 | SURLYN 1706 ™ | DuPont |
| OB1 | SOARNOL ™ ET3803_ ™ | Nippon Gohsei |
| PE1 | PE ™ 1042cs15 ™ | Flint Hills |
| PE2 | AFFINITY ™ PL 1888G ™ | Dow |
| PE3 | PETROTHENE ™ NA 345-013 ™ | LyondellBasell |
| PE4 | — | — |
| PE5 | EXCEED ™ 3512CB ™ | ExxonMobil |
| PE6 | — | — |
| PE7 | SURPASS ™ FPs317-A | Nova Chemical |
| PSA1 | M3156 ™ | Bostik |
| PSA2 | M550 ™ | Bostik |

AB1 is a masterbatch having about 81% linear low density polyethylene, and about 21% of an antiblocking agent (diatomaceous earth).
AB2 is a masterbatch having about 80% linear low density polyethylene, and about 20% of a silica antiblocking agent.
AB3 is a masterbatch having about 70% low density polyethylene with 25% silica and 5% erucamide, each component by weight of the masterbatch. A very small amount of stabilizer is present.
AD1 is a maleic anhydride modified EVA that acts as a polymeric adhesive (tie layer material).
AD2 is a maleic anhydride modified LLDPE that acts as a polymeric adhesive (tie layer material).
AD3 is a maleic anhydride modified LLDPE that acts as a polymeric adhesive (tie layer material).
EA1, EA2 and EA3 are each ethylene/acrylic acid copolymer with an acrylic acid content of less than 10% by weight of the copolymer. EA1 has an acrylic acid content of 6.5% by weight of the copolymer. EA2 has an acrylic acid content of 3% by weight of the copolymer.
EMAA1 is an ethylene/methacrylic acid copolymer with a methacrylic acid content of about 12% by weight of the copolymer.
EV1 is an ethylene/vinyl acetate copolymer with a vinyl acetate content of less than 10% by weight of the copolymer.
EV2 is an ethylene/vinyl acetate copolymer with a vinyl acetate content of about 27% by weight of the copolymer.
IO1, IO2, IO3, IO4 and IO5 are each an ionomeric resin, comprising a zinc neutralized ethylene/methacrylic acid copolymer.
OB1 is EVOH with about 38 mole % ethylene.
PE1 is LDPE.
PE2 is a branched, single-site catalyzed ethylene/octene copolymer with a density of about 0.9035 grams/cubic centimeter.
PE3 is LDPE.
PE4 is a dry/pellet blend of 65% AD1 and 35% PE1.
PE5 is a linear, single-site catalyzed ethylene/hexene copolymer with a density of about 0.9120 grams/cubic centimeter.
PE6 is a blend of between 0.01% and 100%, by weight of the total composition, PE5, and between 100% and 0.01%, by weight of the total composition, EV1.
PE7 is a single-site catalyzed ethylene/octene copolymer with a density of 0.916 grams/cc.
PSA1 and PSA2 are each a pressure sensitive adhesive, comprising styrene/isoprene block copolymer.
All percentages herein are by weight unless indicated otherwise.

The oxygen barrier layer 103 of Examples 11 to 14 of the above film structures can comprise any suitable oxygen barrier material, such as EVOH, and can be blended in any suitable proportion with other polymeric materials or organic or inorganic additives as desired. Optionally, intermediate layers can be included on each respective side of layer 103, each comprising a nylon, e.g. 100% semicrystalline polyamide such as nylon 6. An intermediate layer of nylon can, in one embodiment, be placed on either or both adjacent surfaces of an EVOH or other barrier layer 103.

Tie layers 102 and 104 can comprise any suitable polymeric adhesive that functions to bond two layers together, e.g. EVA, EAO, LDPE, EMA, and anhydride grafted derivatives of these polymers. Tie layers 102 and 104 can be the same, or can differ.

Layer 108 can comprise a suitable polyolefin, such as an EAO; and/or a polymeric adhesive such as those disclosed herein for tie layers 102 and 104.

Additional materials that can optionally be incorporated into one or more of the film layers of the discrete strip or the primary web, as appropriate, include antiblock agents, slip agents, antifog agents, fillers, pigments, dyestuffs, antioxidants, stabilizers, processing aids, plasticizers, fire retardants, UV absorbers, etc.

The first anchor seal 63 (sealing zone "D"), of any suitable geometry seals the first side panel to the first surface 23 of the discrete strip. This seal is an easy-open seal.

The sealant layers of the discrete strip, e.g. layer 22 and layer 20 as depicted in FIG. 2, or layer 109 and layer 101 as depicted in FIGS. 6 and 7, can comprise any suitable sealant material or blend of materials. Examples of such materials include the following polymers, their copolymers or blends: olefinic polymers such as ethylene polymer or copolymer, ethylene/alpha olefin copolymer, ethylene/vinyl acetate copolymer, ionomer resin, ethylene/acrylic or methacrylic acid copolymer, ethylene/acrylate or methacrylate copolymer, low density polyethylene, high density polyethylene, polypropylene, propylene/ethylene copolymer, propylene/ethylene/butene terpolymer; polystyrene, syndiotactic polystyrene, ethylene/styrene copolymer, and norbornene/ethylene copolymer. Ethylene/alpha olefin copolymers can include Ziegler/Natta or single-site catalyzed ethylene/alpha olefin copolymer such as ethylene/butene copolymer, ethylene/hexene copolymer, and ethylene/octene copolymer. Cycloolefin copolymers can be used. Non-olefinic copolymers can also be used, such as polyester and polyamide. Examples of polyester include homopolymers and copolymers of alkyl-aromatic esters, such as polyethylene terephthalate (PET), amorphous polyethylene terephthalate (APET), crystalline polyethylene terephthalate (CPET), glycol-modified polyethylene terephthalate (PETG), and polybutylene terephthalate; copolymers of terephthalate and isophthalate, such as polyethylene terephthalate/isophthalate copolymer; and homopolymers and copolymers of aliphatic esters such as polylactic acid (PLA) and polyhydroxyalkonates, such as polyhydroxypropionate, poly(3-hydroxybutyrate), poly(3-hydroxyvalerate), poly(4-hydroxybutyrate), poly(4-hydroxyvalerate), poly(5-hydroxyvalerate), poly(6-hydroxydodecanoate) and blends of any of these materials. An example of a polyamide is a commercially available resin, GRILAMID™ XS1392 from EMS Grivory, comprising a blend of polyamide 6/12 and polyamide 12. For polyester and polyamide sealants on the discrete strip, the sealant layer of the first side panel, or web to made into the first side panel, that will be sealed to the discrete strip to make a package is selected to have the same or substantially the same chemical formulation. For example, if a polyester is used as the sealant for the discrete strip, a polyester is also used as the sealant for the inner surface of the first side panel. Thus, the sealant materials as disclosed herein for a sealant layer of the discrete strip can be selected for the sealant layer of the primary web to which the discrete strip will be sealed. This selection can be made based on cost of materials, the strength of the seals made in the production of the package, and the like, and takes into account that the seal of the discrete strip to the inner surface of the first side panel, or the portion of a web that becomes the inner surface of the first side panel, is such that upon opening the package as described herein, a rupture of the sealing segment of the discrete strip occurs, and upon continued opening part of the PSA layer is exposed by delamination of the sealing segment/PSA interface of the discrete strip in sealing zone "D", and access is gained to the interior of the package.

The web and discrete strip of the invention can be made by any suitable process, including coextrusion, extrusion coating, lamination, extrusion lamination, etc.

Opening Mechanisms

The package of the invention can be easily manually opened.

The first surface 23 of strip 10 is sealed with a first anchor seal to the inner surface 27 of the first side panel 12. Anchor seal 63 is an easy-open seal that will typically exhibit a combination of cohesive and delamination failure. Cohesive failure herein refers to the feature wherein the sealing segment 22 of the discrete strip fractures when the package is opened. Delamination failure herein refers to the feature wherein once the sealing segment fractures, the interlaminar bonds between the sealing segment and the PSA layer is broken. Thus, the interlaminar bond provides the interface that will break apart upon manually opening the package. This delamination occurs substantially along the portion of the discrete strip that underlies the sealing zone "D".

The invention is characterized by the fact that:

- the package before initial opening does not have a PSA on the exterior surface of the package,
- before opening the package, the PSA is not in direct contact with the outer surface of the first side panel, or of the outer surface of the second side panel,
- In some embodiments, a portion of the first side panel acts functionally as a closing flap.
- after opening the package, the first end of the package can be folded over and the exposed PSA can be brought in contact with the outer surface of the first side panel.

Figure 2A:
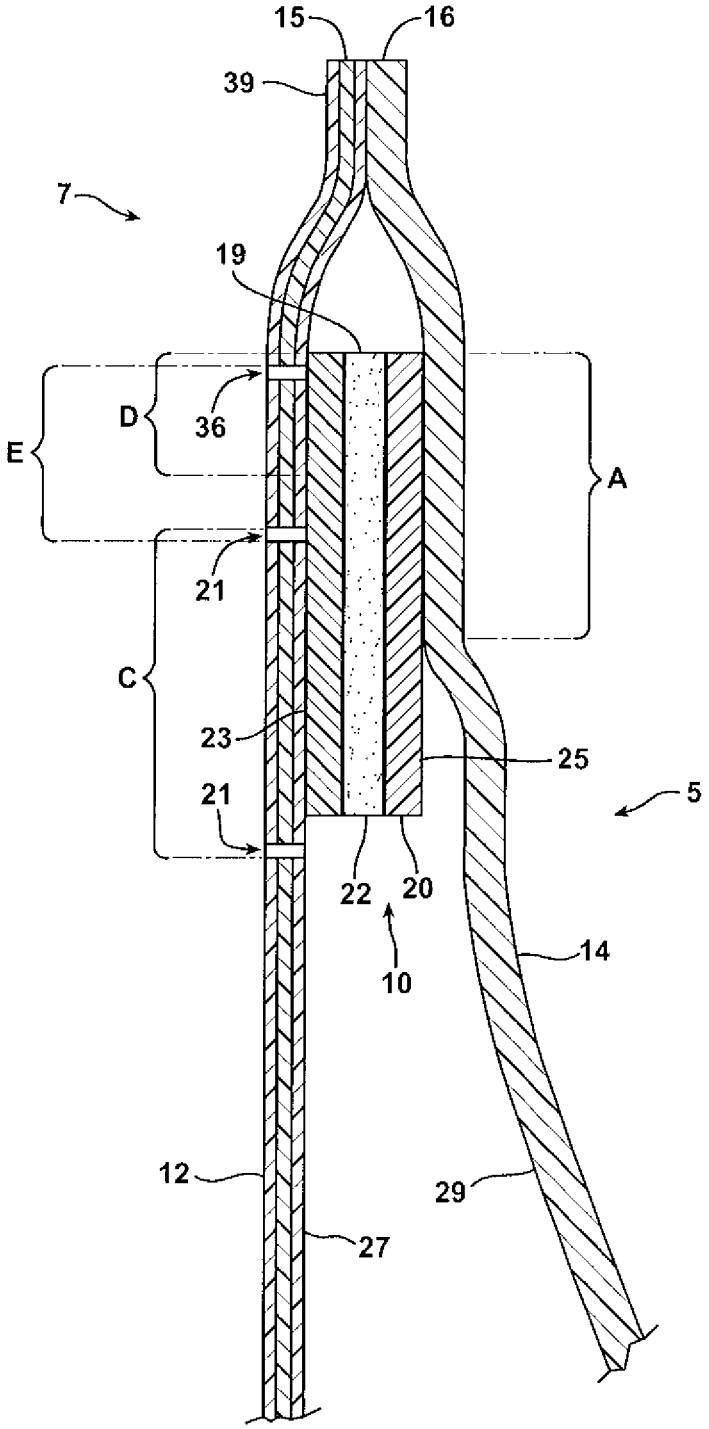
FIG. 2A is an enlarged cross-sectional view of a portion of FIG. 1.

FIG. 2A shows a primary die cut segment defined by die cuts 21, and identified as region "C". Also shown is a secondary die cut segment defined by upper die cut 21 and die cut 36, and identified as region "E". Region "C" is partially underlain by the discrete strip, and partially underlain by a clear area in which the discrete strip is not present; region "E" is entirely underlain by the discrete strip. See an alternative arrangement in FIGS. 28 A to D, and 29A to D.

Figure 2B:
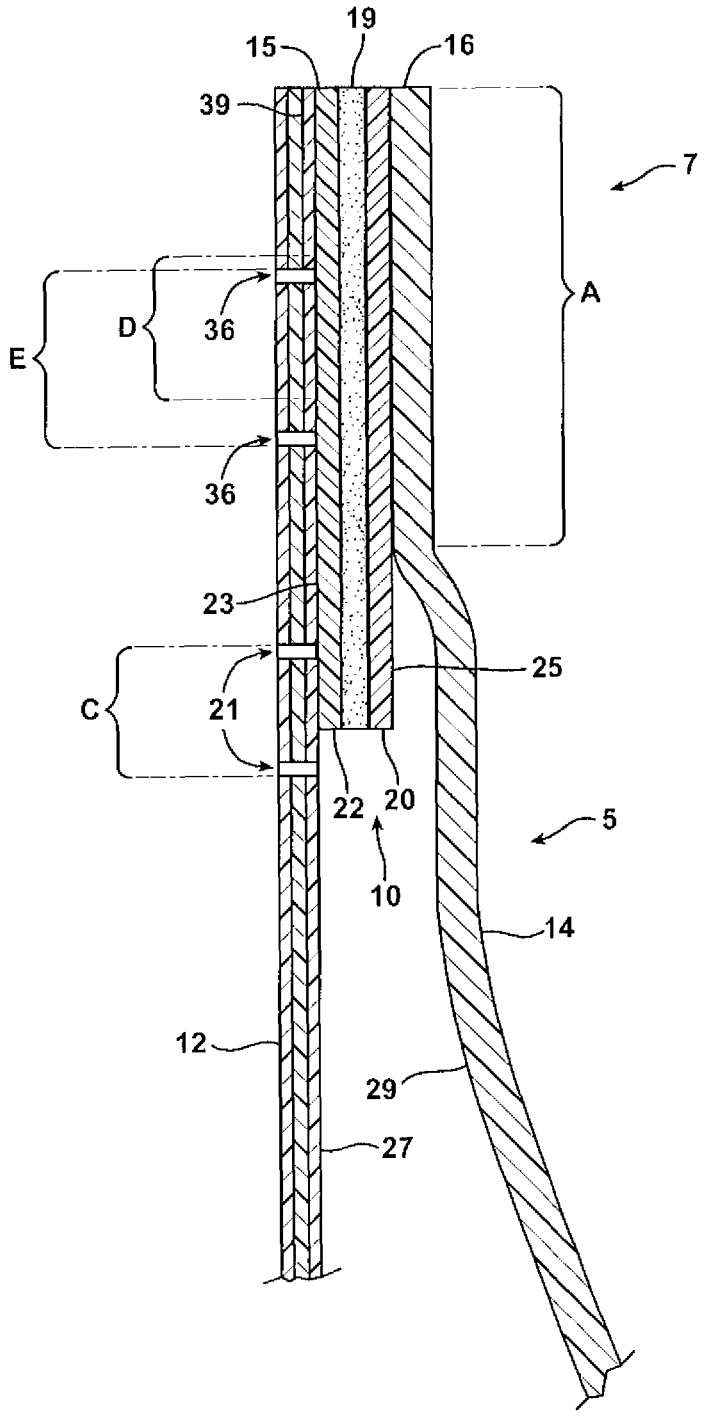
FIG. 2B is an enlarged cross-sectional view of another embodiment of a portion of a package.
Figure 2C:
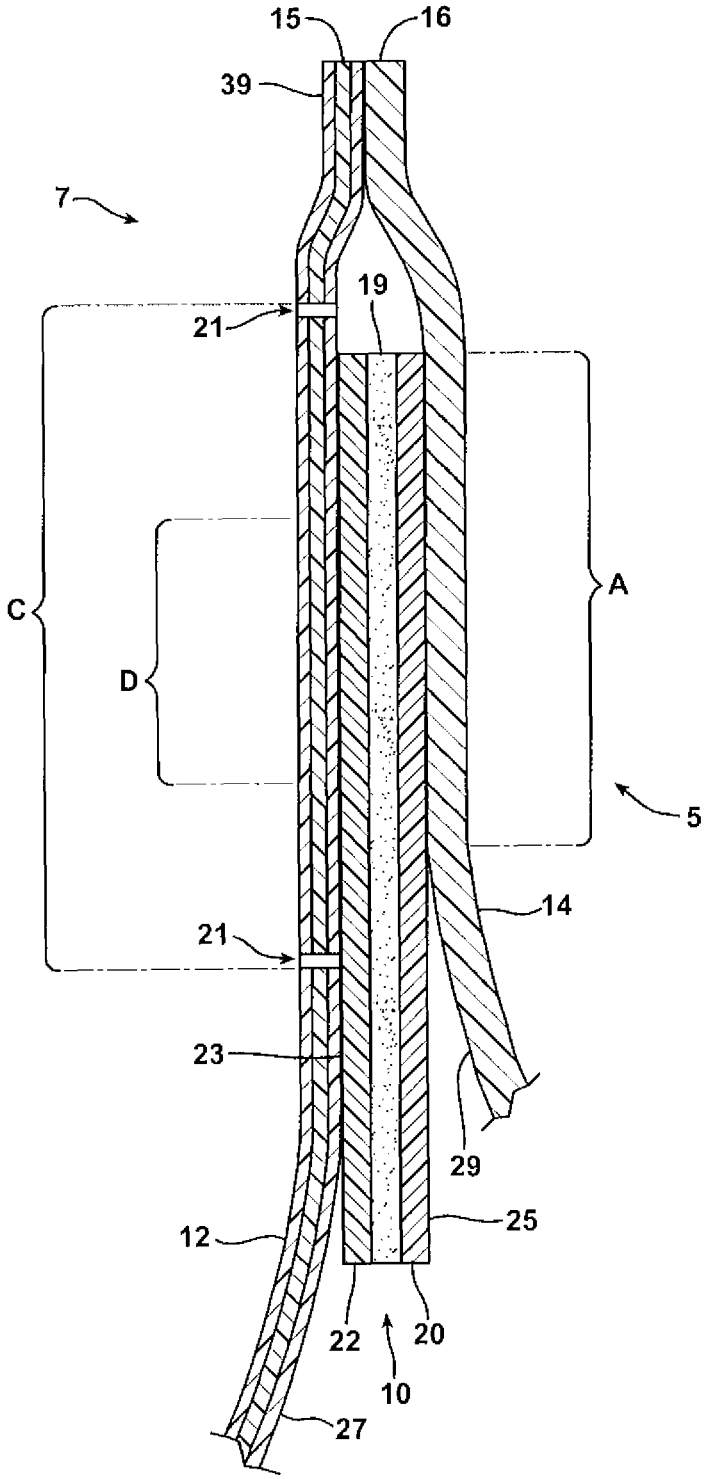
FIG. 2C is an enlarged cross-sectional view of another embodiment of a portion of a package.
Figure 3:
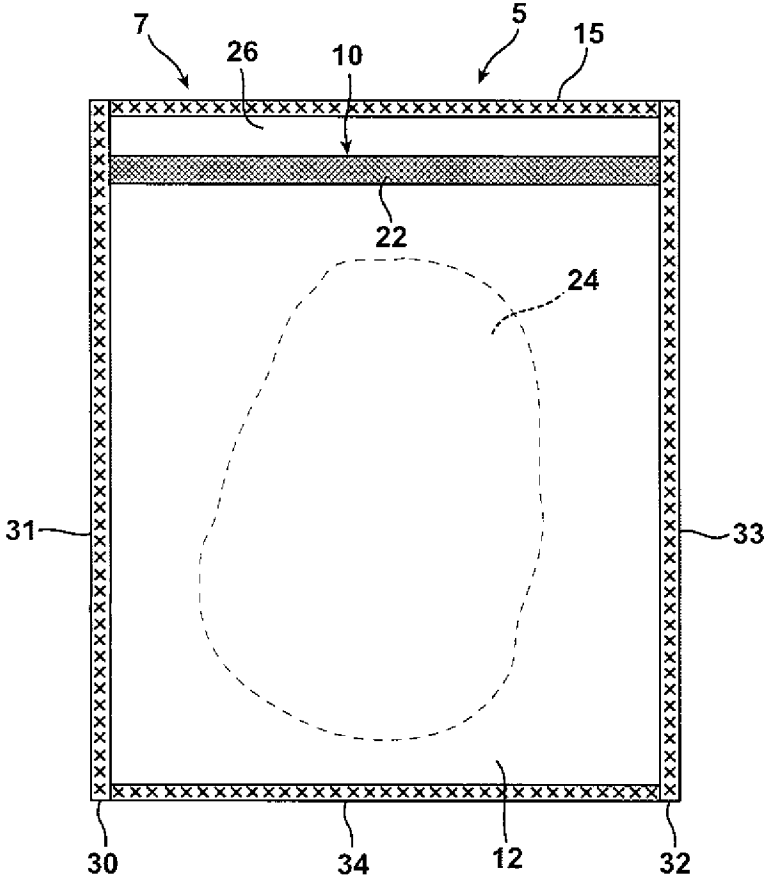
FIG. 3 is a front view of the package of FIG. 1, viewed along lines 3-3 of FIG. 1.

In an alternative embodiment, FIG. 2B is similar to FIG. 2A, but in which 1) strip 10 is sealed at its first end 28 to the inner surfaces of the first ends of the first and second side panels respectively; and 2) regions "C" and "E" are spaced from one another, and do not share a common die cut. The embodiments of both FIGS. 2A and 2B offer the feature of having the opening mechanism of the package (removing the primary die cut segment) different from the reclosing mechanism (removing the secondary die cut segment to expose the PSA, etc.). Thus, in these embodiments, the PSA need not be exposed to open the package.

In FIG. 2C, a single primary die cut segment defined by die cuts 21 can be removed, thereby opening the package and also at least partially removing the sealing segment from the discrete strip, and at least partially exposing the pressure sensitive adhesive.

In each of the embodiments of the package and process disclosed herein, a non-hermetic or hermetic package can be made in accordance with the invention.

2. Method of Making a Package

A. Horizontal form/fill/seal (HFFS)

HFFS packaging systems are generally well known to those of skill in the packaging industry, and can be used to make packages of the present invention.

Referring to FIGS. 8A, 8B, 9C and 9D, lay-flat web 300 is unwound from roll 302, then advanced to forming plow 304 to convert lay-flat web 300 to folded web 305 (typically a centerfold film). The second end of each of the pouches to be made will comprise a second end fold 306. Second end fold 306 therefore is equivalent to second end 34 of FIG. 1. This second end fold can be optionally sealed, or left as a folded second end of the pouch. Side seals 308 are made to define a plurality of vertically arranged pouches 309. Each pouch 309 is cut off from the trailing edge of web 300 by an appropriate cutting mechanism (not shown) at position 311, a product (not shown in FIG. 8, but see product 24) is inserted or dropped into the open mouth 312 of each pouch, and the pouch mouth 312 is then closed by a suitable sealing mechanism such as a heat sealer (not shown) to create a seal 314. Web 300 includes die cuts made in a predetermined pattern (see FIGS. 29A to 30D) to produce packages according to the invention.

Discrete strip 310, equivalent to strip 10 of FIGS. 1 to 5B, can be introduced into the HFFS process in a number of ways. For example, strip 310 can be unwound from a roll 315 in the vicinity of roll 302, and disposed on lay-flat web 300 prior to, or as web 300 is being folded into folded web 305. The strip is disposed on the web, typically near and spaced apart from, and parallel to, the first or second longitudinal edges 307 or 313 of the lay-flat web 300; or near the centerline of lay-flat web 300.

The strip 310 includes a discrete strip with a first and second surface. The first surface of the strip is anchored to the inner surface of folded web 305 at a first location on the folded web, by a suitable sealing mechanism such as a heat sealer (not shown). The second surface of the strip is sealed to a second inner surface of the folded web on the other side of fold 306. Strip 310 would thus be installed on the pouch in the same overall HFFS process that achieves production of the pouch, loading of a product into the pouch, and completion of the final package. Strip 310 is incorporated into the pouch material and after cutting and sealing as described hereinabove, is disposed between and sealed to the two side panels of each pouch as shown in FIGS. 8A, 8B, and FIGS. 1 to 5A.

Figure 9A:
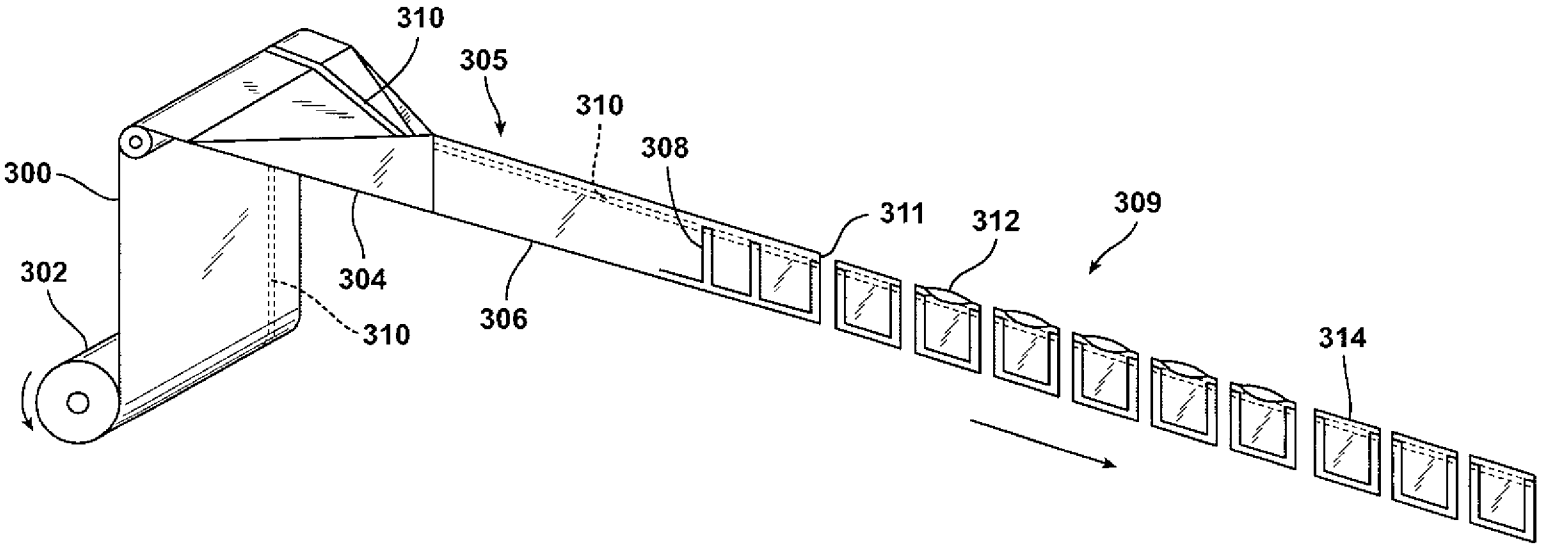
FIG. 9A is a perspective view of a HFFS process and apparatus for making a package according to another embodiment.
Figure 9B:
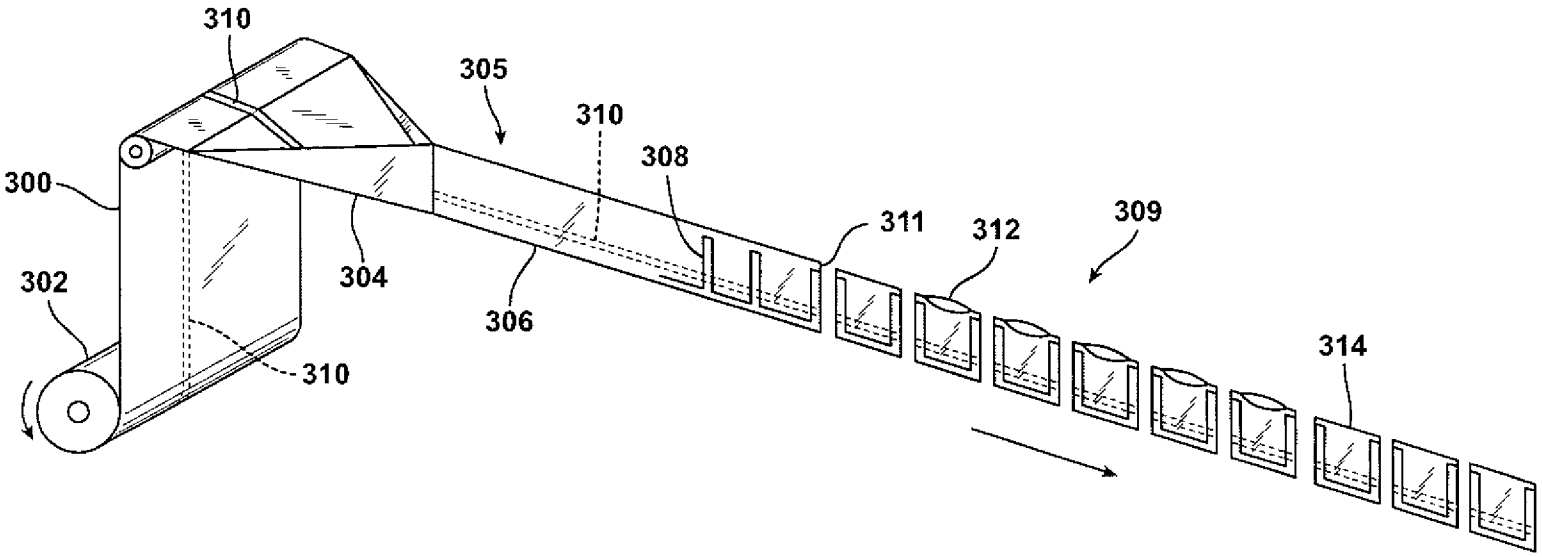
FIG. 9B is a perspective view of a HFFS process and apparatus for making a package according to another embodiment.

Alternatively, and referring to FIGS. 9A and 9B, strip 310 is shown as being installed on the lay-flat web prior to the start of the HFFS packaging process. This can be accomplished off-site from the processor, e.g. by the supplier of the web roll 302. A disadvantage of this embodiment is the asymmetry caused in the roll profile when the strip 310 is wound onto the roll, caused by the build-up in thickness of the roll in the region where the strip is applied, as the result of repeated winds of the roll.

Figure 8A:
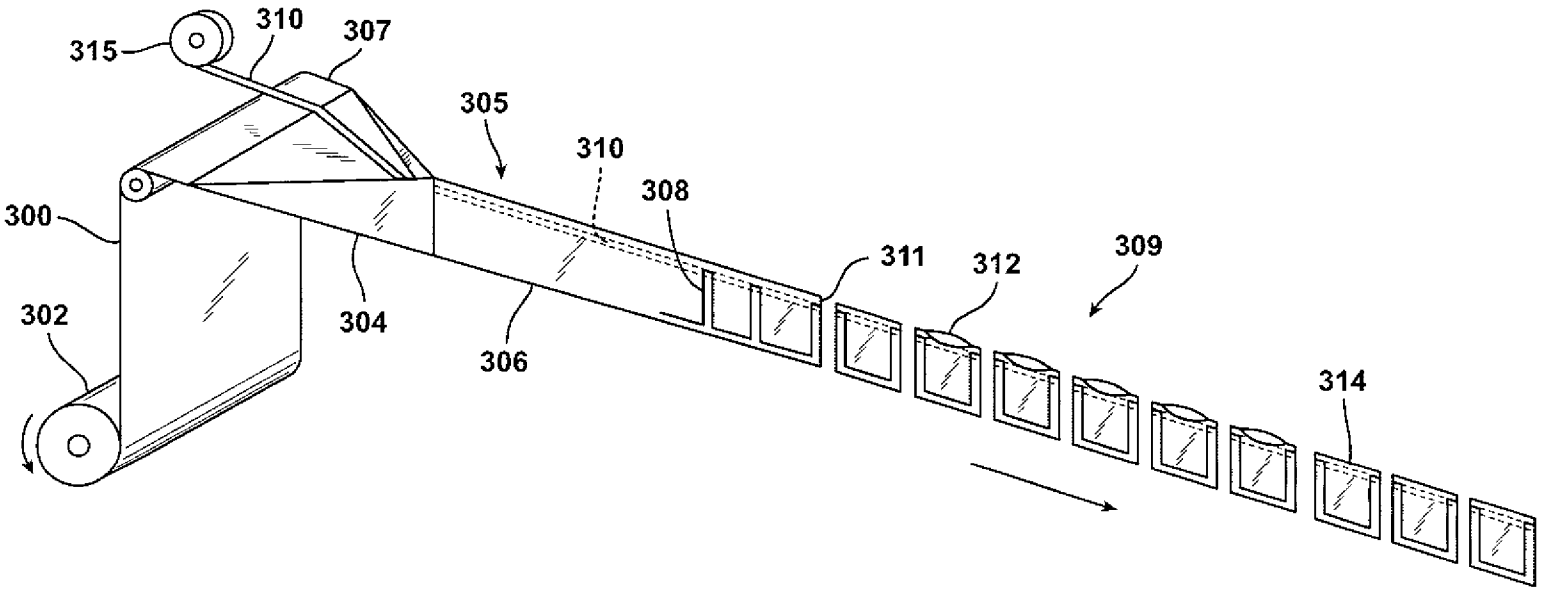
FIG. 8A is a perspective view of a HFFS process and apparatus for making a package.
Figure 9C:
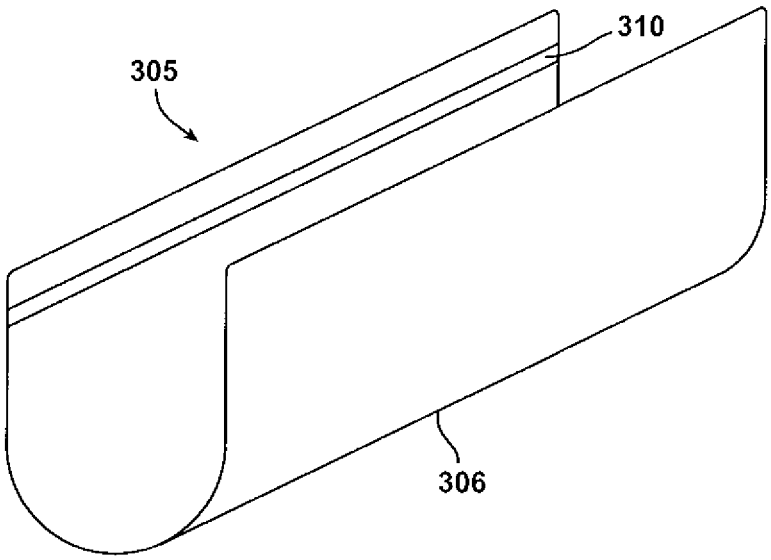
FIG. 9C is a perspective view of a section of folded web.

FIG. 9C is a perspective view of a section of folded web as shown in the HFFS process and apparatus of FIGS. 8A and 9A, as the lay-flat web is folded to create folded web 305. The discrete strip 310 is shown disposed, and optionally attached to, an inner surface 27 of one panel 12 of the folded web 305, such that upon sealing the web to create a pouch, panels 12 and 14 (see FIGS. 1 and 2) will sandwich the discrete strip 310 between them.

Figure 9D:
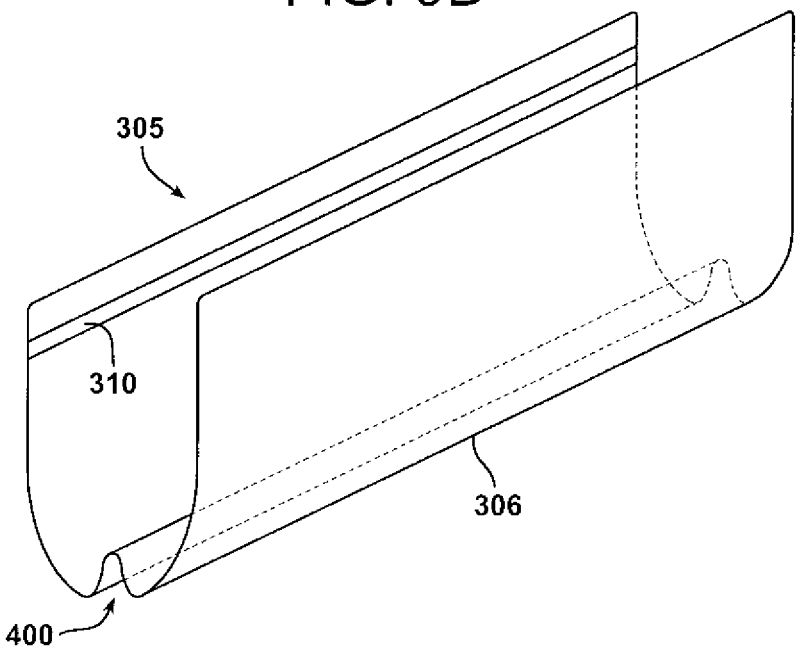
FIG. 9D is a perspective view of a section of gusseted folded web.

The embodiment of FIG. 9D is similar to FIG. 9C, but additionally shows an optional gusset 400 that can be made in the second end fold 306 of the folded web. The gusset can be optionally thereafter heat sealed. A gusseted second end provides a stand-up pouch feature in the final package. Gusseting can be accomplished by any suitable means known to those of skill in the art, such as a second forming plow (not shown) placed in-line in the manufacturing line at a position downstream of the forming plow 304. The bottom area of the folded web takes on a generally "W" shape, i.e. a gusseted shape, in cross-section, with the outside legs of the "W" extending upwardly, and two parallel reverse folds to create the gusseted bottom. Seal opening or holes are previously punched in the inner legs of the "W" shape and aligned with one another so that the two outside plies can be sealed together through these holes. When the seals are made the panels are sealed to one another through the holes. One or more static plows may be mounted above the seal zone to form the gussets. Gusset holes can be die punched by a static die at a hole-punch station at a predetermined position designed to be in general alignment with the side seal, adding rigidity to the gusset portion of the final package. This added rigidity enables the final package to stand up by itself when placed on a flat surface.

At any time during the method of making the package in an HFFS process, the second surface of the discrete strip is anchored to the lay-flat web, the folded web, or the inner surface of the second side panel. This can be done e.g. on the lay-flat web prior to supplying the web to the processor, or prior to or as the lay-flat web is advanced to a forming device, or before or after a product is put in the open pouch.

In the embodiment of FIGS. 8A and 9A, the strip is disposed on the web near and spaced apart from, and parallel to, the first longitudinal edge 307 of the lay-flat web 300. This positions the strip, in each individual pouch made by the HFFS process, near and spaced apart from the first end of each pouch, i.e. near and below the open mouth.

Figure 8B:
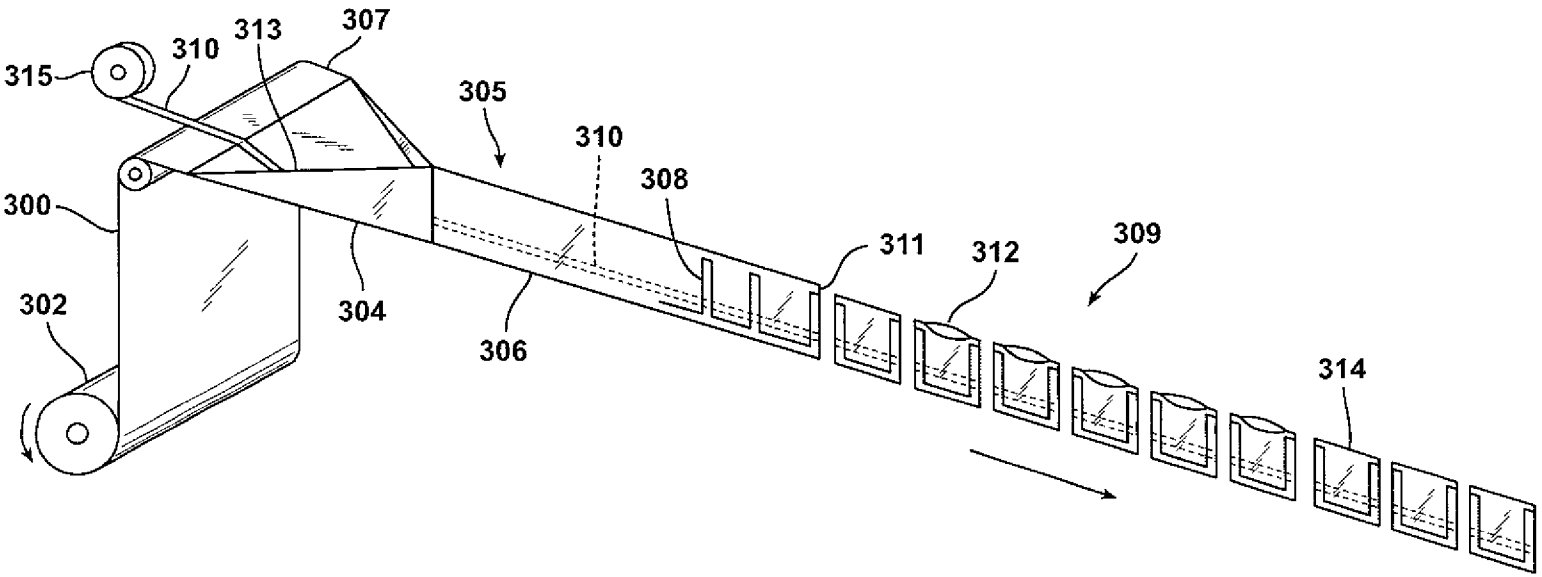
FIG. 8B is a perspective view of a HFFS process and apparatus for making a package according to another embodiment.

In the embodiment of FIGS. 8B and 9B, the strip is disposed on the web near the centerline of the web, and parallel to, the first longitudinal edge 307 of the lay-flat web 300. This positions the strip, in each individual pouch made by the HFFS process, near and spaced apart from the end fold 306 of each pouch, i.e. near and above the end fold. The end fold 306 can thus effectively become the first end of the package, with die cuts suitably installed as disclosed herein near the end fold 306.

B. Vertical Form/Fill/Seal (VFFS)

Figure 10:
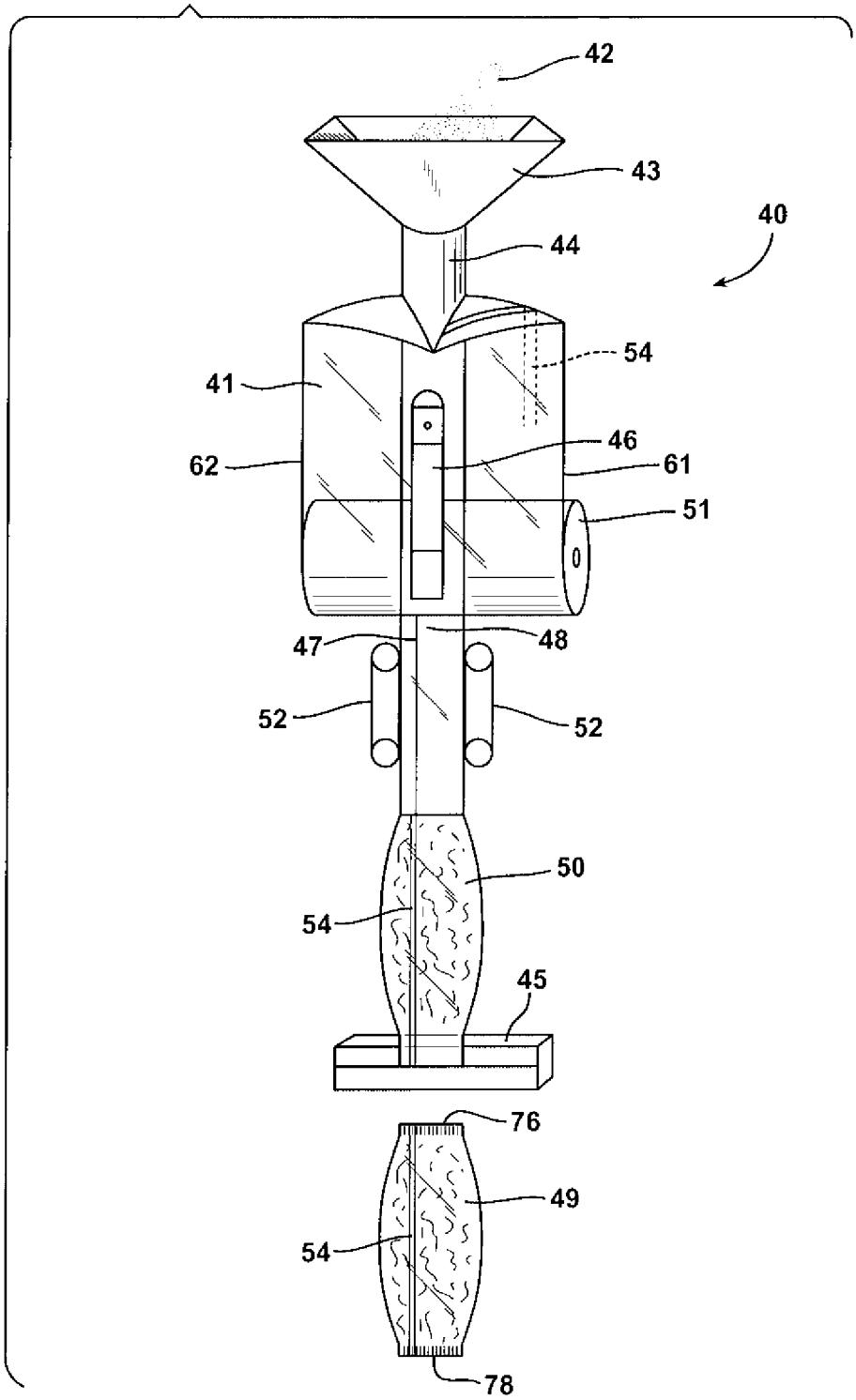
FIG. 10 is an elevational view of a VFFS process and apparatus for making a package.

FIG. 10 schematically illustrates a VFFS apparatus that can be used in conjunction with the apparatus and process according to some embodiments of the present invention. VFFS packaging systems are generally well known to those of skill in the art, and described for example in U.S. Pat. No. 4,589,247 (Tsuruta et al), U.S. Pat. No. 4,656,818 (Shimoyama et al.), U.S. Pat. No. 4,768,411 (Su), and U.S. Pat. No. 4,808,010 (Vogan), all incorporated herein by reference in their entirety.

Apparatus 40 utilizes a lay-flat web 41 as a rollstock. Web 41 includes die cuts made in a predetermined pattern (see FIGS. 29A to 30F) to produce packages according to the invention. Product 42 is manually or mechanically supplied to apparatus 40 from a source (not illustrated), from which a predetermined quantity of product 42 reaches the upper end portion of forming tube 44 via funnel 43, or other conventional means. The packages are formed in a lower portion of apparatus 40, and web 41 from which the packages are formed is fed from feed roll 51 over certain forming bars (not illustrated), is wrapped about forming tube 44 (sometimes known as a "sailor's collar" or "forming collar") and is provided with a longitudinal fin seal or lap seal 47 by longitudinal heat sealing device 46, resulting in the formation of a vertically-oriented folded web in the form of a tube 48. Transverse heat seal bars 45 operate to close and seal horizontally across the lower end of vertically-sealed tube 48, to form a pouch 49 which is thereafter immediately packed with product 42. Film drive belts 52, powered and directed by rollers, as illustrated, or by suitable alternative motive means, advance tube 48 and pouch 49*a* predetermined distance, after which seal bars 45 close and simultaneously seal horizontally across the lower end of vertically-sealed tube 48 as well as simultaneously sealing horizontally across upper end of sealed pouch 49, to form a product packaged in sealed pouch 49. The next pouch 50, thereabove, is then filled with a metered quantity of product 42, forwarded, and the packaging cycle is repeated. It is conventional to incorporate with the seal bars 45*a* cut-off knife (not shown) which operates to sever a lower sealed pouch 49 from the bottom of upstream pouch 50.

Figure 11:
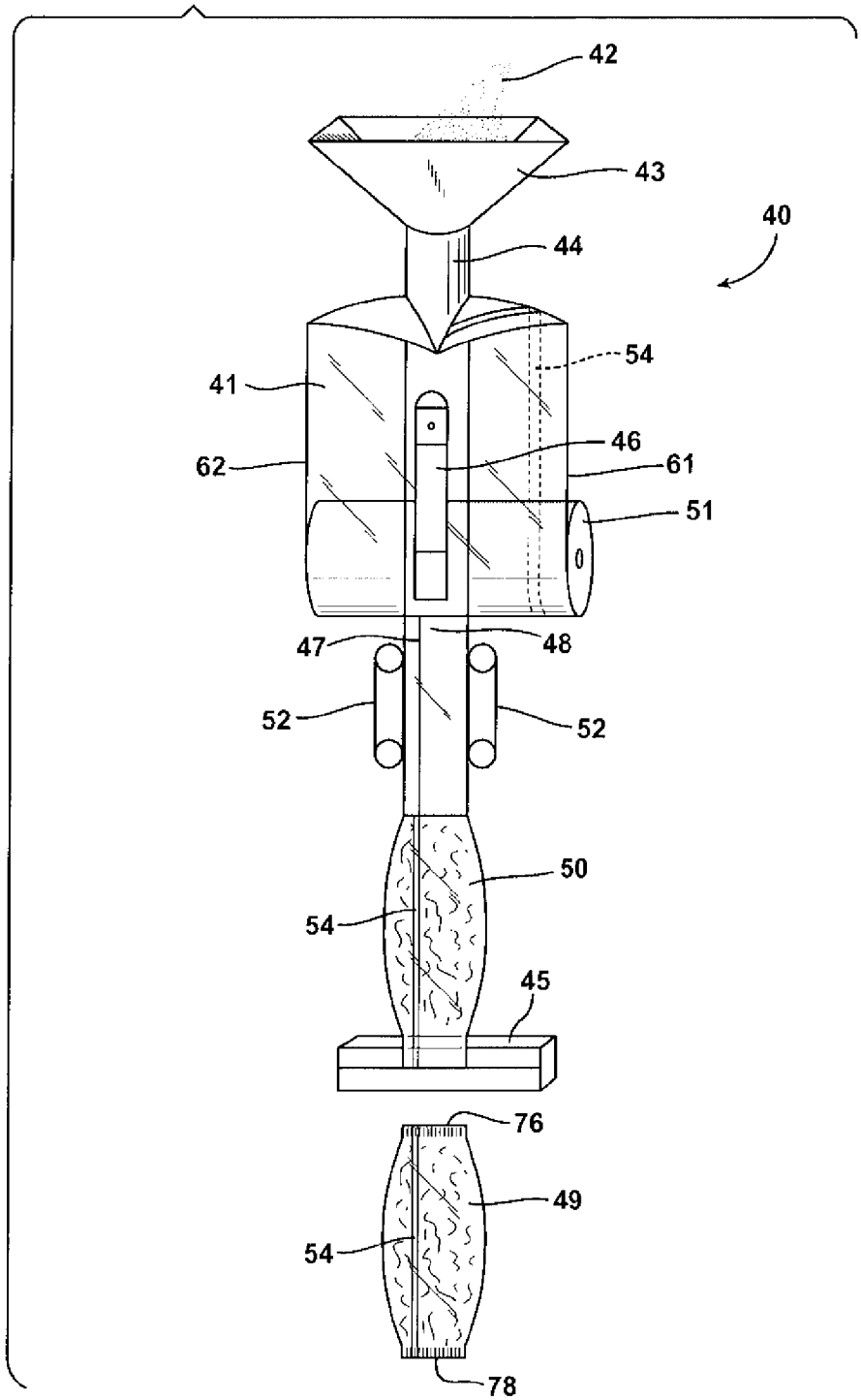
FIG. 11 an elevational view of a VFFS process and apparatus for making a package according to another embodiment.

Lay-flat web 41 of FIGS. 10 and 11 will in operation travel vertically upward from roll 51 to the forming tube 44, and then vertically downward for the remaining process steps. Discrete strip 54 is unwound from roll 53 (FIG. 12) to dispose strip 54 onto web 41 before, or as, web 41 is wrapped about forming tube 44, such that strip 54 is trapped between inner surfaces of the web 41 in the region near and spaced apart from where the longitudinal seal 47 is to be made. Fin seal 47 is made, and strip 54 is sealed to the inner surface of the formed web.

Figure 12:
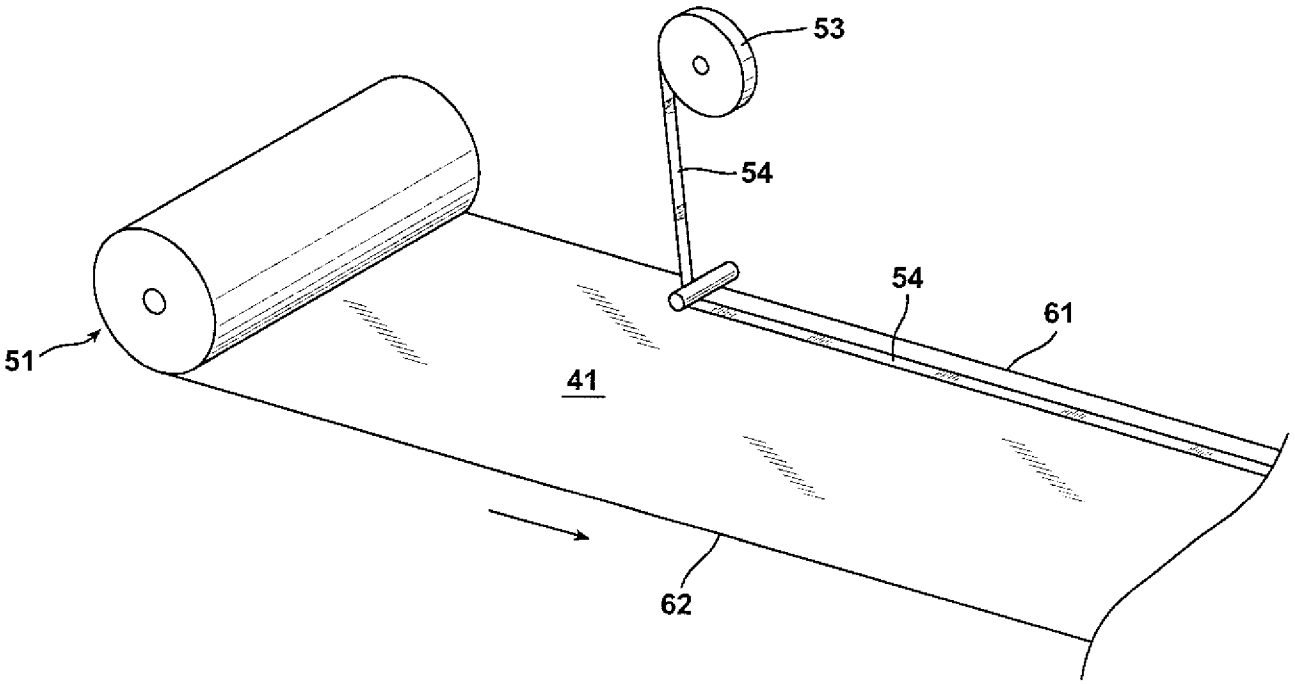
FIG. 12 is a perspective view of a roll of lay-flat film and a discrete strip.

FIG. 12 discloses the roll 51 of lay-flat web 41 according to one embodiment of the invention. Strip 54 is fed from roll 53 onto lay-flat web 41, the strip 54 disposed on web 41 near and spaced apart from, and parallel to, first or second longitudinal edges 61 or 62 of lay-flat web 41.

Figure 13:
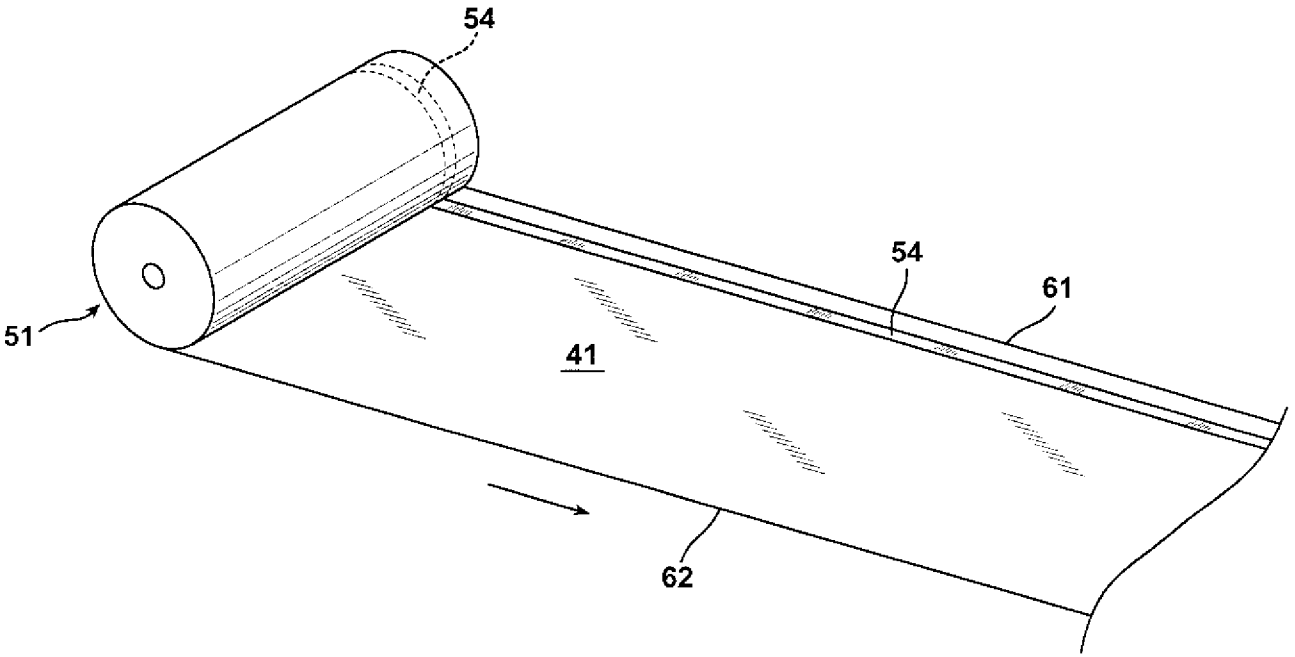
FIG. 13 is a perspective view of a roll of lay-flat film and a discrete strip according to another embodiment.

Alternatively, and referring to FIGS. 11 and 13, discrete strip 54 is already installed on the lay-flat web prior to the start of the VFFS packaging process. This can be accomplished off-site from the processor, e.g. by the supplier of the feed roll 51, but with the same disadvantage discussed for the embodiment of FIGS. 9A and 9B.

Alternatively (FIG. 14) discrete strip 74 is already installed on the lay-flat web prior to the start of the VFFS packaging process. This can be accomplished off-site from the processor, e.g. by the supplier of the feed roll 51. The disadvantage associated with the embodiments of FIGS. 11 and 13 can be avoided or minimized by spacing the consecutive strips 74 such that they are staggered as installed in winds on the roll 51, so that they are installed on the roll in a manner that avoids or minimizes roll asymmetry. The strips 74 of FIG. 14 are disposed on the web 41 spaced apart from, and perpendicular to, the first and second longitudinal edge 61 and 62.

Figure 14:
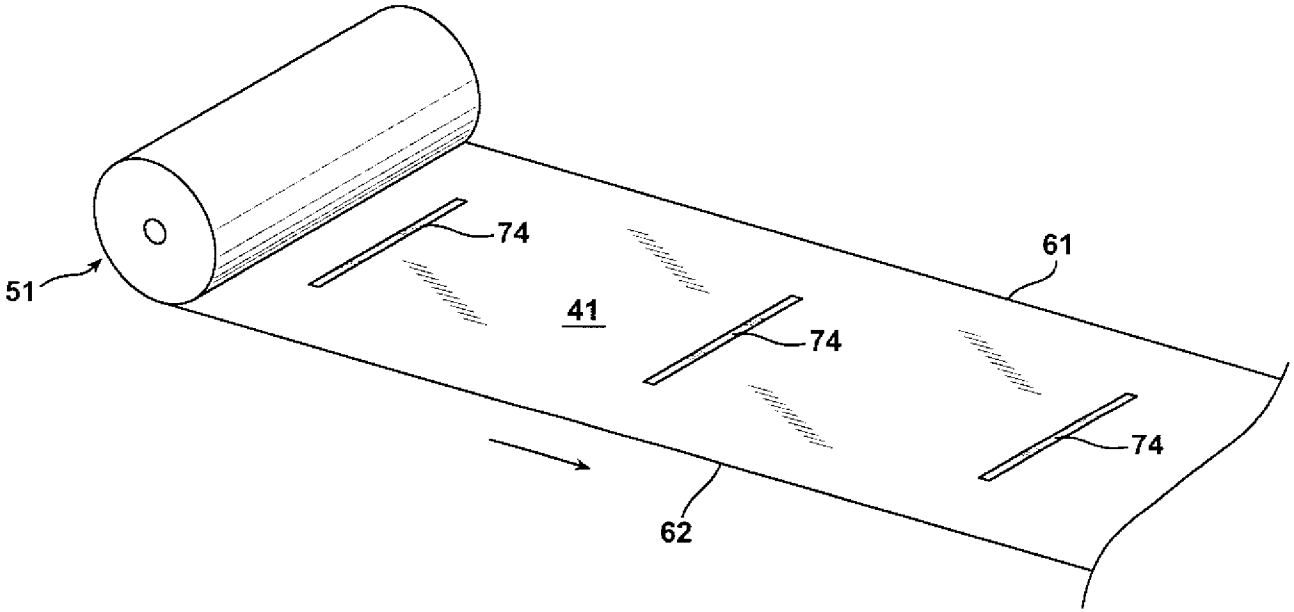
FIG. 14 is a perspective of a roll of lay-flat film and a discrete strip according to yet another embodiment.

In some embodiments, e.g. FIG. 14, at least one of the web and the discrete strip carries a registration device. Printed indicia can be in the form of registration marks, such as eye-spots. Those skilled in the art will be familiar with the use of eye-spots and registration marks in processing web material in packaging operations. Registration marks are printed in uniformly spaced fashion along or near an edge of the web or strip, and facilitate the controlled production of packages of the invention, and can be printed in conjunction with other decorative printing.

Figure 16:
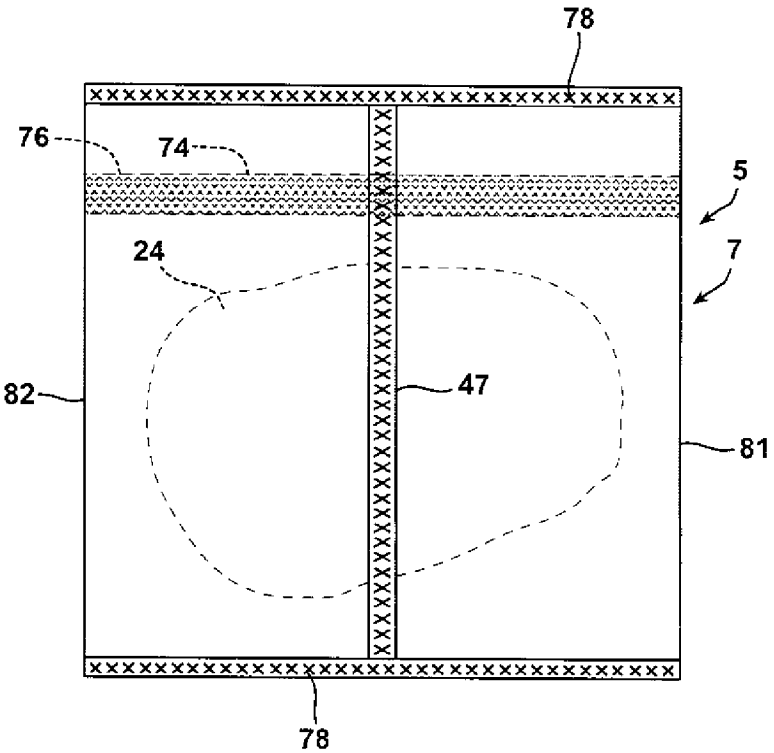
FIG. 16 is a back view of the package of FIG. 15.
Figure 15:
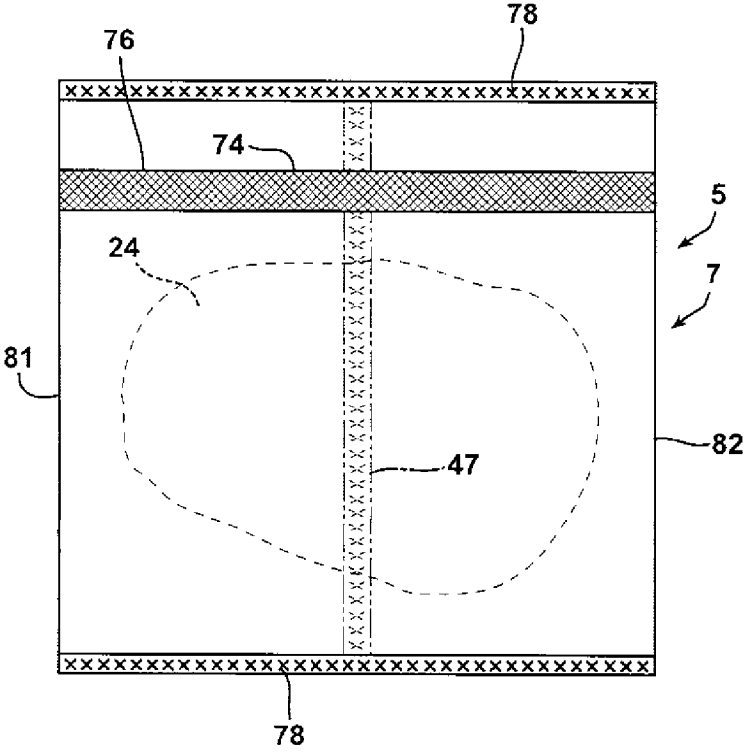
FIG. 15 is a front view of an alternative embodiment of the package.

FIG. 15 shows a front view of a VFFS package 5 made according to the embodiment of FIG. 14, and including a pouch 7 comprising first and second transverse seals 78, folded side edges 81 and 82, discrete strip 74, longitudinal seal 47; and product 24. Strip 74 is anchored to the interior surface of the first side panel of the pouch in region "D" (see FIGS. 2A and 2B), and is anchored to the interior surface of the second side panel of the pouch in region "A". FIG. 16 shows a back view of package 5.

Figure 17:
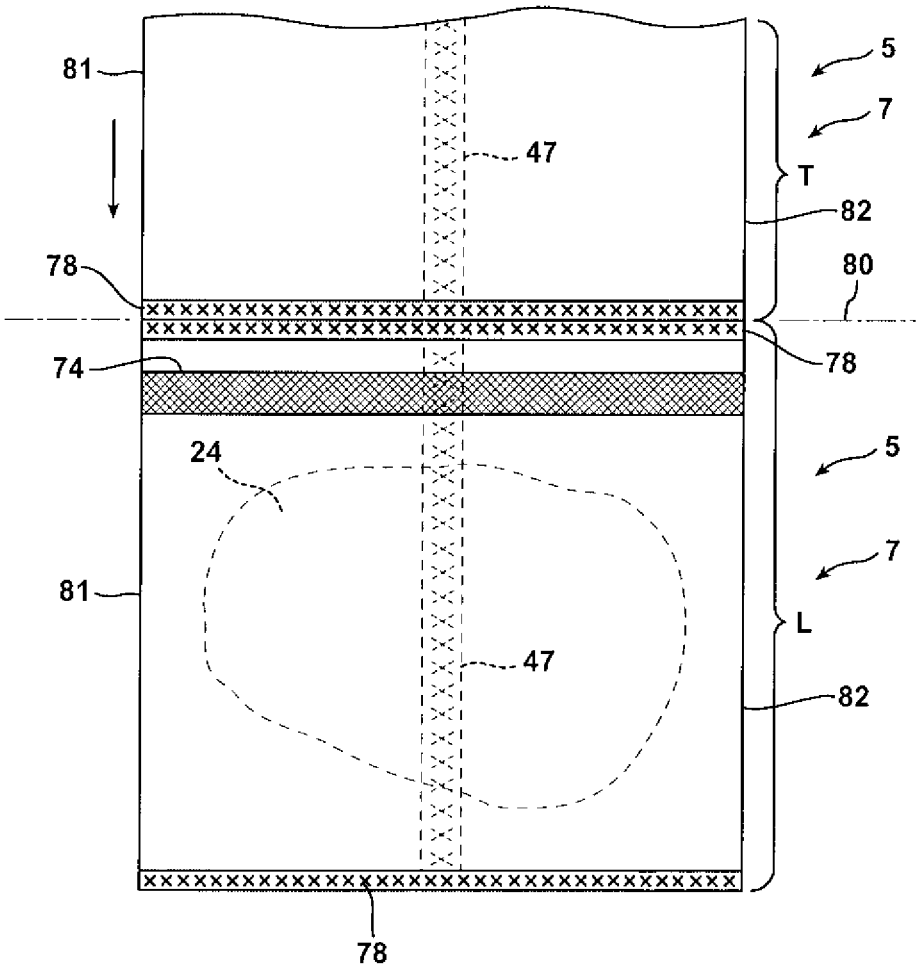
FIG. 17 is an elevational view of two consecutive pouches in a VFFS embodiment.
Figure 18:
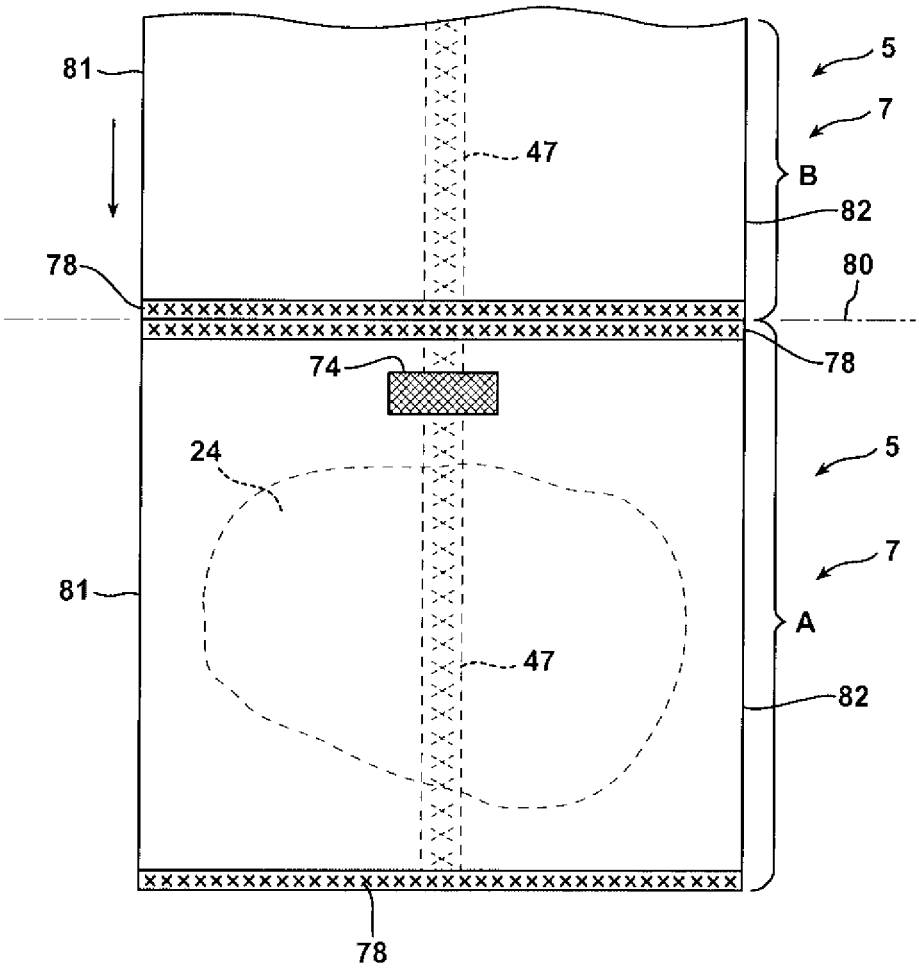
FIG. 18 is a front view of another alternative embodiment of the package.
Figure 19:
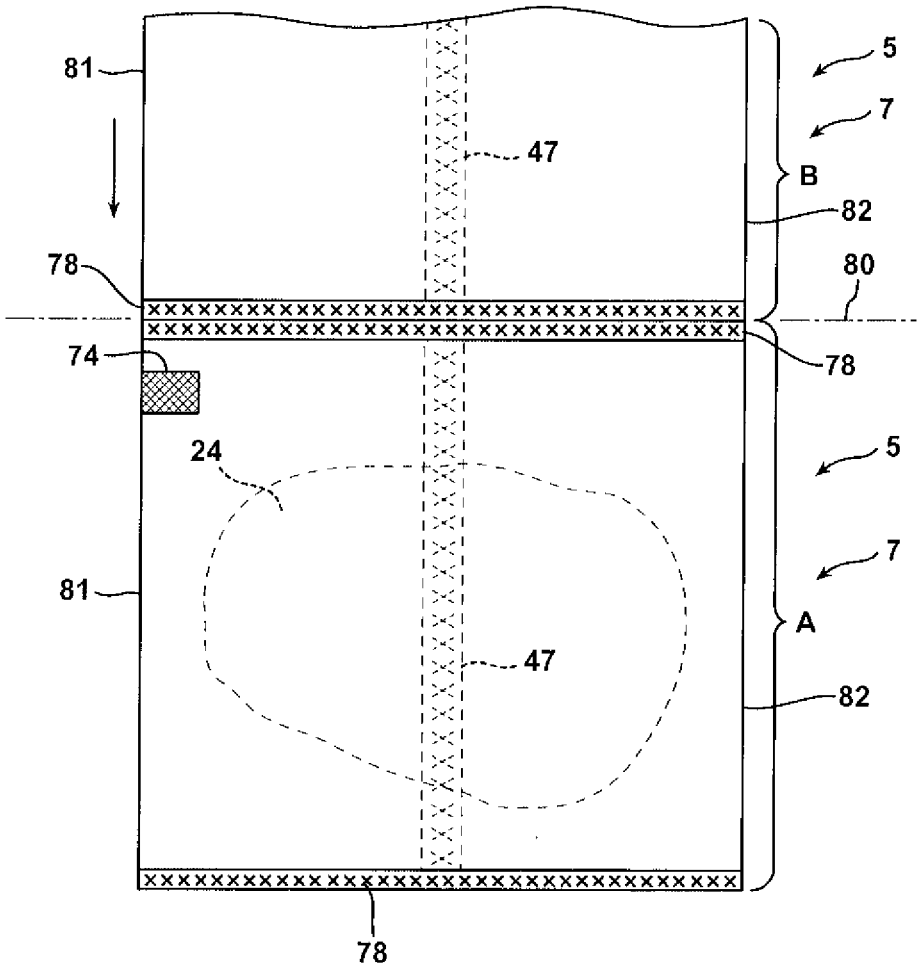
FIG. 19 is a front view of another alternative embodiment of the package.

Discrete strip 74 can extend entirely across the transverse width of pouch 7 (FIGS. 15 to 17) or across selected segments of the pouch (FIGS. 18 and 19). In FIG. 17, a leading or downstream pouch "L" includes a transverse bottom and top seals 78, folded side edges 81 and 82, strip 74, and longitudinal seal 47. Trailing or upstream pouch "T" has features similar to leading pouch "L". Leading pouch "L" is severed from upstream pouch "T" at cut line 80, and the seals 78, as well as first anchor seal 68 (see FIG. 5A) that anchors discrete strip 74 to the inner surface of the first side panel of the pouch with an easy-open seal, and a second anchor seal (not shown, but see e.g. FIGS. 2A through 2C, region "A"), are made by suitable sealing equipment commonly used in VFFS packaging processes, such as heat sealing equipment, or anchoring equipment, not shown.

Die cuts 21 and optionally 36, present in lay-flat web 41 and the first side panel of the package, are not shown in all of the drawings, e.g. in FIGS. 3, 4, and 12 through 22.

In embodiments where strip 74 extends across only selected segments of the pouch, easy-open access to the package (the ability to manually open the package under normal conditions) will be roughly proportionate to that part of the package occupied by the strip. Thus, In FIG. 18, strip 74 is relatively small, and centrally located. This embodiment provides easy-open access to pouch L through a relatively narrow opening defined by strip 74. In FIG. 19, a very small generally square shaped strip permits only a small easy-open access opening, functioning effectively as a pour spout. In these embodiments, the lateral extent of die cuts 21 and 36 can be proportionately small.

Figure 20:
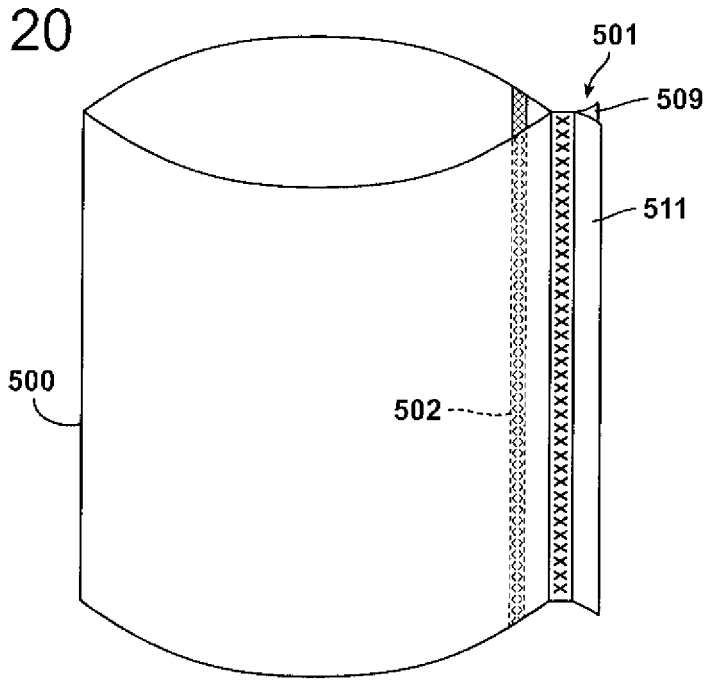
FIG. 20 is a perspective view of a folded web for use in the invention.
Figure 21:
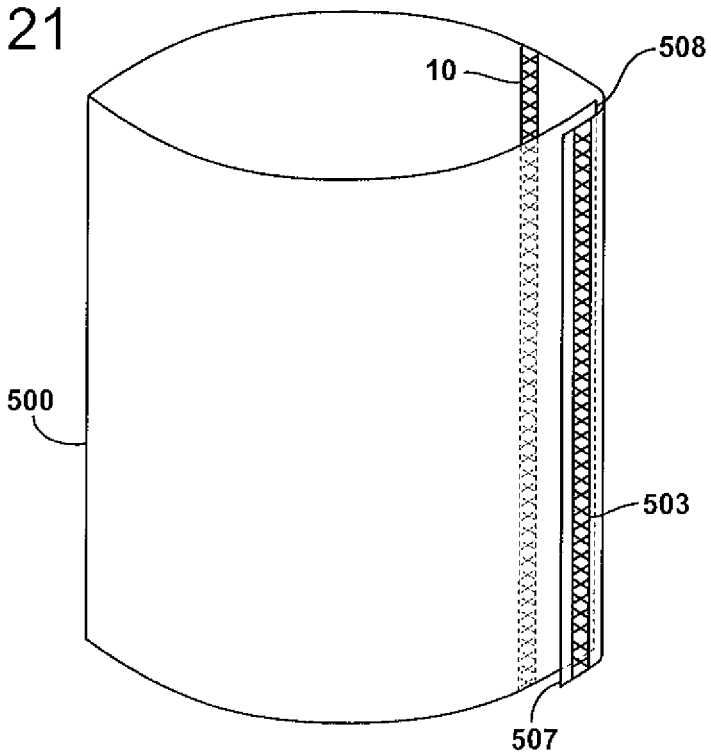
FIG. 21 is a perspective view of a folded web for use in the invention.
Figure 22:
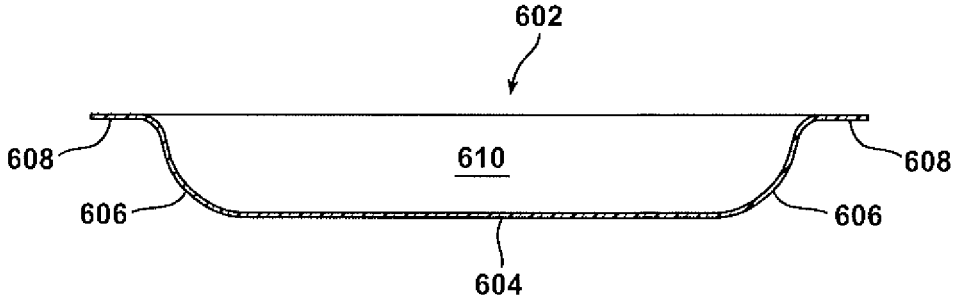
FIG. 22 is a side view of a tray for use in connection with the invention.

FIG. 20 shows folded web 500 in which the discrete strip 502 is sealed to a longitudinal portion of the folded web, and is positioned near and spaced apart from fin seal 501, formed as disclosed hereinabove, or alternatively the discrete strip is positioned in the fin seal. A finished package made according to FIG. 20 will thus look like the packages of FIGS. 3 and 4, when these are viewed at right angles to their position in FIGS. 3 and 4, i.e. with the strip 10 to the right side of each package, and the second end 34 representing a fold. The embodiment of FIG. 20 thus provides a method of producing packages on a VFFS apparatus where the longitudinal seal of the package effectively becomes the first end of the finished package (discounting any unsealed material between the longitudinal seal and the top edge of the package). The apparatus and methodology of U.S. Pat. No. 6,293,073 (Caudle) this patent incorporated herein by reference in its entirety, can be utilized in combination with the teachings herein, to produce packages according to this embodiment. A point of distinction is that in the present invention, the transverse seals will typically (although not necessarily) be rectilinear, whereas the transverse seals disclosed in Caudle '073 are wavy or sinusoidal.

Alternatively (FIG. 21), a package like the embodiment of FIG. 20 is shown, but where a lap seal 503 is shown wherein discrete strip 10 is sealed to a longitudinal portion of the folded web, near a first longitudinal edge 507 of the folded web, and is positioned near and spaced apart from lap seal 503 of the folded web, formed as disclosed hereinabove. In this as well as the other processes disclosed herein, a lap seal can be used in lieu of a fin seal when making a longitudinal seal according to the invention. A finished package 5 according to FIG. 21 has a product therein; the two longitudinal ends of the package are closed by a transverse seal; the lap seal runs down the middle or spine of the package, the package bounded on both ends by the transverse seals; and a discrete strip is anchored to an interior surface of the folded web.

At any time before or during the method of making the package in an VFFS process, the first surface of the discrete strip is anchored to the lay-flat web, the folded web, or the inner surface of the first side panel, and the second surface of the discrete strip is anchored to the lay-flat web, the folded web, or the inner surface of the second side panel. This can be done on the lay-flat web prior to supplying the web to the processor, or prior to or as the lay-flat web is advanced over a forming device, or before or after a product is put in a pouch.

C. Lidstock/Formed Web

FIGS. 22, and 23A to 23C illustrate in another embodiment the use of a formed web, e.g. a tray, and a non-formed web, e.g. a lidstock, used in connection with the invention. Tray 602 will typically be made during the packaging process.

Thermoforming equipment, available from e.g. Multivac, Tiromat, Ulma or Rapid Pak, is used to convert flat thermoplastic forming web into formed pockets to create trays for containing product such as food, various industrial and consumer items and sterile medical products. Trays are formed from a lower web by heat and pressure, and can be loaded with product manually or automatically on the machine. After that, the packages are vacuumized or backflushed with modified atmosphere (if required), hermetically sealed to an upper web, separated, and removed for distribution or storage. Alternatively, pre-formed trays can be used.

Each tray 602 has a tray bottom 604, tray sides 606, and a tray flange 608 along its perimeter to which the lidstock 612 can be sealed by heat or other means. Tray bottom 604 and tray sides 606 define tray cavity 610. Prior to any thermoforming step, tray 602 can be of any suitable thickness, e.g. from 2 to 30 mils thick, and any suitable construction.

If a pre-made tray is used according to the invention, it can be rigid or semi-rigid, can be in the form of a flat or shaped tray, and can be made from any suitable material, including solid or expanded embodiments, such as PP, polystyrene, polyamide, 1,4-polymethylpentene (e.g. TPX™ available from Mitsui), or crystallized polyethylene terephthalate (CPET). A tray liner can optionally be used that adheres to the surface of the pre-made tray on which the product is to be placed. This liner can be of any suitable design, and can be a multi-layer structure with at least one layer with gas-barrier properties. Such a liner can be adhered to the tray by heat lamination, extrusion lamination, extrusion coating, adhesives, corona treatment, etc. Tray 602 can be a flexible or semi-rigid, or rigid formed web.

Figure 23A:
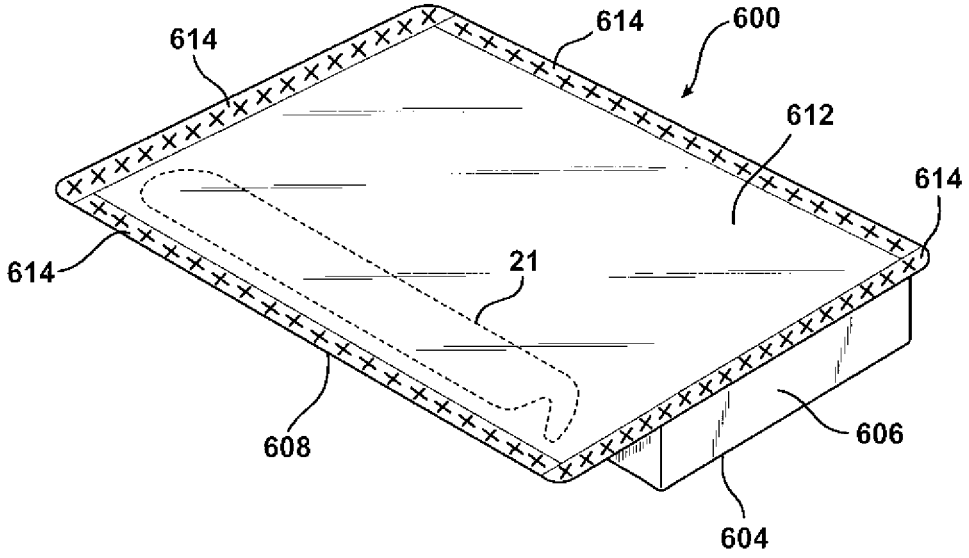
FIG. 23A is a perspective view of a package.
Figure 23B:
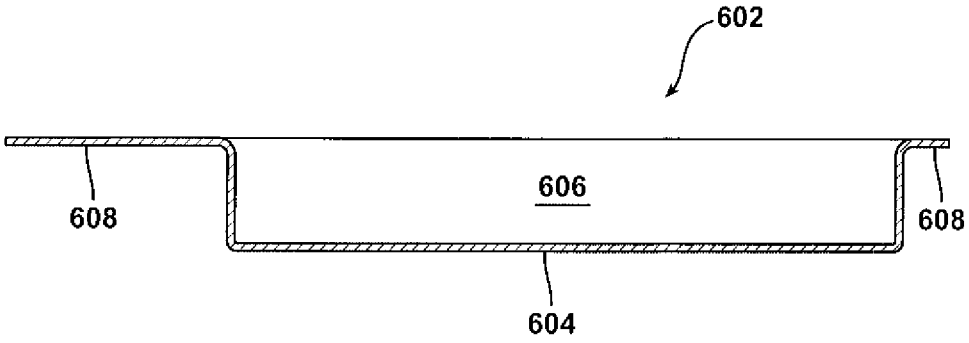
FIG. 23B is an elevational view of a tray with an extended flange for use in connection with the invention.
Figure 23C:
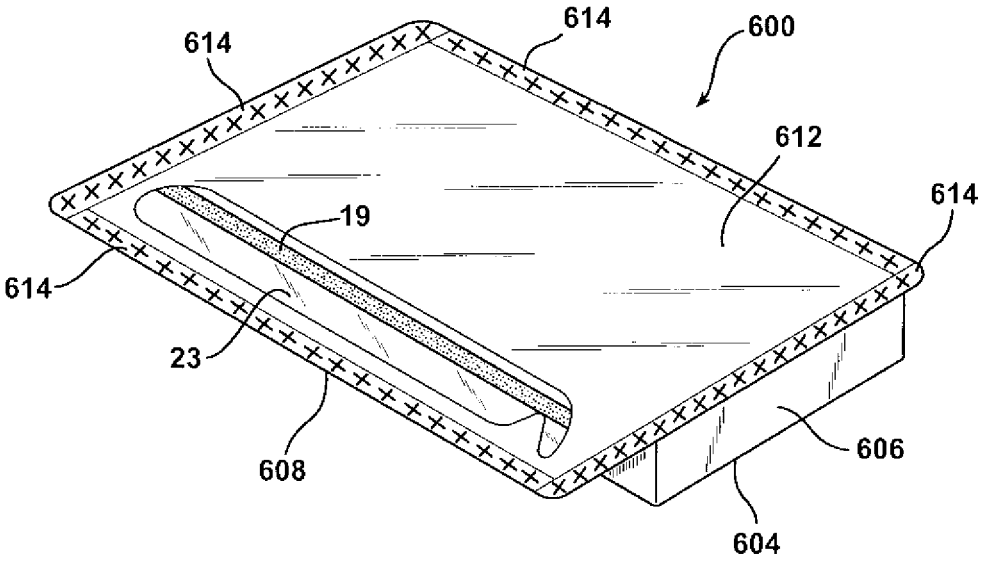
FIG. 23C is a perspective view of the package of FIG. 23A in an opened condition, with the die cut segment removed to expose a pressure sensitive adhesive.

Referring to FIG. 23A, a package includes tray 602 having an extended tray flange 608 (see FIG. 23B) to which lidstock 612 has been sealed with perimeter seal 614. Lidstock 612 is typically a lay-flat web formulated to function as a lid on a formed web, and can be any suitable monolayer or multilayer thermoplastic film as described herein with respect to webs useful in connection with the present invention. The discrete strip is disposed between the lidstock and the tray flange such that the discrete strip is trapped between and sealed to the lidstock and tray flange at the perimeter seals. The discrete strip has the easy-open characteristics and composition discussed herein with respect to the discrete tape of HFFS or VFFS packages. The discrete strip is anchored to the tray flange. The first side panel at closed loop die cut 21 can be removed so that the package is easily opened and product can be removed as desired. Removal or displacement of the primary die cut segment defined by die cut 21 also exposes the PSA layer 19 (see FIG. 23C). After removing the product, the package can be reclosed by folding over the first end of the package (where the extended tray flange is located) such that the PSA contacts the outer surface of lidstock 612.

Figure 24:
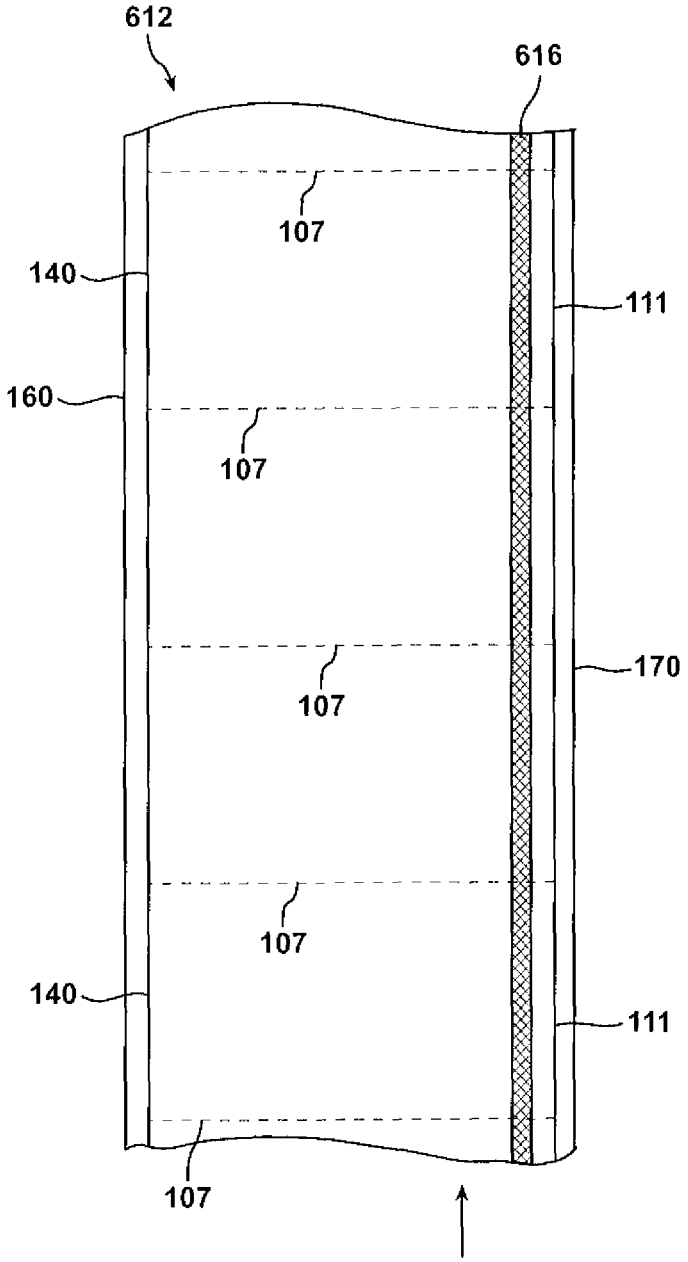
FIG. 24 is a plan view of a lidstock.

Referring to FIG. 24, dotted lines 107 indicate the location at which lidstock 612 is sealed and cut, e.g. perimeter heat sealed and cut, in registered fashion by otherwise conventional means as discussed herein, e.g. in thermoforming equipment, to create individual packages. Lines 107 represent what will become the side edges and seals of individual packages when lidstock 612 is advanced into a packaging system where it is progressively fed over filled trays, sealed to the trays, and cut to create finished packages. Lines 111 and 140 represent what will become the first and second end respectively of individual packages. Lidstock 612, as rolled up, and as it feeds into thermoforming equipment, has a second lateral edge 160 and first lateral edge 170. During the sealing and cutting operation to make individual, filled packages, the web will be cut such that the lidstock material between lines 170 and 111, and between lines 160 and 140, will be removed as scrap.

FIG. 24 shows strip 616 disposed on lidstock 612 near, parallel to, and spaced apart from, line 111. Strip 616 can be preinstalled on lidstock 612 by the supplier of the lidstock, as in the embodiments of FIGS. 9A and 9B, 11 and 13. Alternatively, strip 616 can be installed on the lidstock during the packaging process, as in the embodiments of FIGS. 8A and 8B, 10, and 12.

Figure 25:
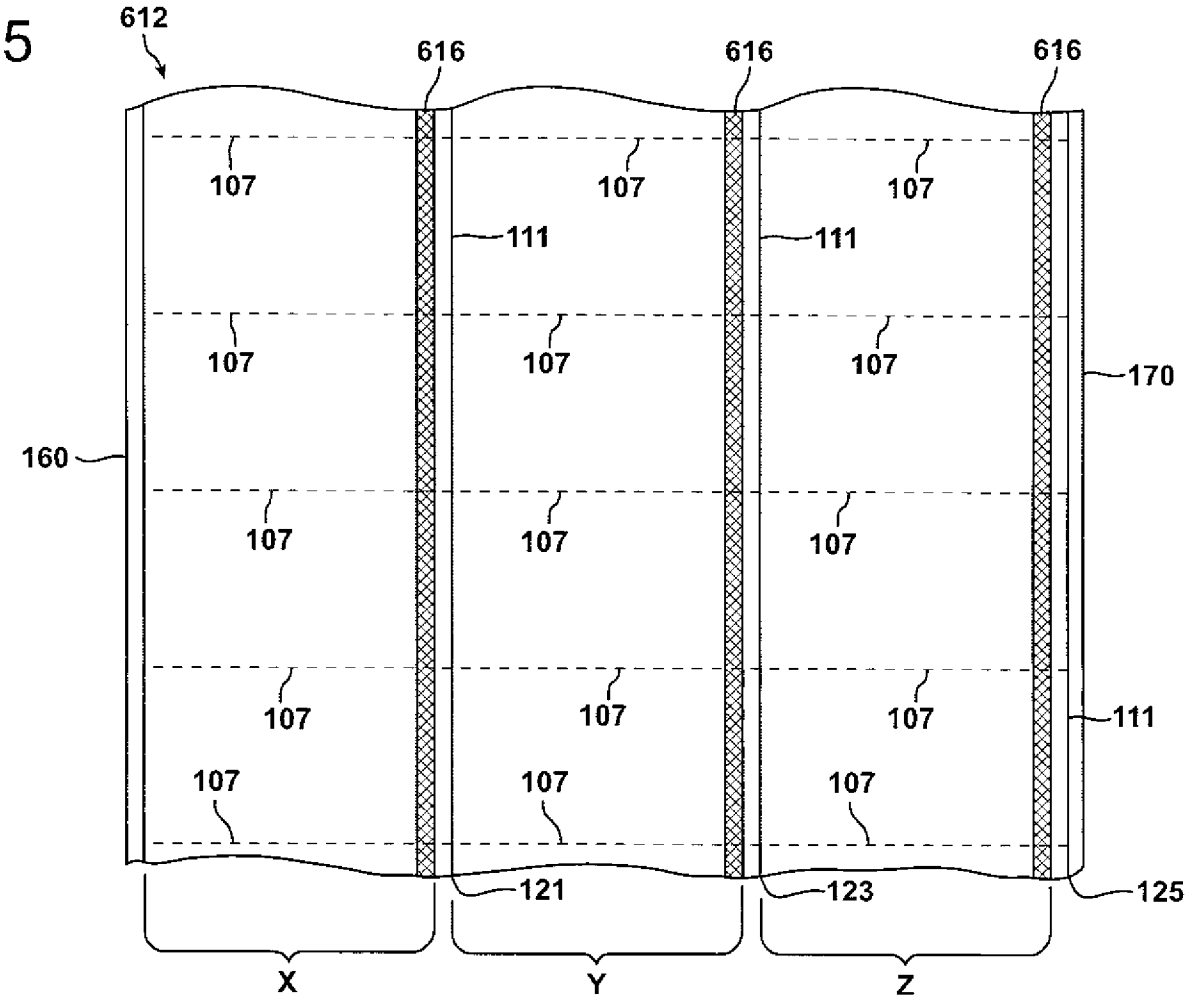
FIG. 25 is a plan view of a lidstock according to another embodiment.

FIG. 25 shows an alternative embodiment of FIG. 24, in which the lidstock is produced as described above, but "three across", so that when run in a packaging machine, with suitable machine die set-ups, three, six, etc. packages can be made simultaneously. In addition to the seal and cut steps at locations 107, the web is cut longitudinally along lines 121, 123, and 125 respectively, so that individual packages made from the longitudinal portion "X" of FIG. 25A will have a first end 121; individual packages made from the longitudinal portion "Y" of FIG. 25A will have a first end 123; and individual packages made from the longitudinal portion "Z" of FIG. 25A will have a first end 125. The discrete strip can instead be positioned at right angles to the direction of travel of web 612, and can be preapplied to the web, as in FIG. 14.

At any time before or during the method of making the package having a formed web, the first surface of the discrete strip is anchored to the inner surface of the lidstock or the lay-flat web. This can be done on the lay-flat web prior to supplying the web to the processor, or before or after sealing the lidstock to the formed web.

At any time during the method of making the package having a formed web, the second surface of the discrete strip is anchored to the inner surface of the formed web.

D. Continuous Horizontal Packaging

Figure 26:
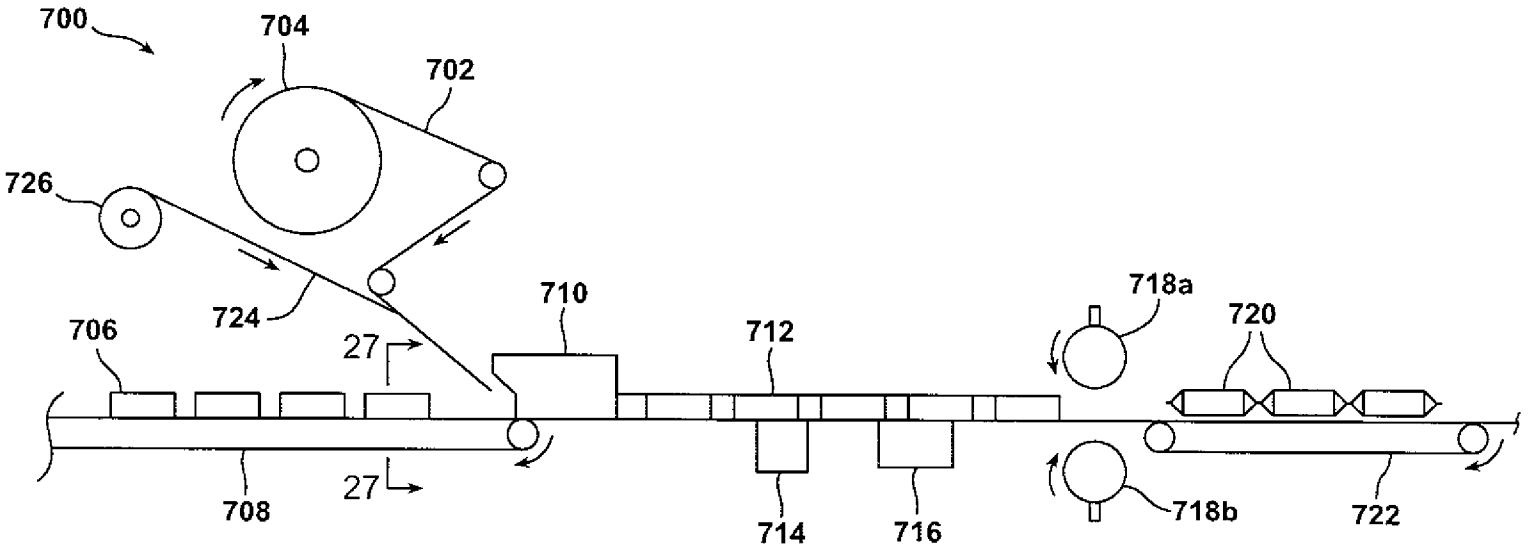
FIG. 26 is an elevational view of a continuous horizontal packaging process and apparatus for making a package.
Figure 27:
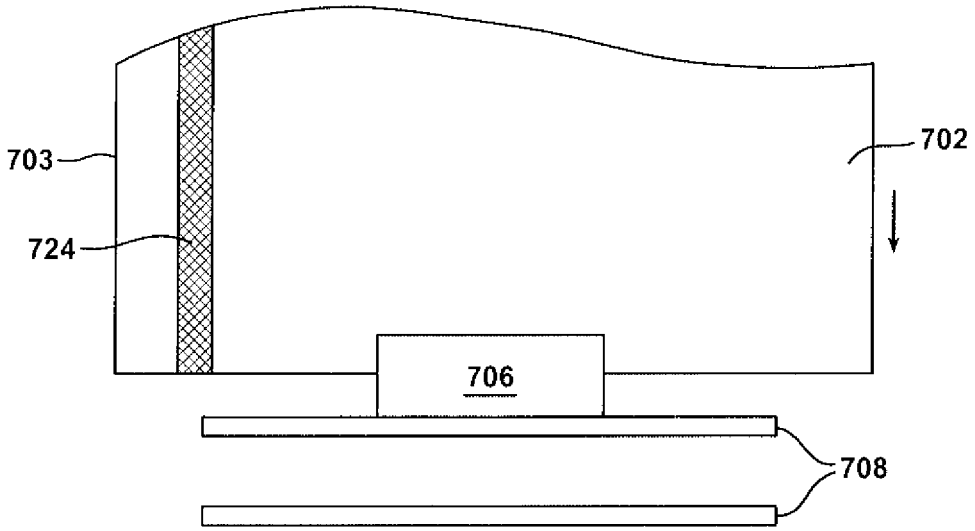
FIG. 27 a front end view of the apparatus of FIG. 26, viewed along lines 27-27 of FIG. 26.

In another embodiment, and referring to FIGS. 26 and 27, the package of the invention can be made using a continuous HFFS process and apparatus such as those used for packaging bakery and other goods, sometimes known as Flow Wrap, Flow-Wrap or Flow wrapping machines or systems, and available from manufacturers/suppliers such as Ilapak, ULMA, and Bosch.

FIG. 26 shows such a process and apparatus 700, but one in which a discrete strip 724 is installed into a package. Lay-flat web 702 is drawn from roll 704 and advanced to forming device 710. As this occurs, a series of products 706 is advanced along conveyor 708 to forming device 710, and strip 724 is drawn from roll 726 and advanced to forming device 710. Web 702 is formed by forming device 710 into folded web 712. This folded web will be like the folded web described above with respect to VFFS embodiments, but in a substantially horizontal orientation. Folded web 712 wraps around products 706. A longitudinal sealing device that can be part of forming device 710 forms a lap or fin seal (of the type disclosed above with respect to VFFS embodiments) typically at the bottom of the folded web, but can also be embodied as a fin seal along a longitudinal edge of the finished package. The lap or fin seal is typically a heat seal. An alternative is to have a separate sealing device 714 to produce the lap or fin seal. The products travel downstream from forming device 710 and sealing device 714 to transverse sealing device 716 where the folded web is transversely sealed in areas of the folded web between adjacent products. Such seals are typically heat seals. The products are advanced from transverse sealing device 716 to cutting device 718*a* and 718*b*, where the formed and longitudinally and transversely sealed folded web is severed in areas of the folded web between adjacent products, in or near the transverse seals, such that individual packages 720 are produced, having a first and second side panel.

Alternatively, the sealing function of transverse sealing device 716 and the cutting function of cutting device 718*a* and 718*b* can be combined at a single station, rather than being performed at separate locations on the production path.

Web 702 and strip 724 can be of any suitable dimension and composition, such as those disclosed herein. As strip 724 is fed to forming device 710, it can be brought into contact with, and anchored to a surface of web 702. This embodiment is shown in FIGS. 26 and 27, where strip 724 is shown as anchored parallel to, spaced apart from, and near a longitudinal edge 703 of web 702 as it progresses toward forming device 710. Alternatively, strip 724 can be fed into forming device 710, and then incorporated into folded web 712 by anchoring the strip to the interior surface of the web adjacent to the area of the formed web in which the lap or fin seal is made, and in a manner and format analogous to the embodiment of the VFFS pouch and package of FIGS. 10, 20 and 21, but in a horizontal rather than vertical position. In another embodiment, strip 724 can be pre-anchored to web 702 by the supplier of the web, analogous to the embodiment of the VFFS pouch and package of FIG. 13, and the HFFS pouch and process of FIGS. 9A and 9B. In another embodiment, the strip can be positioned at right angles to the direction of travel of web 702, and can be pre-anchored to the web, as in FIG. 14. The resulting packages will in this particular embodiment be like those illustrated in FIGS. 15 and 16.

At any time before or during the method of making the package in a continuous horizontal packaging process, the first surface of the discrete strip is anchored to the lay-flat web, the formed web, or the first side panel. This can be done on the lay-flat web prior to supplying the web to the processor, or prior to or as the lay-flat web is advanced to a forming device, or before or after advancing a product to a forming device.

At any time before or during the method of making the package in a continuous horizontal packaging process, the second surface of the discrete strip is anchored to the lay-flat web, the formed web, or the second side panel. This can be done on the lay-flat web prior to supplying the web to the processor, or prior to or as the lay-flat web is advanced to a forming device, or before or after advancing a product to a forming device.

E. Side Seal Bags

Figure 31:
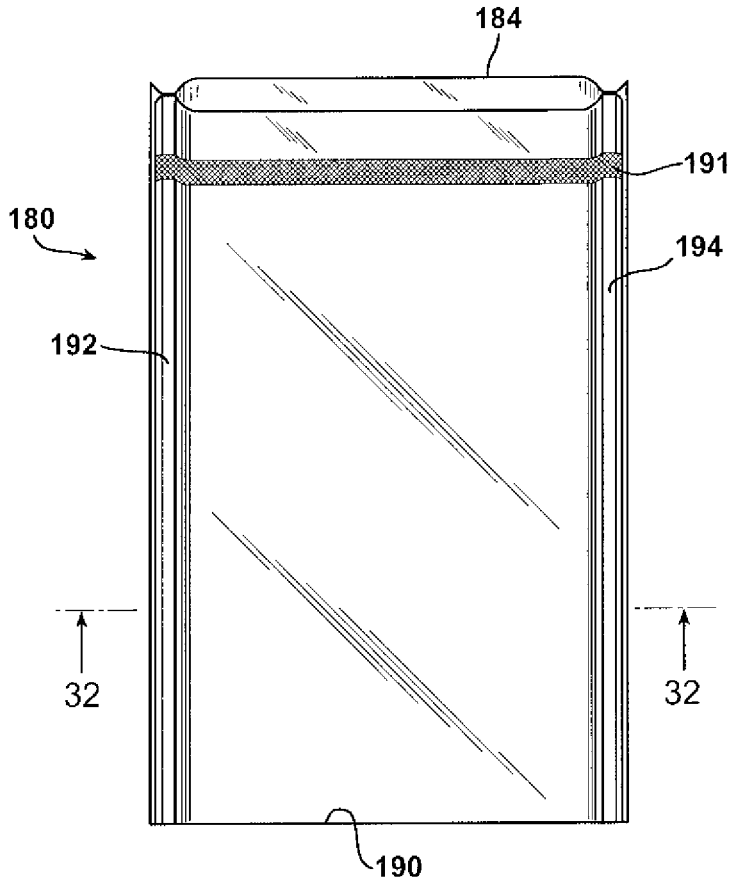
FIG. 31 is a plan view of an alternative embodiment of the invention.
Figure 32:
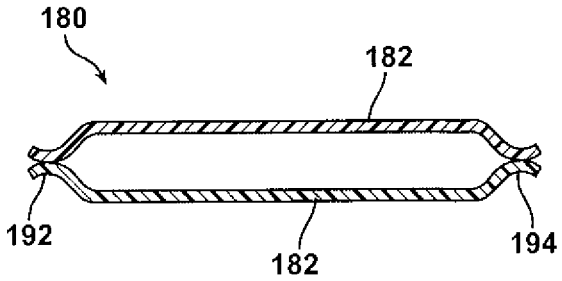
FIG. 32 is a cross sectional view of FIG. 31.

In one embodiment, and referring to FIGS. 31 and 32, the package of the invention can be made using otherwise conventional bag making equipment and processes. Bags are often made as side seal bags. The side seal bag has a factory-made heat seal at opposite bag edges. The bag bottom is formed by one of two folds of film created during the extrusion of bag tubing during manufacture. The opposite fold of film is slit to form a bag mouth. The bag is typically made from a long length of bag tubing. A method of making side seal bags is disclosed in US 2008/0138478 A1 (Ebner et al.), this patent incorporated herein by reference in its entirety.

FIGS. 31 and 32 illustrate bag 180. FIG. 31 illustrates a side seal bag 180, in a lay-flat view; FIG. 32 illustrates a cross-sectional view taken through section 32-32 of FIG. 31. With reference to FIGS. 31 and 32 together, side seal bag 180 comprises a web 182, first edge 184 defining an open mouth, edge fold 190, first side seal 192, and second side seal 194. Discrete strip is installed on the individual bag, or on a slit bag tube that is then cut and sealed at predetermined intervals to make a series of side seal bags 180, by any suitable process such as any of those disclosed herein.

A bag with a die cut and discrete strip disposed thereon can be made by extruding a thermoplastic tube to make a bag tubing; die cutting the bag tubing at predetermined intervals; slitting the tubing at one longitudinal edge thereof; and periodically transversely cutting and sealing the bag tubing to make a plurality of individual bags each with a discrete strip disposed thereon. The discrete strip and die cut can function as described herein for other embodiments and processes, in providing an easy-open and reclosable package. Some of the steps set out in US 200810138478 A1, for making a bag, are optional with respect to the present invention; such steps including irradiation and orientation of the tubing.

At any time before or during the method of making the bag, the first surface of the discrete strip is anchored to the bag tubing or slit bag tubing at a first location to create a first anchor seal 63, and at any time before or during the method of making the bag, the second surface of the discrete strip is anchored to the bag tubing or slit bag tubing at a first location to create a second anchor seal.

Method of Operation

Figure 5A:
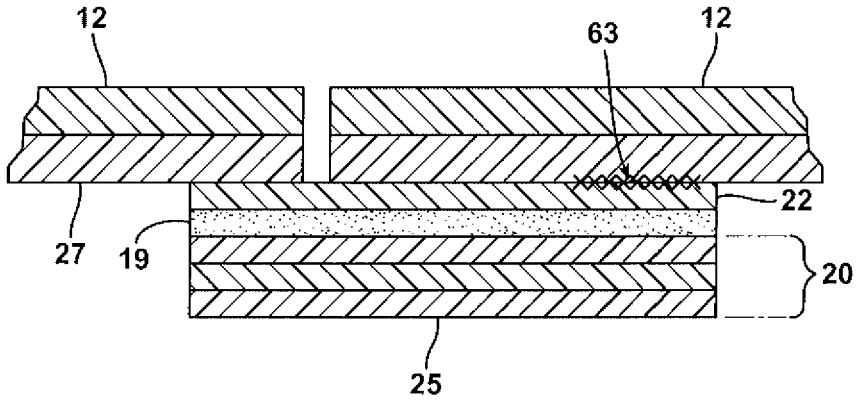
FIG. 5A is a schematic cross-sectional view of a portion of a package.
Figure 5B:
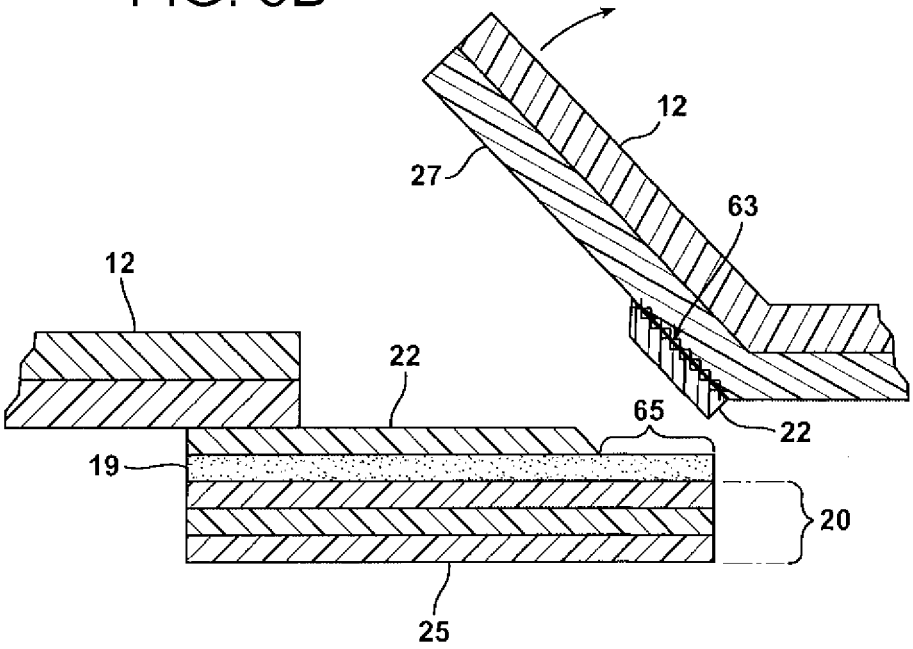
FIG. 5B is a schematic cross-sectional view of a portion of the package of FIG. 5A, shown with the package being opened.

FIGS. 5A and 5B show a sequence for opening a package in accordance with the invention. An open-loop die cut 21 defines an intermediate end of first side panel 12 which can be manually grasped and pulled up and away from the first side panel and back toward the first end of the package as a flap of material. As this action progresses, stress is put on the first anchor seal 63 that bonds a portion of the inner surface of the first side panel 12 to sealing segment 22 of discrete strip 10 in region "D" (see FIGS. 2A through 2C). Anchor seal 63 will typically be located at or near the first end 28 of discrete strip 10. As force continues to be exerted on the flap of first side panel 12, sealing segment 22 ruptures down to the PSA layer 19, as a cohesive failure mechanism, and continued pulling on the flap partially removes the sealing segment from the discrete strip, by delamination of the strip at the sealing segment/PSA interface, thereby partially exposing the intermediate layer 19 comprising a PSA. During this opening sequence, the second anchor seal 68 in region "A" that seals surface 25 of the discrete strip to surface 29 of second side panel 14 will typically remain intact, such that strip 10 as a whole, stays on and in contact with surface 29. Access to the contents of the package is achieved by pulling the first end of the remaining portion of the first side panel toward the user, i.e. away from the second side panel 14.

To reclose the package, the first end or top of the package, typically the top of the first side panel, can be placed down on the PSA, to contact the lower part of the first side panel with the exposed PSA. The package can be opened and reclosed several times.

Figure 28A:
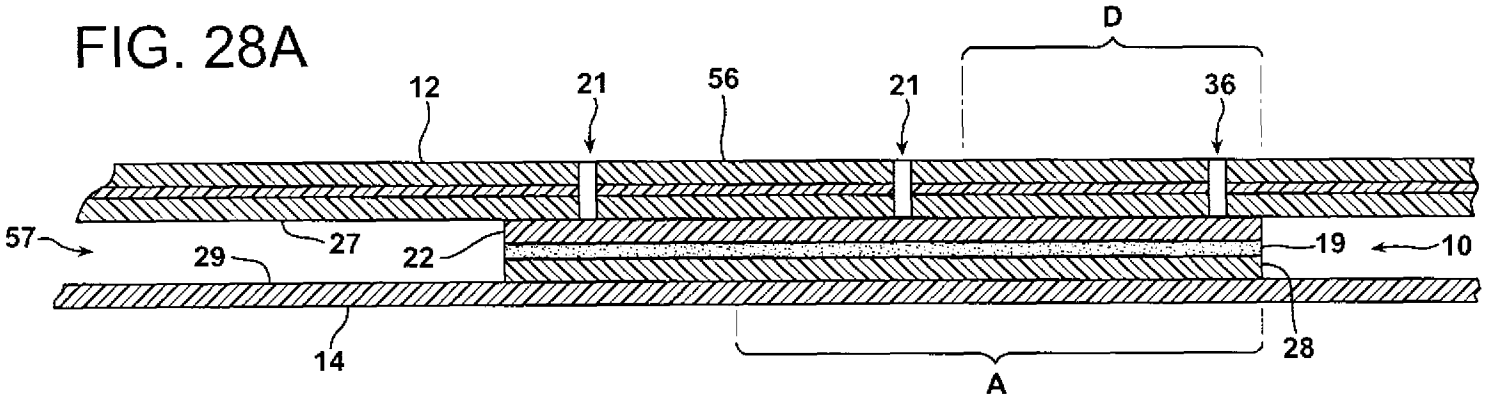
FIGS. 28A, 28B, 28C, 28D, and 28E are each cross-sectional views of a portion of the package, showing a sequence for opening and reclosing the package.
Figure 28B:
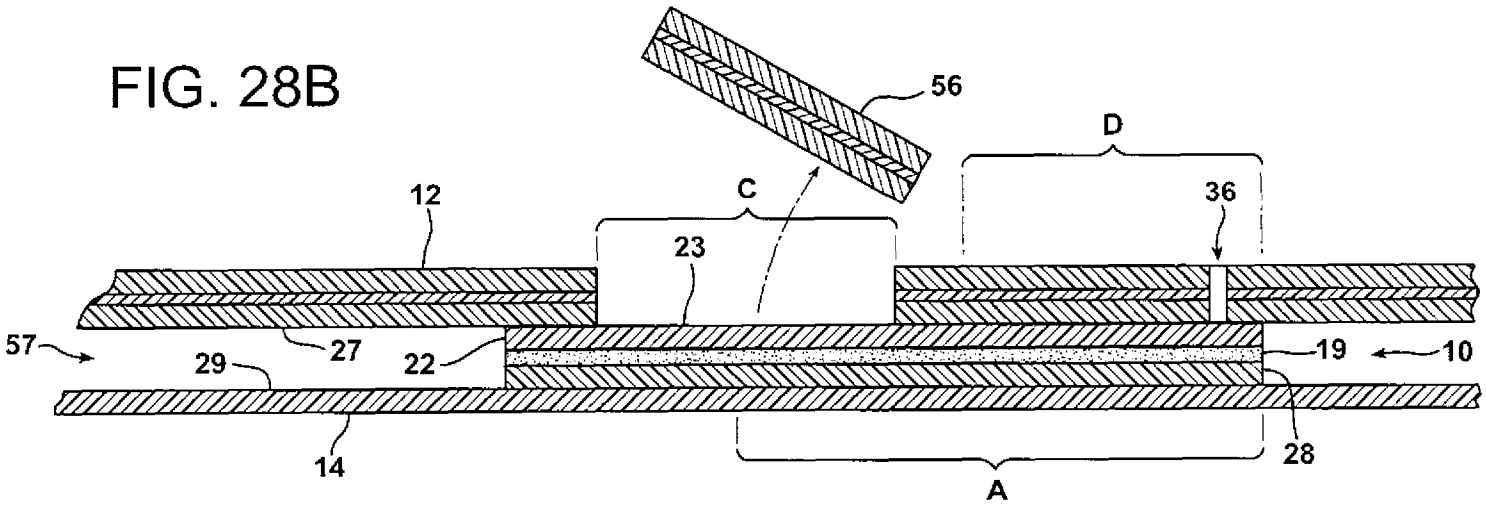
Figure 28C:
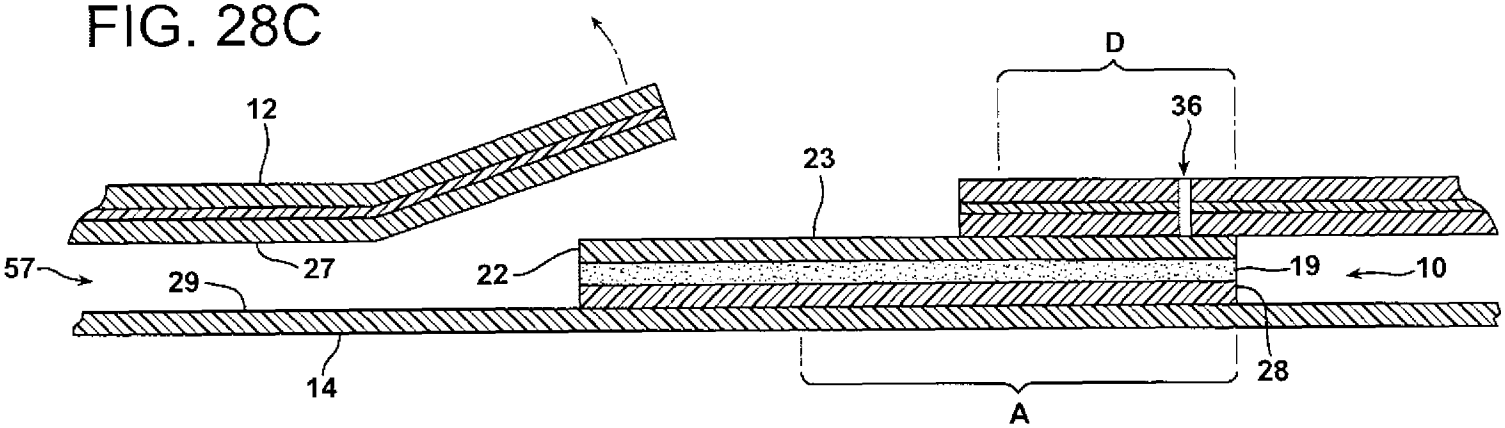
Figure 28D:
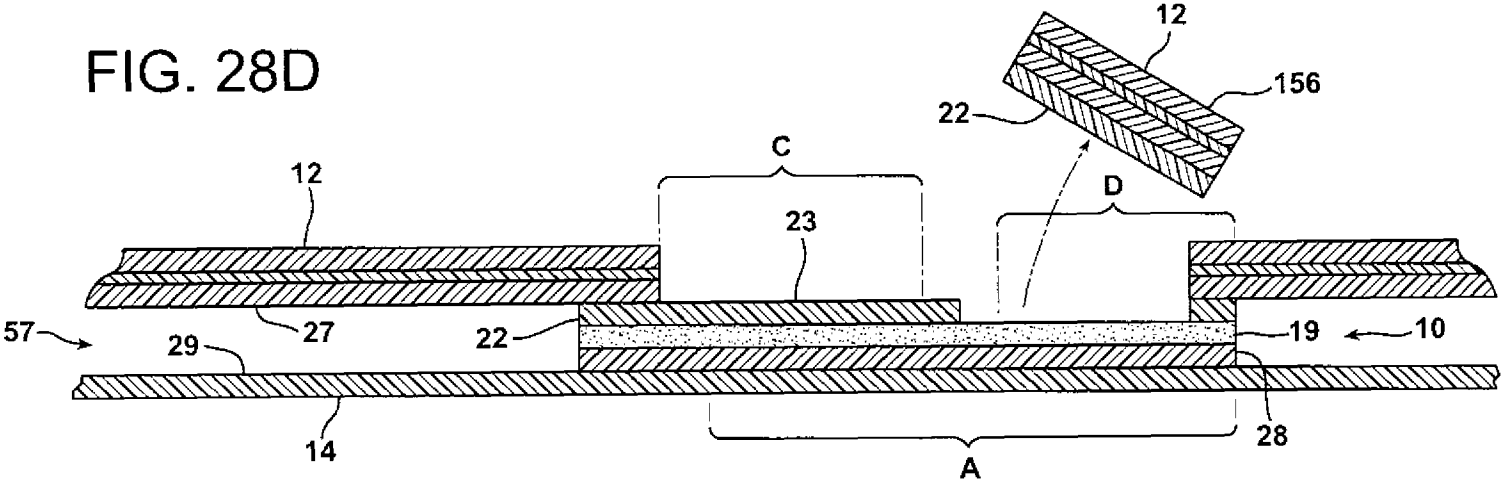

In opening the package of FIGS. 28A to 28E, primary die-cut segment 56 defined by a first closed-loop die cut 21 (see also FIGS. 29A to 29D) is removed (FIG. 28B), and the first end of the remaining portion of first side panel 12 is manually grasped and pulled away to open the package and access product in the interior 57 of the package (FIG. 28C). A secondary die cut segment 156 (see FIG. 28D) defined by secondary die cut 36 is then removed. As this action progresses, stress is put on the first anchor seal 63 that bonds a portion of the inner surface of the first side panel 12 to sealing segment 22 of discrete strip in region "D". Anchor seal 63 will typically be located at or near the first end 28 of discrete strip 10. As force continues to be exerted, sealing segment 22 ruptures down to the PSA layer 19, as a cohesive failure mechanism, and continued pulling partially removes the sealing segment from the discrete strip, by delamination of the strip at the sealing segment/PSA interface, thereby partially exposing the intermediate layer 19 comprising PSA.

Figure 28E:
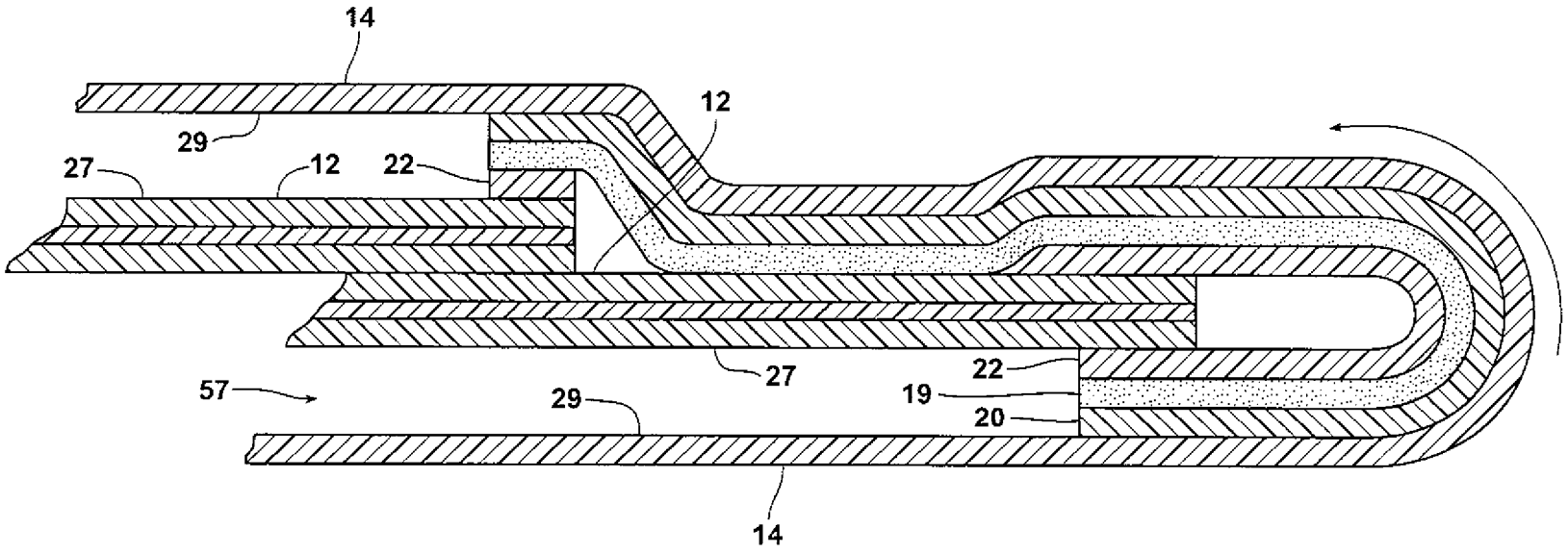
Figure 29B:
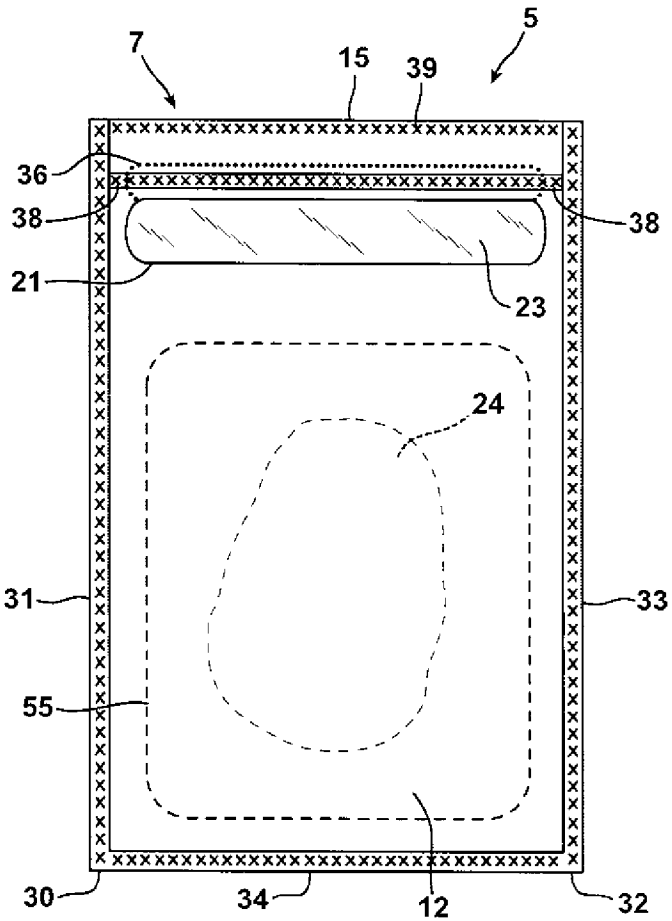
FIGS. 29A, 29B, and 29C are each plan views of the package, showing a sequence for opening and preparing to reclose the package.
Figure 29A:
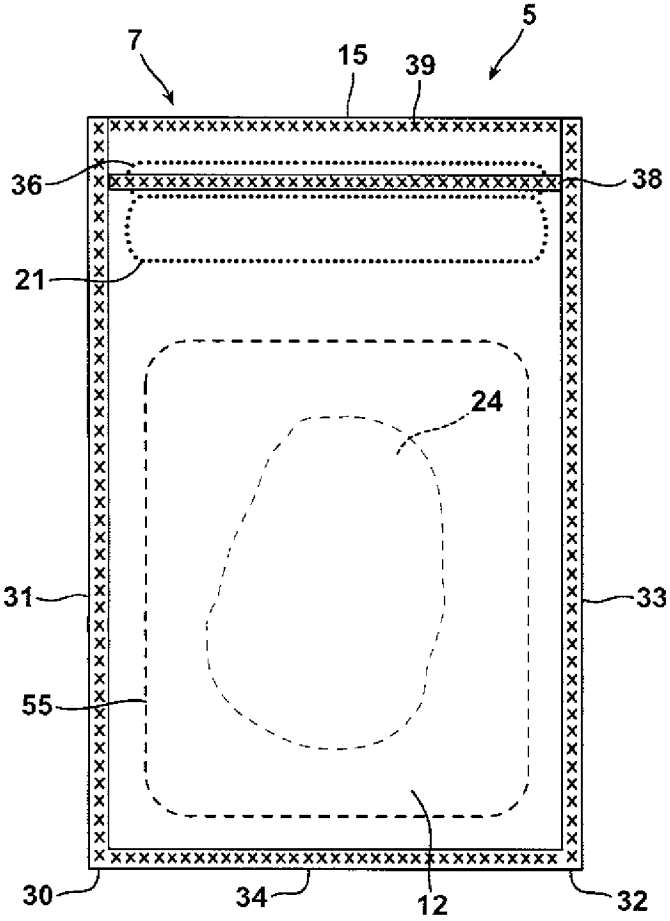
Figure 29D:
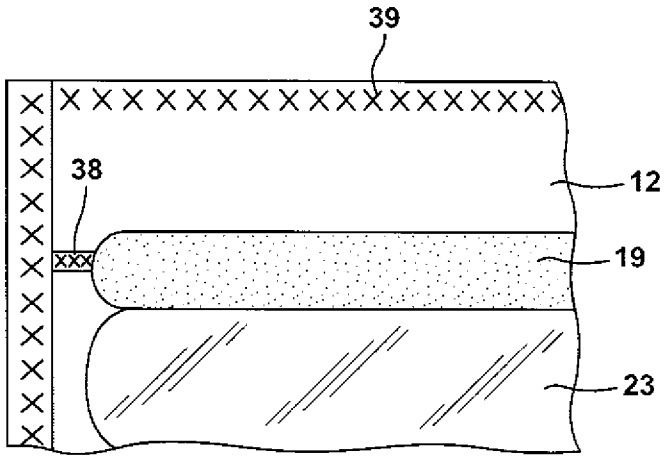
FIG. 29D is an enlarged view of a portion of the package of FIG. 29C.
Figure 29C:
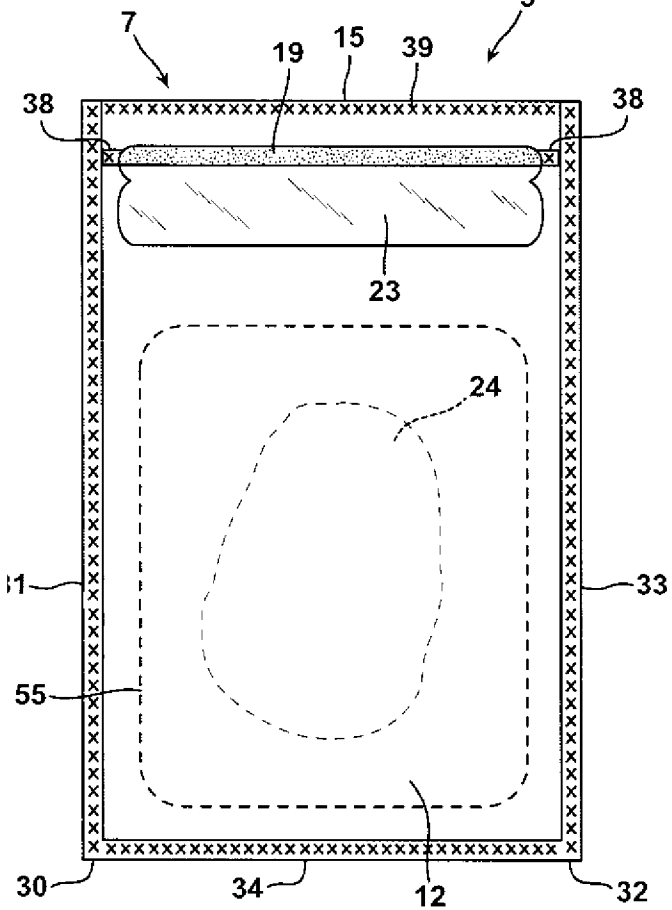

The package can then be reclosed by folding the first end or top of the package over to bring the PSA into contact with the outside surface of the first side panel 12 (see FIG. 28E). During this opening/reclosing sequence, the anchor in region "A" between second surface 25 of the strip and inner surface 29 of second side panel 14 will typically remain intact, such that a portion of the strip 10 stays on and in contact with surface 29. Here, and in FIGS. 29A through 29D and FIGS. 30B and 30C, more than one die cut is present. The first die cut in some embodiments is close-looped, i.e. the die cut defines a primary die-cut segment that can be displaced or completely removed from the first side panel of the package. The second die cut can also be closed-loop (see e.g. FIG. 30C), or can be open-loop and hinged such that the flap formed by a second die cut and a hinge line can be opened without removing the flap from the first side panel of the package (see FIG. 30B).

Figure 30A:
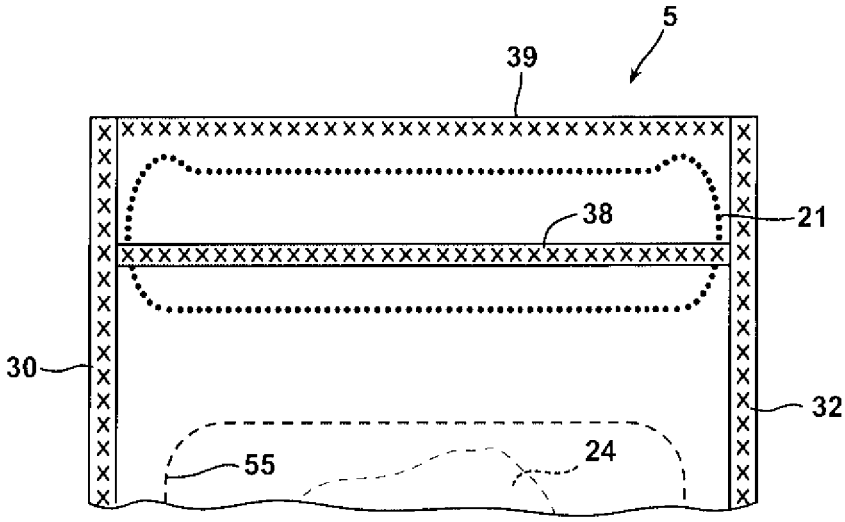
FIGS. 30A, 30B, 30C, and 30D are each a plan view of alternative embodiments.
Figure 30B:
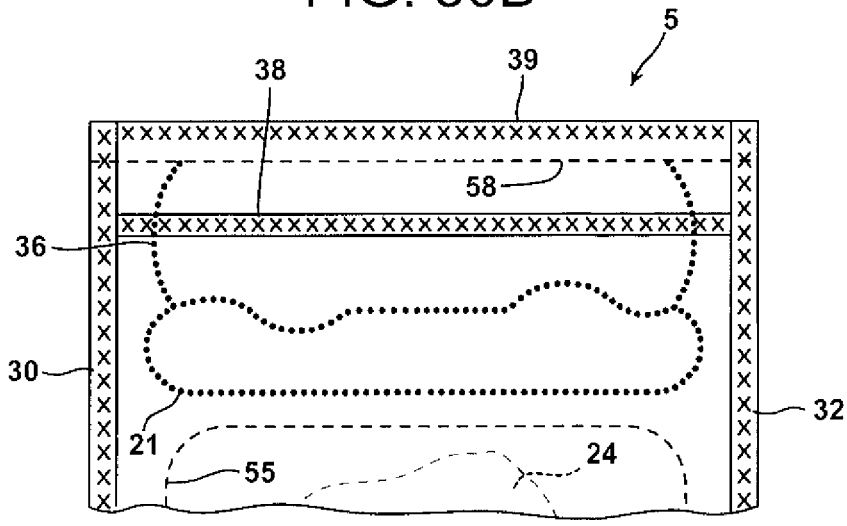
Figure 30C:
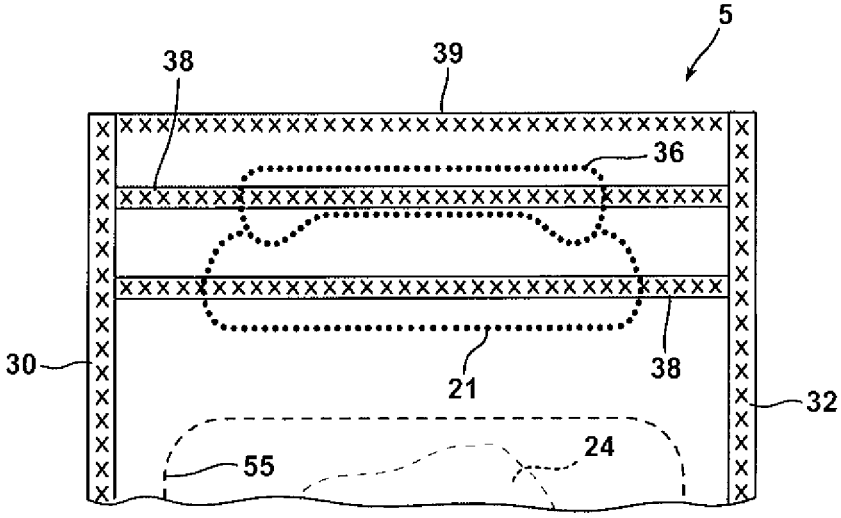
Figure 30D:
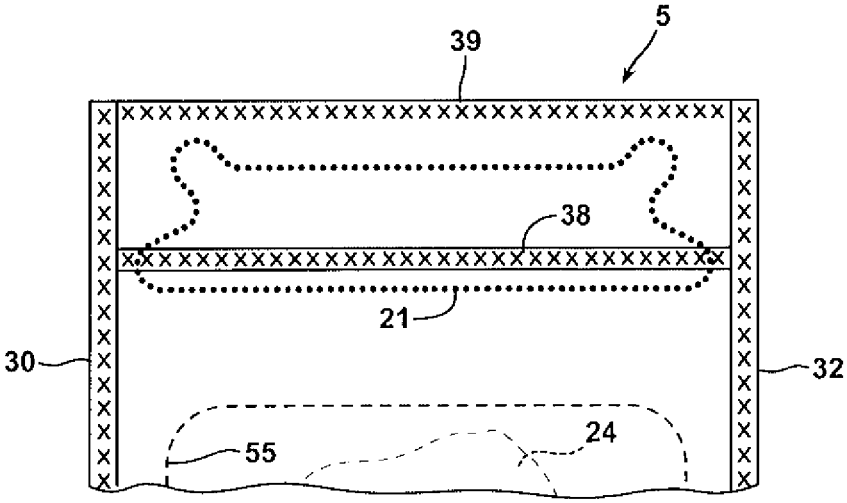

It will be noted in the embodiment of FIG. 30C that the seal 38 furthest from the first (top) end 39 of the package can act as a hermetic seal, allowing the die cut 21 defining the die cut segment to be partially a through-cut to enable the die cut segment to be easily removed, without compromising the hermeticity of the package before opening. The seal 38 closest to the first end of the package acts as an anchor seal that can be used to access the PSA as taught herein, when it is desired to reclose the package. Although the removal of the die cut segment defined by die cut 21 will result in exposure of some of the adhesive of layer 19, the main purpose of the die cut 21 in this embodiment is to provide an easy-open mechanism to open the package and allow access to the package contents.

Alternatively, a single die cut can be used, that is either close-looped (FIGS. 30A and 30D) or includes a hinge line. Each die cut can be of any suitable geometry and depth. In the area of first die cut region "C" on the first side panel of FIGS. 2A and 28A, there is no seal nor PSA holding the strip to the inner surface 27. This leaves an area of the package where a portion of the first side panel can be relatively easily removed. PSA layer 19 is not initially exposed when the package is opened in each of these embodiments. To reclose the package, a secondary die cut segment is removed to expose the PSA. A portion of the second side panel can be folded over to allow the PSA to contact the front panel. Alternatively, removal of a single or primary die cut segment can expose the PSA as well as provide an opening for accessing product in the package. The package can be opened and reclosed several times.

Method of Making a Die Cut in a Web

A conventional die cutter can be used to create a first die cut 21, and optionally one or more additional die cuts 36 in a web that is used to make first side panel 12. Die cuts can be made by any suitable conventional process and equipment. Any suitable pattern of die cut can be used, open or closed-loop, as long as it serves the function of providing an easy open package in which the packaged product can be accessed at least in part by the removal or displacement of the die cut. Alternative patterns include elliptical, oval, triangular, three side rectangle, hour glass, "dog bone", and other regular and irregular shapes.

The die cut extends completely through the first side panel, or may extend through most of, but not entirely through, the thickness of the panel. The die cut may extend through e.g. at least 50% of the thickness of the first side panel, e.g. at least 60%, at least 70%, at least 80%, at least 90%, at least 95%, or 100% of the thickness of first side panel 12.

A laser system can be configured to produce a laser cut that cuts partly or completely through the panel, or alternatively, a die cut can be made using a mechanical cutting system using rotary engraved dies, or steel rule dies supported in platens as used in reciprocating presses. The choice of die cutting technique depends on several factors, including the thickness and physical nature of the film or web to be cut.

The die cut may act as a tamper evident feature.

The die cutting of a web to produce a first side panel, and the assembling of a package incorporated a die cut web and a discrete strip, can be done at a single location, but more practically will typically be done at separate locations, with the assembling of the package by a packager using pre-provided discrete strip and a die cut web prepared elsewhere and provided in advance of the packaging process.

In some embodiments, a first portion of the primary die cut segment of the invention has a score, and a second portion of the die cut has a through cut.

In some embodiments, in particular those in which a hermetic package is desired, the portion of the die cut or die cuts that is cut all the way through the first side panel is bracketed or surrounded collectively by the top seal of the package, the side seals of the package, and the first anchor seal.

In an alternate embodiment, two die cut segments may be present in the first side panel. The primary die cut segment can be removed or displaced to open the package and access the contents of the package. The secondary die cut segment is in one embodiment at least partially underlain by the discrete strip but the primary die cut segment is in one embodiment not underlain by the PSA. Thus, in initially opening the package, the PSA is not exposed. In other embodiments, the primary die cut segment may be partially underlain by the discrete strip, such that in initially opening the package, the PSA is exposed to a limited extent. In either embodiment, when it is desired to reclose the package, the secondary die cut segment is removed or displaced, the underlying PSA 19 is exposed, and the package is folded over to bring the PSA into contact with the outer surface of the first side panel 12 and close the package.

In embodiments where hermeticity is required, and where a portion of a die cut is a through-cut extending entirely through the web or first side panel, a seal is installed in the first side panel, sealing the first side panel to the strip, and the seal is positioned between any through-cut portion of the die cut, and the interior of the package.

The secondary die cut segment is in one embodiment defined by a closed loop die cut, and the secondary die cut segment is removed so that the sealing segment is at least partially removed, the underlying PSA 19 is at least partially exposed, and the package is folded over to bring the PSA into contact with the outer surface of the first side panel 12 and close the package. It will be appreciated that thereafter, subsequent removal of package contents can potentially come in contact with and contaminate the now exposed PSA. Thus in an alternative embodiment, the secondary die cut segment is defined by an open loop die cut. This results in a flap that is displaced but not completely removed when exposing the PSA. The flap can be held back while reclosing the package. When it is desired to reaccess the contents of the package, the package can be reopened, and the flap can be placed over the PSA to recover the PSA before package contents are withdrawn from the package. Depending on the placement and configuration of the secondary die cut segment, nature of the materials, etc. the flap may exhibit a tendency to close over the PSA, aiding this step. This protects the PSA from contamination by the package contents.

PACKAGE EXAMPLES

Example 1

A package is made in accordance with the embodiment illustrated in FIG. 2B and described herein, in a horizontal form/fill/seal system. First and second side panels 12 and 14 respectively each comprise H7530B, a laminate having the construction:

| chemically treated PET | polyurethane adhesive | coextruded barrier film |
|---|---|---|

where the PET is a biaxially oriented polyester film, and the coextruded barrier film has the construction:

| Layer 1 | Layer 2 | Layer 3 | Layer 4 | Layer 5 | Layer 6 | Layer 7 |
|---|---|---|---|---|---|---|
| PE2 | EV1 | AD2 | OB1 | AD2 | EV1 | 76% PE3 + 20% PE4 + 4% AB1 |
| 0.63 | 0.33 | 0.19 | 0.23 | 0.19 | 0.33 | 0.63 |

The overall thickness of the coextruded barrier film is about 2.50 mils. Layer gauges in mils for each layer are indicated below each layer. Layer 7 is the layer of the barrier film adhered, by the adhesive, to the PET film. Layer 1 is the heat sealant layer of the film, and the EAO (PE2) of layer 1 forms the inner or sealant surface of the package, facing the contained product, and the PET forms the outer or skin surface of the package. The thickness of the PET film is about 0.48 mils. The overall thickness of the laminate is about 3.0 mils.

Alternatives to the composition of layer 7 include various combinations of materials, including:

96% PE3+4% AB1.

100% PE3.

76% PE3+20% PE6+4% AB1.

The discrete strip of the package is a film as described herein for Example 11.

Before the package is made, the discrete strip is anchored to the H7530B web (specifically, to layer 1 of the coextruded barrier film of the H7530B laminate) to form first and second anchor seals while the latter is in a lay-flat condition. A closed loop die cut is made in the web by a $CO_2$ laser prior to applying the strip to the web; the die cut defining a die cut segment that is positioned so as to result in the package as shown in FIG. 2D.

Example 2

A package like that of Example 1 is made, but in which the coextruded barrier film of the first and second side panel is a nine-layer film with a composition very similar to the seven layer film construction of Example 1, but having an additional intermediate layer of EV1, and an additional intermediate layer of a LDPE or a blend including LLDPE.

The above descriptions are those of embodiments of the invention. All parts and percentages are by weight, unless otherwise indicated or well understood in the art. Except in the claims and the specific examples, or where otherwise expressly indicated, all numerical quantities in this description indicating amounts of material, reaction conditions, use conditions, molecular weights, and/or number of carbon atoms, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. All references to ASTM tests are to the most recent, currently approved, and published version of the ASTM test identified, as of the priority filing date of this application. Each such published ASTM test method is incorporated herein in its entirety by reference.

Terms referring to polymers, such as polyester, polyamide, and polyolefin, refer herein to both homopolymers and copolymers thereof, unless otherwise specified.

With reference to the drawings, the flow of materials is in the direction of the arrows.

Those of skill in the art will recognize that the drawings herein are not necessarily to scale, and certain features of the invention may be graphically exaggerated for clarity.

The web or webs used in the manufacture of the package according to the invention, and the discrete strip, can be made by any suitable process, including coextrusion, extrusion coating, extrusion lamination, and conventional lamination using polyurethane or other adhesives. These manufacturing processes are well known in the art. Extrusion can be done in annular or flat (slot) dies. The extrudate can be hot blown or cast, and optionally solid-state oriented as desired. For example, in one embodiment the film from which the discrete strip is made can be fully coextruded. In a second embodiment, in an extrusion coating process, a multilayer substrate film is coextruded, having an intermediate layer of coextruded PSA; and another layer of material is extrusion coated onto the multilayer substrate to make up the final laminate from which the discrete strip is made by slitting. In this second embodiment, the multilayer substrate comprises the sealing segment and the PSA layer; the extrusion coated layer of material comprises the backing segment. In a third embodiment, the multilayer substrate comprises the backing segment and the PSA layer; the extrusion coated layer of material comprises the sealing segment. In a fourth embodiment, in an extrusion lamination process, a multilayer substrate film is coextruded; a second multilayer substrate film is coextruded; a PSA is coated onto a surface of at least one of the substrates; and the first and second substrates are brought together, such that they are bonded together at the PSA-coated surface, to form a multilayer laminate having an intermediate layer of PSA. In this embodiment, the first multilayer substrate comprises the sealing segment; and the second multilayer substrate comprises the backing segment. Chemical or electronic crosslinking of one or more layers of the webs or the strip can be done. Both web and strip can be advanced by suitable motive means (not shown, and well known in the art, such as a motor) from their respective rolls.

A package according to the invention can optionally carry printed indicia, which can be decorative or informational in nature. Decorative printed indicia can include a logo, a trademark, product information, etc. with text and/or graphics.

Printed indicia can be in the form of a message e.g. "easy open" or "open here". This can be printed in scattered process (i.e. registration is not required) on or near the first end of the package. The message is surface printed or reverse printed.

In some embodiments, such as those shown in FIGS. 8 to 14, it may be beneficial to adhere the discrete strip to the lay-flat web prior to processing on equipment, or at the time, before processing, when the strip is disposed on the web. Any suitable means, such as permanent adhesive or heat sealing, can be used to seal the strip to the web to ensure that the strip maintains its position on the web during processing. In these embodiments, the strip is anchored to the web at the interface between the web and the surface of the strip comprising a sealant layer that provides a relatively strong seal. The strip can be e.g. sealed to the web by a suitable device (not shown) such as a heat sealer, disposed below the web (see FIGS. 8 and 12) while the web is in its lay-flat condition, that seals the strip to the web. In such embodiments, the surface of the discrete strip that comprises the easy-open surface faces away from the web, so that the opposite surface of the discrete strip is sealed to the web. This approach leaves the easy-open surface unaffected until such time as the package is made and closed, or until e.g. the lap or fin seal is made on the pouch.

In the embodiments disclosed herein, the first end of the package can be sealed, typically where two webs are used to make the package. Alternatively, the first end of the package can be a fold, e.g. where a single web of material is used to make the package.

The present invention, including the package and methods as disclosed herein, is provided in several embodiments in the absence of: plastic zipper closures; press-to-close or slide zippers; interlocking closures; reclosable fasteners with interlockable fastener elements; interlocking rib and groove elements having male and female profiles; interlocking alternating hook-shaped closure members, and the like. The package of the invention is provided herein in the absence of a release liner for a PSA layer or coating. None of these aforementioned closures, zippers, elements, etc. is present in the package of the invention.

Although the invention is described in some embodiments herein as a package comprising a pouch comprising a first and second side panel each having a top edge, a first side edge, and a second side edge, those skilled in the art will understand, after a review of this disclosure, that in some embodiments, wherein a single web is used, the terms "side panel", "top edge", "first side edge", "second side edge", and the like are used for convenience to describe the relative locations or regions on a single web made into a pouch, so that the overall geometry of the package, and relative positions of the various features of the invention can be described. Thus, for instance, the first and second panels in a single web embodiment of the invention can be simply defined regions of the pouch, and the package made therefrom, and side edges are simply the side end lines of those regions. In such embodiments, the line of jointer of the side edges are the two side folds in the web that define the sides of the package. In contrast, in embodiments with two webs, each web when produced will have an identifiable first and second side edge, that will each be joined to a respective side edge of a second web.

Although the first and second side panels are shown in various embodiments as having the same length, the second side panel can in some embodiments be longer than the first side panel, i.e. the first end of the second side panel can extend beyond the first end of the first side panel, or vice versa. The extended portion can e.g. accommodate a hang tab with a hole therein, or function as a fold-over flap for reclosing the package after opening.

In some embodiments, a seal can be applied obliquely across each of the two corners of the first side panel of a package of the invention, closest to the first end of the package, such that they cross over and seal two corners of the discrete strip to the first side panel. These angled seals can be useful in facilitating the reclosure of the package after opening, and/or in assuring the integrity of the package before initial opening. The seals can overlap a portion of a die cut 21 in the first side panel at upper edges of the die cut. Optionally, the die cut can be discontinuous in the regions of the die cut where the angled seals are present.

In some embodiments, a die cut can be installed on the second side panel near its first end, or the region of a lay-flat web or folded web that will form the second side panel, that can act as a fold line for facilitating production of or reclosure of the package. This die cut, which can be a score, can be of any suitable geometry, e.g. a straight line, positioned to ease or direct the folding of the web during processing, or of the second side panel to reclose the package after opening.

Those skilled in the art will appreciate that in describing a panel, strip or the like being "sealed" to another panel, strip, or the like, sealing is done by conventional means as described, and typically occurs in seal widths consistent with industry practice for packaging.

Packages of the various embodiments of the invention disclosed herein can optionally be vacuumized or gas flushed by otherwise conventional means. A package in accordance with the invention can contain a modified atmosphere.

What is claimed is:

1. An easy-open and reclosable package comprising:

a) a pouch comprising i) a first and second side panel each comprising an outer and inner surface, a first and second side edge, and a first and second end, the first and second side panels joined together along their respective first and second side edges;

ii) a first end defined by the first end of at least one of the first and second side panels;

iii) a second end defined by the second ends of the first and second side panels respectively;

iv) the first and second side panels joined together along their respective second ends;

v) a discrete strip, disposed between the first and second side panels, comprising a first and second surface, a first and second end, a first and second side edge, a sealing segment, a backing segment, and an intermediate layer disposed between the sealing and backing segments and comprising a pressure sensitive adhesive, the discrete strip spaced apart from at least one of the first end of the pouch, and the second end of the pouch;

vi) a first anchor seal whereby the first surface of the discrete strip is anchored to the inner surface of the first side panel; and vii) a second anchor seal whereby the second surface of the discrete strip is anchored to the inner surface of the second side panel;

viii) a closed-loop die cut disposed in the first side panel, the closed-loop die cut defining a primary die cut segment spaced from the first and second ends of the package, wherein the primary die cut segment includes a first portion wherein the die cut extends partially through the first side panel, and a second portion wherein the die cut extends entirely through the first side panel, the primary die cut segment so arranged with respect to the discrete strip and the first anchor seal that when the primary die cut segment is removed, the package is opened, ix) a secondary closed-loop die cut segment disposed between the primary die cut segment and an end of the package, and spaced from the first and second ends of the package, wherein the secondary closed-loop die cut segment includes a first portion wherein the die cut extends partially through the first side panel, and a second portion wherein the die cut extends entirely through the first side panel, the secondary closed-loop die cut segment so arranged with respect to the discrete strip that when the secondary die cut segment is removed at the first anchor seal, the sealing segment is at least partially removed from the discrete strip, and the intermediate layer comprising the pressure sensitive adhesive is at least partially exposed at the first anchor seal, such that the package can thereafter be reclosed by adhering the pressure sensitive adhesive to the first side panel; and x) the first end of the first side panel joined to the second side panel; and b) a product disposed in the pouch.

2. The package of claim 1 wherein the package can be opened with a peel force of from 25 grams/inch to 5 pounds/inch.

3. The package of claim 1 wherein the primary die cut segment is spaced apart from a first and second side seal respectively.

4. The package of claim 1 wherein the package can thereafter be reclosed by adhering the pressure sensitive adhesive to the first side panel, by folding over a portion of the second side panel to allow the pressure sensitive adhesive to contact the first side panel.

* * * * *